US009595222B2

(12) United States Patent
Takahara

(10) Patent No.: US 9,595,222 B2
(45) Date of Patent: Mar. 14, 2017

(54) IMAGE DISPLAY APPARATUS

(71) Applicant: JOLED INC., Tokyo (JP)

(72) Inventor: Hiroshi Takahara, Osaka (JP)

(73) Assignee: JOLED INC., Tokyo (JP)

( * ) Notice: Subject to any disclaimer, the term of this patent is extended or adjusted under 35 U.S.C. 154(b) by 81 days.

(21) Appl. No.: 14/433,479

(22) PCT Filed: Oct. 7, 2013

(86) PCT No.: PCT/JP2013/005966

§ 371 (c)(1),
(2) Date: Apr. 3, 2015

(87) PCT Pub. No.: WO2014/057650

PCT Pub. Date: Apr. 17, 2014

(65) Prior Publication Data

US 2015/0255015 A1 Sep. 10, 2015

(30) Foreign Application Priority Data

Oct. 9, 2012 (JP) ..... 2012-223886
Oct. 17, 2012 (JP) ..... 2012-229448

(51) Int. Cl.
*G09G 3/30* (2006.01)
*G09G 3/32* (2016.01)

(52) U.S. Cl.
CPC ..... *G09G 3/3225* (2013.01); *G09G 3/3233* (2013.01); *G09G 3/3266* (2013.01);
(Continued)

(58) Field of Classification Search
CPC ..... G09G 3/32; G09G 3/3233; G09G 3/3225; G09G 3/3266
(Continued)

(56) References Cited

U.S. PATENT DOCUMENTS 6,407,796 B2 6/2002 Tajima et al.
6,847,172 B2 1/2005 Suzuki
(Continued)

FOREIGN PATENT DOCUMENTS

JP 10-214858 8/1998
JP 2001-264731 9/2001
(Continued)

OTHER PUBLICATIONS

U.S. Appl. No. 14/435,189 to Hiroshi Takahara, filed Apr. 13, 2015.
(Continued)

*Primary Examiner* — Vijay Shankar
(74) *Attorney, Agent, or Firm* — Greenblum & Bernstein, P.L.C.

(57) ABSTRACT

The first and second gate driver circuits each include N shift register units. An M1th (M1 is an integer not less than one and not more than L) stage of each of a first to Nth ones of the shift register units of the first gate driver circuit is connected to a first to Nth ones of the gate signal lines in an M1th one of the effective pixel rows. An M2th (M2 is an integer not less than one and not more than L×a/N) stage of each of a (a+1)th to Nth ones of the shift register circuits of the second gate driver circuit is connected to a first to ath ones of the gate signal lines in one of the L effective pixel rows other than an M2th one of the L effective pixel rows.

20 Claims, 56 Drawing Sheets

(52) U.S. Cl.
CPC ..... *G09G 2300/0408* (2013.01); *G09G 2300/0809* (2013.01); *G09G 2300/0819* (2013.01); *G09G 2300/0842* (2013.01); *G09G 2300/0852* (2013.01); *G09G 2300/0861* (2013.01); *G09G 2300/0866* (2013.01); *G09G 2310/0262* (2013.01); *G09G 2310/0283* (2013.01); *G09G 2310/08* (2013.01)

(58) Field of Classification Search
USPC ..... 345/76–83
See application file for complete search history.

(56) References Cited

U.S. PATENT DOCUMENTS

| | | | |
|---|---|---|---|
| 7,283,193 | B2 | 10/2007 | Sugimoto et al. |
| 7,599,193 | B2 | 10/2009 | Park et al. |
| 7,705,812 | B2 | 4/2010 | Yuda et al. |
| 7,830,489 | B2 | 11/2010 | Kim |
| 7,868,865 | B2 | 1/2011 | Shin et al. |
| 7,948,768 | B2 | 5/2011 | Park et al. |
| 8,130,187 | B2 | 3/2012 | Nakao et al. |
| 8,243,107 | B2 | 8/2012 | Matsui et al. |
| 8,289,350 | B2 | 10/2012 | Matsui et al. |
| 8,294,701 | B2 | 10/2012 | Matsui et al. |
| 8,547,307 | B2 | 10/2013 | Shirouzu et al. |
| 8,553,023 | B2 | 10/2013 | Yoshizaki et al. |
| 8,649,477 | B2 | 2/2014 | Matsui |
| 8,692,741 | B2 | 4/2014 | Shin |
| 8,699,656 | B2 | 4/2014 | Matsui |
| 8,890,778 | B2 | 11/2014 | Shirouzu et al. |
| 8,917,227 | B2 | 12/2014 | Osako |
| 8,933,870 | B2 | 1/2015 | Higashijima et al. |
| 9,049,784 | B2 | 6/2015 | Osako |
| 9,111,490 | B2 * | 8/2015 | Ra ..... G09G 3/3266 |
| 9,129,920 | B2 * | 9/2015 | Masumoto ..... G09F 9/00 |
| 9,226,432 | B2 * | 12/2015 | Yamakita ..... G09F 9/00 |
| 2001/0040664 | A1 | 11/2001 | Tajima et al. |
| 2002/0180686 | A1 | 12/2002 | Yuda et al. |
| 2003/0098657 | A1 | 5/2003 | Suzuki |
| 2004/0041766 | A1 | 3/2004 | Nakao et al. |
| 2004/0061825 | A1 | 4/2004 | Sugimoto et al. |
| 2005/0121796 | A1 | 6/2005 | Park et al. |
| 2006/0001621 | A1 | 1/2006 | Ono et al. |
| 2006/0055649 | A1 | 3/2006 | Yuda et al. |
| 2006/0114196 | A1 | 6/2006 | Shin et al. |
| 2006/0233003 | A1 | 10/2006 | Iwanaga et al. |
| 2007/0063950 | A1 | 3/2007 | Shin |
| 2007/0167036 | A1 | 7/2007 | Kim |
| 2008/0150933 | A1 | 6/2008 | Toyomura et al. |
| 2009/0073100 | A1 | 3/2009 | Kim et al. |
| 2009/0184899 | A1 | 7/2009 | Kim et al. |
| 2009/0251446 | A1 | 10/2009 | Ogawa et al. |
| 2010/0149775 | A1 | 6/2010 | Park et al. |
| 2010/0289788 | A1 | 11/2010 | Yoshizaki et al. |
| 2011/0102729 | A1 | 5/2011 | Kawamura et al. |
| 2011/0273408 | A1 | 11/2011 | Ra et al. |
| 2012/0075282 | A1 | 3/2012 | Higashijima et al. |
| 2014/0131693 | A1 | 5/2014 | Masumoto et al. |
| 2014/0160674 | A1 | 6/2014 | Yamakita |
| 2015/0116194 | A1 | 4/2015 | Matsui et al. |
| 2015/0255015 | A1 | 9/2015 | Takahara |
| 2015/0279272 | A1 | 10/2015 | Takahara |
| 2016/0163264 | A1 | 6/2016 | Nishimura et al. |
| 2016/0171933 | A1 | 6/2016 | Takahara et al. |

FOREIGN PATENT DOCUMENTS

| | | |
|---|---|---|
| JP | 2002-098939 | 4/2002 |
| JP | 2003-050402 | 2/2003 |
| JP | 2003-167269 | 6/2003 |
| JP | 2003-167551 | 6/2003 |
| JP | 2004-133428 | 4/2004 |
| JP | 2005-167238 | 6/2005 |
| JP | 2006-049514 | 2/2006 |
| JP | 2006-154822 | 6/2006 |
| JP | 2007-086728 | 4/2007 |
| JP | 2007-188078 | 7/2007 |
| JP | 2008-158378 | 7/2008 |
| JP | 2010-145893 | 7/2010 |
| JP | 2010-266715 | 11/2010 |
| JP | 2010-282060 | 12/2010 |
| JP | 2011-237763 | 11/2011 |
| JP | 2012-058748 | 3/2012 |
| JP | 2012-060514 | 3/2012 |
| JP | 2012-068592 | 4/2012 |

OTHER PUBLICATIONS

U.S. Appl. No. 14/434,851 to Hiroshi Takahara, filed Apr. 10, 2015.
International Search Report (ISR) in International Patent Application No. PCT/JP2013/006030, dated Jan. 7, 2014.
International Search Report (ISR) in International Patent Application No. PCT/JP2013/005984, dated Dec. 3, 2013.
International Search Report (ISR) in International Patent Application No. PCT/JP2013/005966, dated Jan. 21, 2014.
Office Action from United States Patent and Trademark Office (USPTO) in U.S. Appl. No. 14/434,851, dated Sep. 22, 2016.

* cited by examiner

IMAGE DISPLAY APPARATUS

TECHNICAL FIELD

The present disclosure relates to an active-matrix image display apparatus including a current light-emitting element.

BACKGROUND ART

Recent years have seen commercialization of display panels including pixel circuits arranged in a matrix each of which includes an organic electroluminescence (hereinafter referred to as an EL or an OLED in some cases) element, and an image display apparatus including the display panel. The EL element emits light upon application of a current to a light emitting layer disposed between an anode electrode and a cathode electrode.

Each of the pixel circuits includes transistors. Furthermore, the display panel includes gate signal lines of different kinds for controlling the transistors in the pixel circuit. These gate signal lines can be divided into ones with high load capacity and ones with relatively low load capacity. Furthermore, a slew rate required of a control signal to be applied to each of the gate signal lines differs.

For example, the gate signal lines through which a video signal voltage is supplied to the pixel circuit require a high slew rate. However, a relatively low slew rate is sufficient for the gate signal lines that control a current to be supplied to the EL elements.

For example, Patent Literature (PTL) 1 discloses an image display apparatus which includes two gate signal lines resulting from dividing a single gate signal line around the center thereof, and drives each of the gate signal lines by a corresponding driving circuit, which is a method of driving a gate signal line with high load capacity at a high slew rate. Furthermore, PTL 2 discloses an image display apparatus that applies voltages with the same waveform from both ends of one gate signal line without dividing a single gate signal line, that is, an image display apparatus that performs so-called bilateral driving.

CITATION LIST

Patent Literature

[PTL 1] Japanese Unexamined Patent Application Publication No. 2006-154822

[PTL 2] Japanese Unexamined Patent Application Publication No. 2012-068592

SUMMARY OF INVENTION

Technical Problem

As described above, a display panel includes gate signal lines corresponding one-to-one to transistors included in a pixel circuit. The more the number of the transistors per pixel circuit increases, the more the kinds of the gate signal lines increases. Furthermore, the number of the gate signal lines per kind is equal to the number of the pixel circuits in a vertical direction. For example, the number of the gate signal lines included in a display panel of Extended Graphics Array (XGA) is 768, and that of Super-XGA (SXGA) is 1024. Thus, for example, a display panel of SXGA including four kinds of gate signal lines has in total 1024×4=4096 of the gate signal lines.

The image display apparatus includes gate signal line driving circuit (gate driver circuits) for driving the multiple gate signal lines described above. The gate driver circuits are integrated into a gate driver integrated circuit, and mounted near terminals of the gate signal lines drawn from the display panel.

However, in the case where both of the gate signal line that performs the bilateral driving and the gate signal line that does not perform the bilateral driving (i.e., that performs unilateral driving) are included, the number or the arrangement of the terminals of the gate signal lines drawn from one side of the display panel is, in general, different from the number or the arrangement of the terminals of the gate signal lines drawn from the other side of the display pane.

In addition, with different specifications or the like of the image display apparatus, the number of pixels differs and the number of transistors per pixel circuit also differs, and therefore the number of gate signal lines to be driven differs as well. Furthermore, the number of gate signal lines which should be driven through the bilateral driving also differs. There is a problem that tremendous amounts of money and time are required for generating a dedicated gate driver integrated circuit according to the number and arrangement of the gate signal lines drawn from the display panel, and further according to the specifications or the like of the image display apparatus.

The present disclosure has been conceived in view of the above-described problems and an object of the present disclosure is to provide: an image display apparatus including a versatile gate driver integrated circuit (IC) irrespective of the number and arrangement of terminals of the gate signal lines and irrespective of the specifications of the image display apparatus; and a method of driving the image display apparatus.

Solution to Problem

An image display apparatus according to an aspect of the present disclosure is an image display apparatus which includes: a display panel including a plurality of pixel circuits arranged in rows and columns; and a driving circuit which drives the display panel. The image display apparatus according to an aspect of the present disclosure includes: a display screen including pixel circuits arranged in a matrix; and a gate driver circuit which drives the display screen. Gate driver circuits 14 and 15 are disposed to the left and to the right of the display screen.

A plurality of gate signal lines are disposed on each of the pixel circuits. One or more of the gate signal lines are driven by the gate driver circuits 14 and 15 disposed to the left and to the right of the display screen. The other one of the gate signal lines is driven by one of the gate driver circuits 14 and 15 disposed to the left and to the right of the display screen.

Pixels each having a light-emitting element are arranged in a matrix on the display screen that has L effective pixel rows, where L is an integer not less than 2. It is to be noted that the effective pixel rows are pixel rows each contributing to image display. N gate signal lines disposed for each of the pixel rows, where N is an integer not less than two, a source signal line disposed for each pixel column, a first gate driver circuit, a second gate driver circuit, and a source driver circuit which outputs a video signal to the source signal line are included.

The first gate driver circuit and the second gate driver circuit each include N shift register circuits. Among the N gate signal lines disposed for each of the pixel rows, each of a gate signal lines has one end connected to the first gate driver circuit and an other end connected to the second gate driver circuit, where a is an integer not less than one and not more than (N−1). In addition, an M1th stage of each of a first to Nth ones of the N shift register circuits of the first gate driver circuit is electrically connected to a first to Nth ones of the N gate signal lines in an M1th one of the pixel rows, where M1 is an integer not less than one and not more than L.

An M2th stage of each of a (a+1)th to Nth ones of the N shift register circuits of the second gate driver circuit is electrically connected to a first to ath ones of the N gate signal lines in one of the pixel rows other than an M2th one of the L effective pixel rows, where M2 is an integer not less than one and not more than L×a/N.

In addition, according to another example of the discloser, the gate driver circuit 14 includes a first shift register unit having the same number of stages as the number of effective pixel circuit rows (L rows) of the display screen, and a first gate driver unit which supplies, from one side of the pixel circuit rows, each of first gate signal lines with a first control signal generated by the first shift register unit.

The gate driver circuit 15 includes N second shift register units each having stages of at least L/N (N is an the integer not less than two) of the number of effective pixel circuit rows of the display screen, and a second gate driver unit which supplies, from the other side of the pixel circuit rows, the first control signal generated in each of the second shift register units to each of the first gate signal lines.

With this configuration, it is possible to provide an image display apparatus which includes a gate driver integrated circuit that is highly versatile and can be used irrespective of the number and arrangement of terminals of gate signal lines and irrespective of the specification or the like of the image display apparatus.

In addition, it is desirable that the image display apparatus includes a clock input terminal, an enable input terminal, and a data input terminal, which are independent of each other, and that the first gate driver circuit and the second gate driver circuit are each configured by including a plurality of gate driver integrated circuits in each of which a plurality of shift register units are integrated, each having a length corresponding to half or smaller than the number of pixel circuit rows included in a display panel.

Advantageous Effects of Invention

According to the image display apparatus described above, it is possible to provide an image display apparatus including a gate driver integrated circuit which is highly versatile and can be used irrespective of the number and arrangement of terminals of the gate signal lines and irrespective of the specification or the like of the image display apparatus.

DESCRIPTION OF EMBODIMENTS

Figure 1:
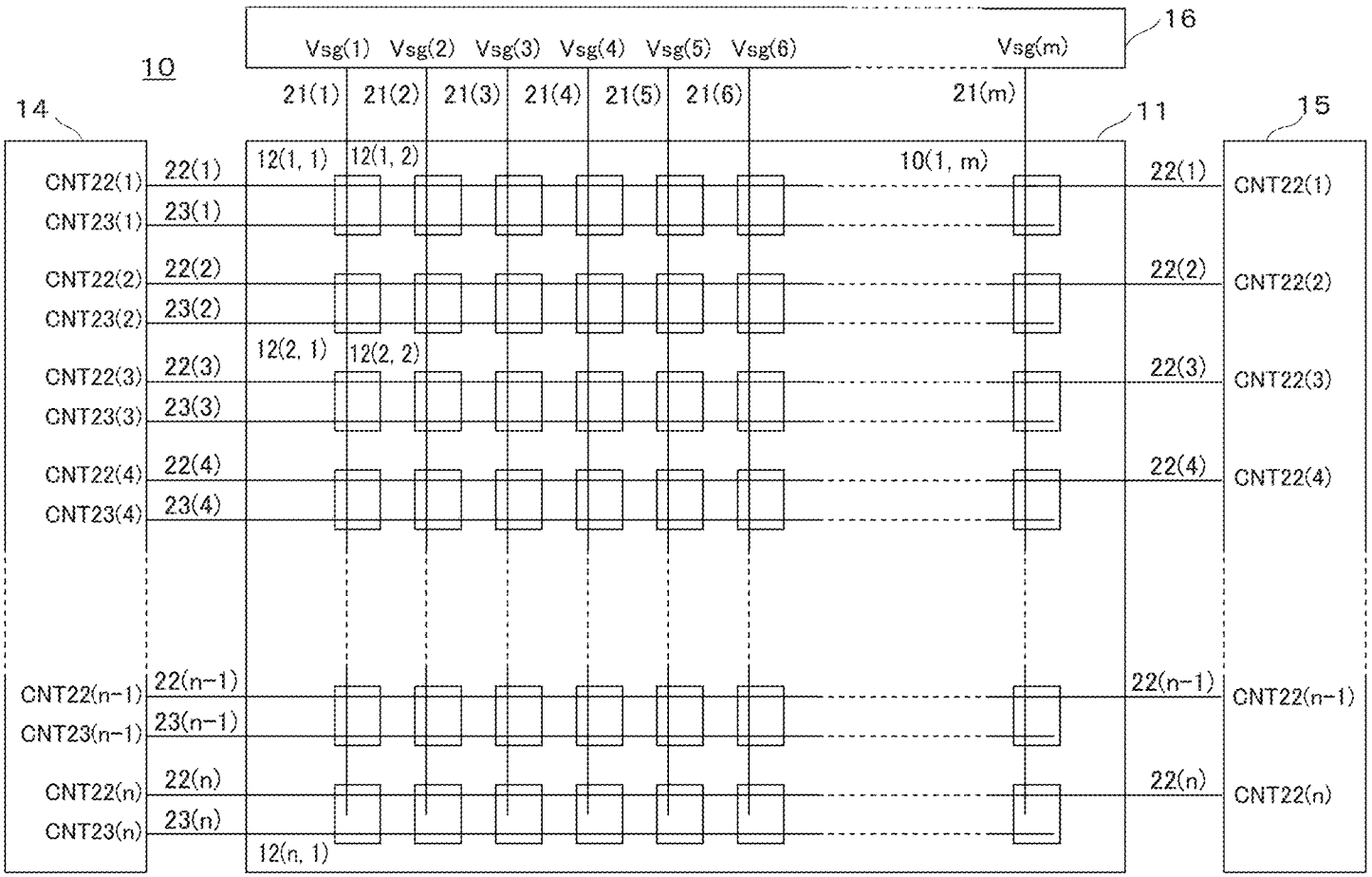
FIG. 1 is a schematic diagram illustrating a configuration of an image display apparatus according to Embodiment 1.

Underlying Knowledge Forming the Basis of the Present Disclosure

Underlying knowledge forming the basis of the present disclosure is described below prior to describing details of the present disclosure.

As described above, a display panel includes gate signal lines each disposed for a corresponding one of transistors included in a pixel circuit. The more the number of the transistors per pixel circuit increases, the more the kinds of the gate signal lines increases. Furthermore, the number of the gate signal lines per kind is equal to the number of the pixel circuits in a vertical direction. For example, the number of the gate signal lines included in a display panel of Extended Graphics Array (XGA) is 768, and that of Super-XGA (SXGA) is 1024. Thus, for example, a display panel of SXGA including four kinds of gate signal lines has in total 1024×4=4096 of the gate signal lines.

The image display apparatus includes gate driver circuits for driving the multiple gate signal lines described above. The gate driver circuits are integrated into a gate driver integrated circuit, and mounted near terminals of the gate signal lines drawn from the display panel.

However, in the case where both of the gate signal line to which the bilateral driving is performed and the gate signal line to which the bilateral driving is not performed (i.e., the gate signal line to which the unilateral driving is performed) are included, the number and the arrangement of the terminals of the gate signal lines drawn from one side of the display panel are, in general, different from the number and the arrangement of the terminals of the gate signal lines drawn from the other side of the display pane.

In addition, with different specifications or the like of the image display apparatus, the number of pixels differs and the number of transistors per pixel circuit also differs, and therefore the number of gate signal lines to be driven differs as well. Furthermore, the number of gate signal lines which should be driven through the bilateral driving also differs. There is a problem that tremendous amounts of money and time are required for generating a dedicated gate driver integrated circuit according to the number and arrangement of the gate signal lines drawn from the display panel, and further according to the specifications or the like of the image display apparatus.

In view of the above, inventors of the present disclosure have invented an image display apparatus including a highly versatile gate driver integrated circuit that can be used irrespective of the number of the gate signal lines which should be driven at high speed and the number of the gate signal lines to which the bilateral driving should be applied, and irrespective of the arrangement of the gate signal lines.

Hereinafter, non-limiting embodiments are described in greater detail with reference to the accompanying Drawings as necessary. However, description that is too much detailed will be omitted in some cases. For example, there are instances where detailed description of well-known matter and redundant description of substantially identical components are omitted. This is for the purpose of preventing the following description from being unnecessarily redundant and facilitating understanding of those skilled in the art.

It is to be noted that the accompanying Drawings and subsequent description are provided by the inventors to allow a person of ordinary skill in the art to sufficiently understand the present disclosure, and are thus not intended to limit the scope of the subject matter recited in the Claims.

Hereinafter, an image display apparatus according to embodiments will be described with reference to the Drawings. The image display apparatus includes: a display panel including pixel circuits disposed in a matrix; and a driving circuit which drives the display panel. Here, an image display apparatus will be described which includes: a display panel (EL display panel) in which active-matrix pixel circuits each of which causes an EL element to emit light using a driving transistor are arranged; and a driving circuit which drives the display panel.

According to the image display apparatus described below, it is possible to provide an image display apparatus including a gate driver integrated circuit which is highly versatile and can be used irrespective of the number and arrangement of terminals of the gate signal lines and irrespective of the specification or the like of the image display apparatus. In addition, the gate signal line which requires a high slew rate can easily realize the bilateral driving, and thus can be driven at high speed. Furthermore, the gate signal line which does not require a high slew rate can easily realize the unilateral driving and can reduce the number of the gate driver circuit to be used, and thus can realize reduction in costs for the panel module.

Embodiment 1

An image display apparatus according to an aspect of the present disclosure is an image display apparatus which includes: a display panel including a plurality of pixel circuits arranged in rows and columns; and a driving circuit which drives the display panel. The image display apparatus according to an aspect of the present disclosure includes: a display screen including pixel circuits arranged in a matrix; and a gate driver circuit which drives the display screen. The gate driver circuit is disposed on the right side and the left side of the display screen.

A plurality of gate signal lines are disposed on each of the pixel circuits. At least one of the gate signal lines are driven by the gate driver circuits disposed on the right side and the left side. Another one of the gate signal lines is driven by one of the gate driver circuits disposed on the right side and the left side.

One of the gate driver circuits disposed on the right side and the left side includes: a first shift register unit having the same number of stages as the number of effective pixel circuit rows (L rows) of the display screen; and a first gate driver unit which supplies, from one side of the pixel circuit rows, each of first gate signal lines with a first control signal generated by the first shift register unit.

The other of the gate driver circuits disposed on the right side and the left side includes: N second shift register units each having a length corresponding to at least L/N (N is an integer not less than two) of the number of effective pixel circuit rows of the display screen; and a second gate driver unit which supplies, from the other side of the pixel circuit rows, each of the first gate signal lines with the first control signal generated by each of the second shift register units.

In addition, the image display apparatus according to an aspect of the present disclosure includes: N gate signal lines disposed for each of the L effective pixel rows, where N is an integer not less than two; a source signal line disposed for each pixel column; a first gate driver circuit; a second gate driver circuit; and a source driver circuit which outputs a video signal to the source signal line, wherein the first gate driver circuit and the second gate driver circuit each include N shift register circuits, among the N gate signal lines disposed for each of the L effective pixel rows, each of a gate signal lines has one end connected to the first gate driver circuit and an other end connected to the second gate driver circuit, where a is an integer not less than one and not more than (N−1), an M1th stage of each of a first to Nth ones of the N shift register circuits of the first gate driver circuit is electrically connected to a first to Nth ones of the N gate signal lines in an M1th one of the L effective pixel rows, where M1 is an integer not less than one and not more than L, and an M2th stage of each of a (a+1)th to Nth ones of the N shift register circuits of the second gate driver circuit is electrically connected to a first to ath ones of the N gate signal lines in one of the L effective pixel rows other than an M2th one of the L effective pixel rows, where M2 is an integer not less than one and not more than L×a/N.

It is to be noted that the first stage of each of the first to ath shift register circuits of the second gate driver circuit is connected to the first to ath gate signal lines of the first pixel row, and the number of stages of the shift register matches the number of pixel rows in the relation of connection at least in this portion; however, the relation of connection may be a relation of connection in which the number of stages of the shift register does not match the number of pixel rows. In addition, in the Description of the present disclosure, "the number of stages of the shift register" is also referred to as "the length of the shift register" in some cases.

According to any of the above-described configurations, it is possible to provide an image display apparatus including a gate driver integrated circuit which is highly versatile and can be used irrespective of the number and arrangement of terminals of the gate signal lines and irrespective of the specification or the like of the image display apparatus.

In addition, it is desirable that the image display apparatus includes a clock input terminal, an enable input terminal, and a data input terminal, which are independent of each other, and that the first gate driver circuit and the second gate driver gate driver are each configured by including a plurality of gate driver integrated circuits in each of which a plurality of shift register units each having a length corresponding to half or smaller than the number of pixel circuit rows included in a display panel are integrated.

FIG. 1 is a schematic diagram illustrating a configuration of an image display apparatus 10 according to Embodiment 1. The image display apparatus 10 according to the present embodiment includes a display panel (EL display panel) 11 and a driving circuit which drives the display panel 11. The driving circuit includes a source driver circuit (source driver IC) 16, a first gate driver circuit (first gate driver IC) 14, a second gate driver circuit (second gate driver IC) 15, and a power supply circuit (not illustrated).

Figure 2:
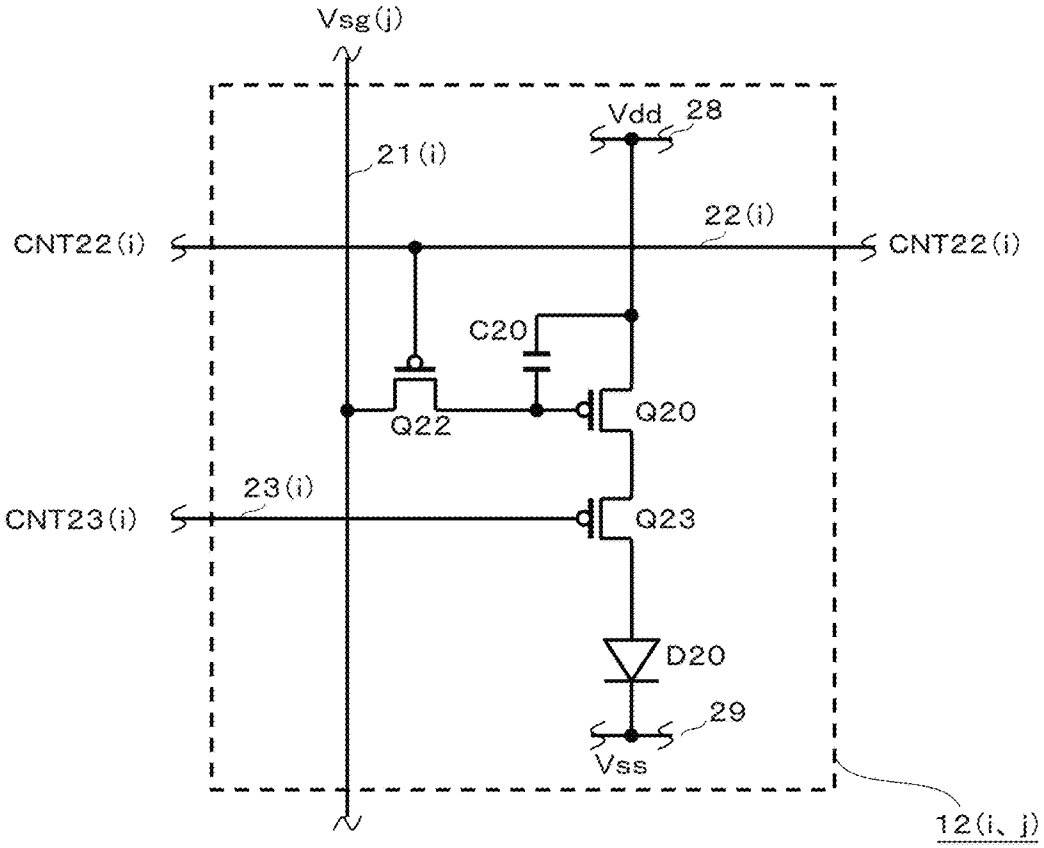
FIG. 2 is a circuit diagram illustrating a pixel circuit according to Embodiment 1.

FIG. 2 is a diagram explaining a pixel configuration of the image display apparatus 10 according to the present disclosure. A transistor Q which includes a driving transistor and a switching transistor is described as a thin-film transistor (TFT). The transistor Q has, for example, an LDD (lightly doped drain) structure.

Furthermore, the transistor Q is formed of, for example, high-temperature polycrystalline silicon (HTPS), low-temperature poly silicon (LTPS), continuous grain silicon (CGS), transparent amorphous oxide semiconductors (TAOS, IZO), amorphous silicon (AS), or infrared rapid thermal annealing (RTA). In addition, the first gate driver circuit 14, the second gate driver 15, and the source driver circuit 16 are each formed of, for example, a semiconductor chip.

In FIG. 2, transistors Q included in a pixel are all formed in, for example, a p-type.

The transistors Q each have, for example, a top gate structure. This is because the top gate structure reduces parasitic capacitance, and a gate electrode pattern of the top gate functions as a light shielding layer to shield light emitted from a light-emitting element D20, making it possible to reduce malfunction of a transistor or an off-leakage current.

In the process to be carried out, a copper line or a copper alloy line can be employed as a line material for a gate signal line 22(*i*) or a source signal line 21(*i*), or for both of the gate signal line 22(*i*) and the source signal line 21(*i*). This is because it is possible to reduce wiring resistance between signal lines and a larger display panel can be implemented.

It is preferable that the gate signal line 22(*i*) which is driven (controlled) by the first gate driver circuit 14 has low impedance. Accordingly, in the process to be carried out, a copper line or a copper alloy line, for example, can be employed as the line material, in a composition or a structure of the gate signal line 22(*i*).

Specifically, as a technique of forming the pixel circuit 12, low-temperature poly silicon (LTPS) is employed. A transistor formed through the low-temperature poly silicon technique is easily formed into the top gate structure. With the top gate structure, parasitic capacitance is small, an n-type and a p-type transistor can be manufactured, and the copper line or the copper alloy line process can be employed in the process, and thus it is preferable that the top gate structure is used in the image display apparatus according to the present disclosure. It is to be noted that, for the copper line, a three-layer structure of Ti—Cu—Ti is employed, for example.

For the lines such as the gate signal line 22(*i*) and the source signal line 21(*i*), a three-layer structure of molybdenum Mo—Cu—Mo is employed when the transistors Q are, for example, transparent amorphous oxide semiconductors (TAOS).

Figure 3:
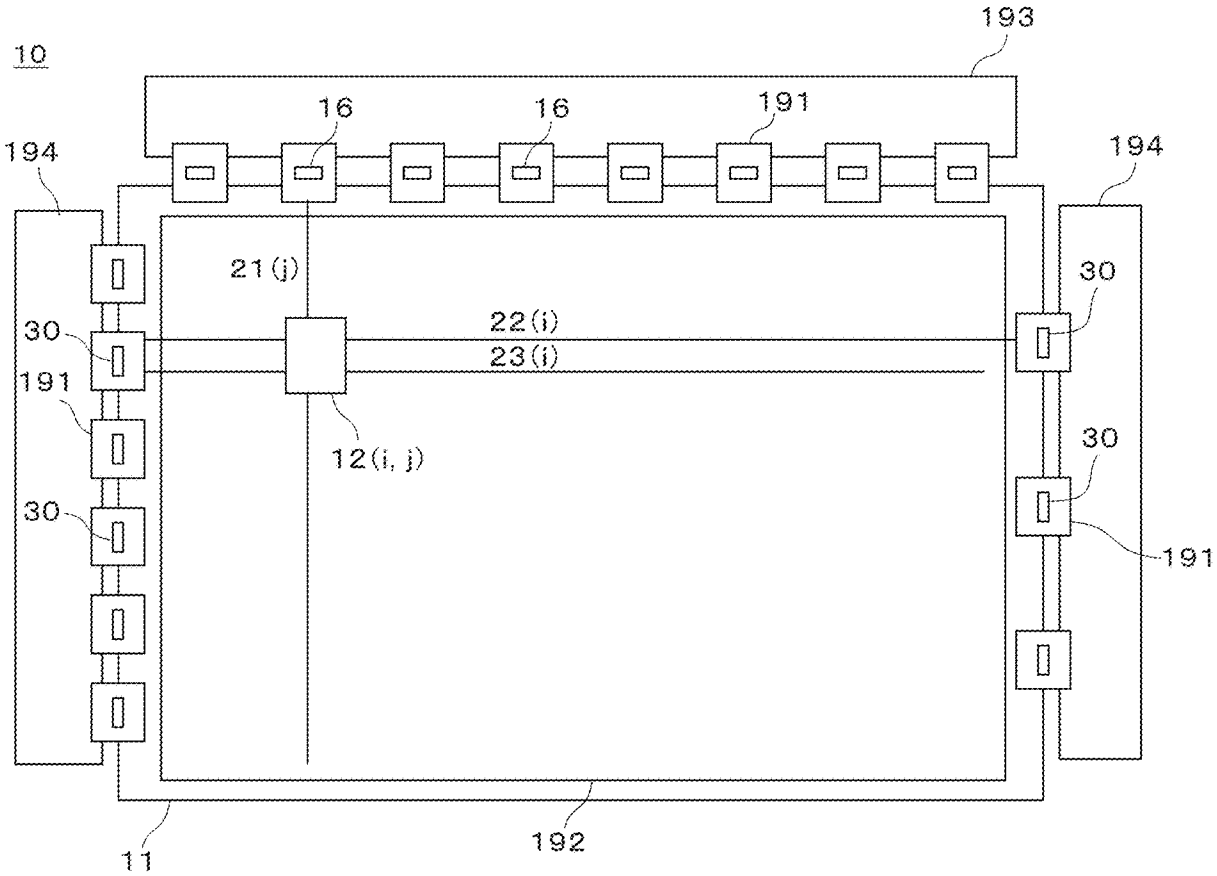
FIG. 3 is a schematic diagram illustrating the configuration of the image display apparatus according to Embodiment 1.

FIG. 3 is a schematic diagram illustrating in more detail the configuration illustrated in FIG. 1. Pixel circuits 12(*i, j*) are arranged in a matrix on a display screen 192. In each of the pixel circuits 12(*i, j*), gate signal lines 22(*i*) and 23(*i*) are disposed. It is to be noted that i and j are each a natural number greater than or equal to one.

The gate signal line 22(*i*) has ends to each of which a gate driver integrated circuit (IC) 30 is connected. The gate signal line 23(*i*) has one end to which the gate driver integrated circuit 30 is connected. Accordingly, the bilateral driving is applied to the gate signal line 22(*i*), and the unilateral driving is applied to the gate signal line 23(*i*).

In addition, it is exemplified that a gate signal line driving unit and the gate driver integrated circuit (IC) are each formed of a semiconductor chip. However, it should be understood that the gate signal line driving unit and the gate driver integrated circuit (IC) are not limited to the above, and the driver circuits or the like may directly be formed on a substrate on which the pixel circuits 12 are formed, using the low-temperature poly silicon, the high-temperature polycrystalline silicon, or the TAOS technique, for example.

In addition, it is exemplified that the source driver circuit 16 is also formed of a semiconductor chip. However, the source driver circuit 16 is not limited to the above, and it should be understood that the driver circuit or the like may directly be formed on a substrate on which the pixel circuit is formed, using the low-temperature poly silicon, the high-temperature polycrystalline silicon, or the TAOS technique, for example.

It is to be noted that, for facilitating the explanation, each of the gate driver integrated circuit 30 and the source driver circuit 16 is formed of a semiconductor chip and mounted on a COF (chip on film) (not illustrated) in the description below.

It is possible to form each of the COFs 191 so as to absorb light, by applying or forming light absorbing paint or a material, or applying a sheet, on a surface of the COF 191. It is also possible to dissipate heat from the driver circuits (30 and 16), by disposing or forming a heatsink on the surface of the driver circuits mounted on the COF 191. It is also possible to dissipate heat generated by the driver circuits, by disposing or forming a heat dissipation sheet or a heatsink on a back surface of the COF 191.

The gate driver integrated circuit 30 and the source driver circuit 16 are each mounted on the COF 191. The gate driver integrated circuit 30 applies, to the gate signal lines 22(*i*) and 23(*i*), a control signal which turns ON or OFF a switching transistor Q of the pixel circuit 12. The source driver circuit 16 applies a video signal voltage to the source signal line 21(*i*).

The COF 191 on which the gate driver integrated circuit 30 is mounted connects electrically the display panel (image display panel) 11 and a gate printed circuit board 194. The COF 191 on which the source driver circuit 16 is mounted is electrically connected to the display panel 11 and a source printed circuit board 193.

In the pixel circuit illustrated in FIG. 2, the capacitor C20 is a capacitor including a first electrode electrically connected to a gate terminal of a driving transistor Q20 and a second electrode electrically connected to a source terminal of the driving transistor Q20.

It is to be noted that, in the following description, a terminal of each element is expressed as a terminal for convenience; however, the terminal may be referred to as an electrode. For example, the gate terminal of a transistor Q may be a gate electrode. Furthermore, the gate terminal of a transistor Q may be described simply as a gate in some cases. A "terminal" is a "connecting unit", a "wire connecting unit", or a portion to which a voltage or a signal is applied.

The capacitor C20 first stores a potential between the gate electrode and the source electrode of the driving transistor Q20 (potential of the source signal line 21(*i*)) in a steady state when the switching transistor Q22 is in a conducting state. After that, the potential of the capacitor C20 is determined even when the switching transistor Q22 is brought into an OFF state, and thus a gate voltage of the driving transistor Q20 is determined.

It is to be noted that the capacitor C20 is formed or disposed so as to overlap (stack) with the source signal line 21(*i*) and the gate signal line 22(*i*). In this case, layout flexibility is improved, a wider space can be secured between elements, and yield is improved.

The light-emitting element D20 according to the pixel circuit illustrated in FIG. 2 includes an anode electrode or a cathode electrode disposed or formed on the source signal line 21(*i*) and the gate signal line 22(*i*), and thus an electric field from the source signal line 21(*i*) and the gate signal line 22(*i*) is shielded by the anode electrode or the cathode electrode. It is possible, by the shield, to reduce noise in an image display.

An insulating film or an insulating film formed of an acrylic material (planarization film) is formed on the source signal line 21(*i*) and the gate signal line 22(*i*) to insulate the source signal line 21(*i*) and the gate signal line 22(*i*), and a pixel electrode is formed on the insulating film.

As described above, the structure in which a pixel electrode is stacked on at least part of the gate signal line 22(*i*) or the like is referred to as a high aperture (HA) structure. This structure reduces unnecessary interfering light or the like, and thus realizes an excellent light emitting condition.

Figure 4:
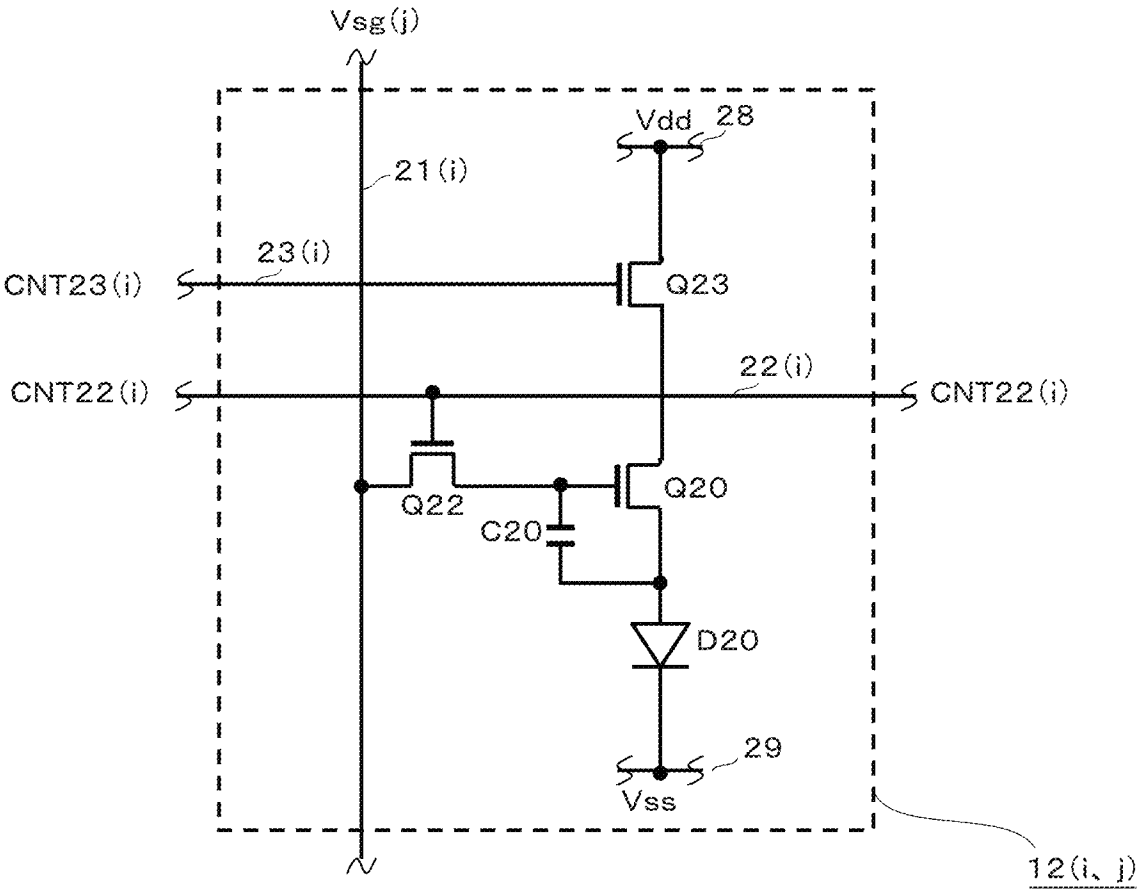
FIG. 4 is a circuit diagram illustrating the pixel circuit of the image display apparatus according to Embodiment 1.

It is to be noted that FIG. 2 is a circuit diagram in the case where the transistor included in the pixel circuit 12 is P-channel. In the case where the transistor included in the pixel circuit 12 is N-channel, the pixel circuit 12 is configured as illustrated in FIG. 4. It is to be noted that, in the case where the polarity of the transistor included in the pixel circuit is N-channel, it is only necessary to invert the polarity of signal waveforms in FIG. 7 and FIG. 8 which are described below, and thus description for a timing chart or the like in the case where the transistor is N-channel will be omitted.

It is possible to use a transparent electrode including such as ITO, indium (IGZO), gallium, zinc, oxygen, IZO, transparent amorphous oxide semiconductor (TAOS), or the like, for the pixel electrode of the pixel circuit 12(*i, j*).

With the display apparatus according to the present embodiment, a color filter including red (R), green (G), and blue (B) can be formed to correspond to the position of the pixel circuit 12(*i, j*). It is to be noted that the color filter is not limited to RGB, and a pixel including cyanogen (C), magenta (M), and yellow (Y) may be formed. Furthermore, a pixel of white (W) may be formed. More specifically, pixel circuits of R, G, B, and W are disposed in a matrix on the display panel 11.

Pixels are manufactured so as to be square with a three-pixel circuit of RGB or a four-pixel circuit of RGBW. Accordingly, each pixel of R, G, and B has an elongated pixel shape.

R, G, and B may each have a different pixel aperture ratio. With the different aperture ratios, it is possible to have different current densities between currents flowing through the light-emitting elements D20 of the respective RGB. With the different current densities, it is possible to equalize the deterioration rate of the RGB light-emitting elements D20. With the same deterioration rate, white balance shift does not occur in the display apparatus.

Colorization of the display apparatus is realized by mask evaporation; however, colorization according to the present embodiment is not limited to the mask evaporation. For example, an EL layer which emits blue light is formed, and emitted blue light may be converted to light of R, G, and B, through a color conversion layer (CCM: color change medium) of R, G, and B.

It is to be noted that it is possible to dispose a circularly polarizing plate (circularly polarizing film) (not illustrated) on the light emitting face of the display apparatus. A polarization plate and a phase film are integrated into a circularly polarizing plate (circularly polarizing film).

In the pixel circuit 12(*i, j*) illustrated in FIG. 2, the gate signal line 22(*i*) is connected to the first gate driver circuit 14 and the second gate driver circuit 15 as illustrated in FIG. 1. More specifically, the gate signal line 22(*i*), to which a gate terminal of the second switching transistor Q22 is connected, has one end to which the first gate driver circuit 14 is connected and the other end to which the second gate driver circuit 15 is connected. This is due to the subsequent reason.

The gate signal line 22(*i*) is connected to the second switching transistor Q22. The second switching transistor Q22 is a transistor for writing a video signal Vsg(j) into the pixel circuit 12(*i, j*), and the transistor Q22 needs to be turned ON or OFF at high speed (high slew rate operation). The gate signal line 22(*i*) is driven by the first gate driver circuit 14 and the second gate driver circuit 15 (bilateral driving is applied), thereby implementing the high slew rate operation.

It is to be noted that, for example, the first gate driver circuit 14 is disposed on the left side of the display panel 11 and the second gate driver circuit 15 is disposed on the right side of the display panel 11.

The gate signal line 23(*i*) is connected to the first switching transistor Q23. The first switching transistor Q23 is a transistor which performs an offset cancelling operation of the driving transistor Q20, and turned ON or OFF.

The switching transistor Q22 is connected to the gate signal line 22(*i*). The gate signal line 22(*i*) is applied with the bilateral driving. Accordingly, it is possible to turn ON or OFF the switching transistor Q22 at high speed. In other words, the switching transistor Q22 is capable of implementing the high slew rate operation.

The gate signal line 22(*i*) is driven by the first gate driver circuit 14 and the second gate driver circuit 15, eliminating luminance inclination or the like on the right and left sides and the center of the display panel 11, thereby implementing an excellent image display. In addition, even when the load capacity of the gate signal line 22(*i*) is large, it is possible to realize smoothly drive.

The first gate driver circuit 14 is connected to the gate signal line 23(*i*). The second switching transistor Q23 is disposed between the driving transistor Q20 and the EL element D20. The second switching transistor Q23 has a function of turning ON or OFF (supply or block) a current to be supplied to the EL element D20. High slew rate is not required for turning ON or OFF of a current to be supplied to the EL element D20. Low slew rate is sufficient. Accordingly, it is possible to obtain practically sufficient performance even when the gate signal line 23(*i*) is driven by the first gate driver circuit 14 (unilateral driving).

The display panel (EL display panel) 11 includes a plurality of pixel circuits 12(*i, j*) in a matrix of n rows and m columns ($1 \le i \le n$, $1 \le j \le m$). In FIG. 1, a source signal line 21(*j*) is connected independently to each of pixel circuit columns including the pixel circuits 12(1, *j*) to 12(*n, j*) arranged in a column direction. In addition, the first gate signal line 22(*i*) and the second gate signal line 23(*i*) are connected independently to each of pixel circuit rows including the pixel circuits 12(*i*, 1) to 12(*i, m*) arranged in a row direction. In the following description, the first gate signal line 22(*i*) is simply referred to as a gate signal line 22(*i*), and the second gate signal line 23(*i*) is simply referred to as a gate signal line 23(*i*) It is to be noted that n and m are each a natural number greater than or equal to one.

The source signal lines 21(*j*) are each drawn from one of an upper side and a lower side, or both of the upper side and the lower side, of the display panel 11, and connected to the source driver circuit 16 in FIG. 1.

The gate signal lines 22(*i*) are each drawn from the left side of the display panel 11 and connected to the first gate driver circuit 14, and also drawn from the right side of the display panel 11 and connected to the second gate driver circuit 15, in FIG. 1. Accordingly, the bilateral driving is applied to the gate signal line 22(*i*).

The gate signal lines 23(*i*) are each drawn from the left side of the display panel 11 and connected to the first gate driver circuit 14 in FIG. 1.

As described above, in the display panel 11 according to the present embodiment, the gate signal line 22(*i*) and the gate signal line 23(*i*) are connected in common to the pixel circuits 12(*i*, 1) to 12(*i, m*) arranged in the row direction.

The gate signal line 22(*i*) is drawn from the both sides of the display panel 11, having one end connected to the first gate driver circuit 14 and the other end connected to the second gate driver circuit 15. The gate signal line 23(*i*) is drawn from only one side of the display panel 11 and connected to the first gate driver circuit 14.

The source driver circuit 16 supplies a video signal voltage Vsg(j) independently to each of the source signal lines 21(*j*). It is to be noted that, although it has been described above that the source driver circuit 16 supplies the video signal voltage Vsg(j), it is not limited to a voltage. For example, a video signal current may be supplied. Furthermore, it is not limited to video, and a signal to be applied to the pixel circuit 12 may be any signal or the like.

The first gate driver circuit 14 supplies each of the gate signal lines 22(*i*) with a write controlling signal CNT22(*i*) that is the first controlling signal, and supplies each of the gate signal lines 23(*i*) with a display controlling signal CNT23(*i*) that is the second controlling signal.

The second gate driver circuit 15 supplies each of the gate signal lines 22(*i*) with the write controlling signal CNT22(*i*) that is the first controlling signal. The write controlling signal CNT22(*i*) supplied by the second gate driver circuit 15 is a signal having the same voltage waveform as the voltage waveform of the write controlling signal CNT22(*i*) supplied by the first gate driver circuit 14.

As described above, the gate signal line 22(*i*) is a first gate signal line to which the bilateral driving is applied, and the gate signal line 23(*i*) is a second gate signal line to which the unilateral driving is applied, according to the present embodiment.

It is to be noted that, in the following description, the write controlling signal CNT22(*i*) that is the first controlling signal is simply referred to as a write controlling signal CNT22(*i*), and the display controlling signal CNT23(*i*) that is the second controlling signal is simply referred to as a display controlling signal CNT23(*i*).

The power supply circuit supplies an anode voltage Vdd to a power line on a high-voltage side connected to all of the pixel circuits 12(1, 1) to 12(*n, m*) in common, and supplies a voltage Vss to a cathode power line on a low-voltage side. The power supply of the voltage Vdd and the voltage Vss is a power supply for causing the EL element to emit light as described below. According to the present embodiment, the voltage on the high-voltage side (anode voltage) Vdd=10 (V), and the voltage on the low-voltage side (cathode voltage) Vss=0(V). It is desirable to optimally set these numerical values according to the specification of the pixel circuit or the characteristics of each element.

Next, the pixel circuit 12(*i, j*) will be described.

FIG. 2 is a circuit diagram illustrating the pixel circuit 12(*i, j*) of the image display apparatus 10 according to the present embodiment. The pixel circuit 12(*i, j*) according to the present embodiment includes: the EL element D20 that is a current light-emitting element; the driving transistor Q20; the capacitor C20; and the transistor Q22 and the transistor Q23 each operating as a switch.

The driving transistor Q20 provides the EL element D20 with a current according to the video signal voltage Vsg(j). The capacitor C20 holds the video signal voltage Vsg(j). The transistor Q22 is a switch for writing the video signal voltage Vsg(j) to the capacitor C20. The transistor Q23 is a switch for supplying the EL element D20 with a current to cause the EL element D20 to emit light.

The pixel circuit 12(*i, j*) includes a power line 28 on the high-voltage side and a power line 29 on the low-voltage side. The power line 28 is supplied with a voltage Vdd from the power supply circuit. The power line 29 is supplied with a voltage Vss from the power supply circuit. The source of the driving transistor Q20 is connected to the power line 28, the drain of the driving transistor Q20 is connected to the source of the transistor Q23, the drain of the transistor Q23 is connected to the power line 28 of the anode of the EL element D20, and the cathode of the EL element D20 is connected to the power line 29.

The transistor Q22 has a function of applying, to the pixel circuit 12(*i, j*), the video signal applied to the source signal line 21(*i*). The capacitor C20 is connected between the gate terminal and the source terminal of the driving transistor Q20. The drain terminal (or the source terminal) of the transistor Q22 is connected to the gate of the driving transistor Q20, the source terminal (or the drain terminal) of the transistor Q22 is connected to the source signal line 21(*j*) which transmits the video signal voltage Vsg(j), and the gate terminal of the transistor Q22 is connected to the gate signal line 22(*i*). According to the above-described configuration, the gate terminal of the driving transistor Q20 is supplied with the video signal voltage Vsg(j) in response to conduction of the transistor Q22.

As described above, the transistor Q23 is the second switching transistor disposed between the drain of the driving transistor Q20 and the anode terminal of the EL element D20. The EL element D20 is supplied with a current controlled by the driving transistor Q20 in response to conduction of the transistor Q23.

As described above, the display panel 11 according to the present embodiment includes: the source signal lines 21(*j*) each of which supplies the video signal voltage Vsg(j) independently to a corresponding one of the pixel circuit columns including the pixel circuits 12(1, *j*) to 12(*n, j*) arranged in a column direction; the first gate signal lines (gate signal lines 22(*i*)) each of which supplies, from the both sides of the pixel circuit rows including the pixel circuits 12(*i*, 1) to 12(*i, m*) arranged in a row direction, the first control signal (write controlling signal CNT22(*i*)) independently to a corresponding one of the pixel circuit rows; and the second gate signal lines (gate signal lines 23(*i*)) each of which supplies, from one side of the pixel circuit rows, the second control signal (display controlling signal CNT23 (*i*)) independently to a corresponding one of the pixel circuit rows.

It is to be noted that, although it has been described that each of the driving transistor Q20, the transistor Q22, and the transistor Q23 is a P-channel thin-film transistor according to the present embodiment, the present disclosure is not limited to this. For example, each of the driving transistor Q20 and the transistors Q22 and Q23 may be an N-channel thin-film transistor. In addition, the pixel circuit 12 may be configured using both of the P-channel and the N-channel thin-film transistors.

Next, an operation of the pixel circuit 12(*i, j*) will be described. One field period is divided into a plurality of periods including a writing period Tw and a display period Td, and each of the pixel circuits 12(*i, j*) performs a writing operation of writing the video signal voltage Vsg(j) to be displayed in the writing period Tw, and causes the EL element D20 to emit light in the display period Td based on the video signal voltage Vsg (j) which has been written.

(Writing Period Tw)

Figure 5:
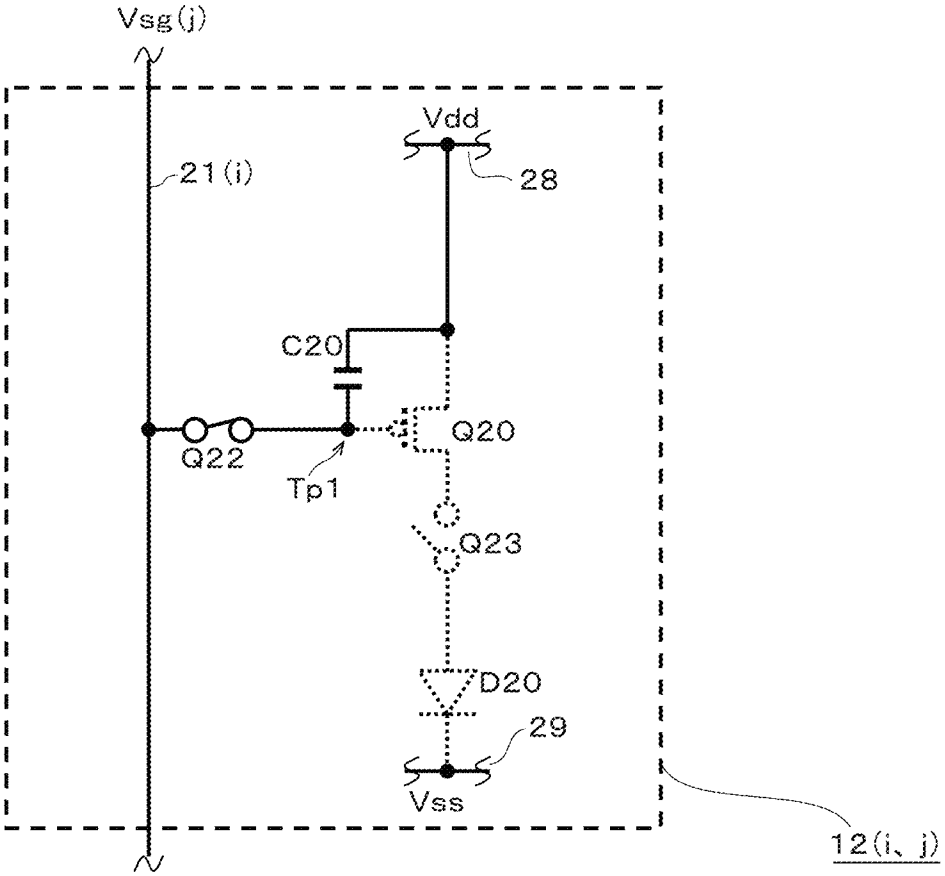
FIG. 5 is a diagram for explaining an operation in a writing period of the pixel circuit according to Embodiment 1.

FIG. 5 is a diagram for describing an operation in the writing period Tw performed by the pixel circuits 12(*i, j*) of the image display apparatus 10 according to the present embodiment. It is to be noted that each of the transistors Q22 and Q23 illustrated in FIG. 1 is denoted by a symbol of switches in FIG. 5. In addition, a path through which a current does not pass is denoted as a dashed line.

For performing the writing operation, the write controlling signal CNT22(*i*) is set at an ON voltage level (V22on) to turn ON the transistor Q22. Then, the video signal voltage Vsg(j) is applied to the gate terminal of the driving transistor Q20, and the capacitor C20 is charged to have a voltage (Vdd−Vsg(j) between the terminals. Subsequent to the writing operation, the write controlling signal CNT22(*i*) is set at an OFF voltage level (V22off) to turn OFF the transistor Q22.

Meanwhile, the display controlling signal CN23(*i*) is set at the OFF voltage level (V23off) to turn OFF the transistor Q23. With this, a current does not pass through the EL element D20, and thus the EL element D20 does not emit light.

It is to be noted that, although the details will be given later, the writing operation should be sequentially performed by n pixel circuits 12(1, *j*) to 12(*n, j*) disposed in the column direction, using the source signal lines 21(*j*) within the one field period. For that reason, a time period of the writing period Tw to be allocated to each of the pixel circuits 12(*i, j*) is short; that is, 1 μs according to the present embodiment.

(Display Period Td)

Figure 6:
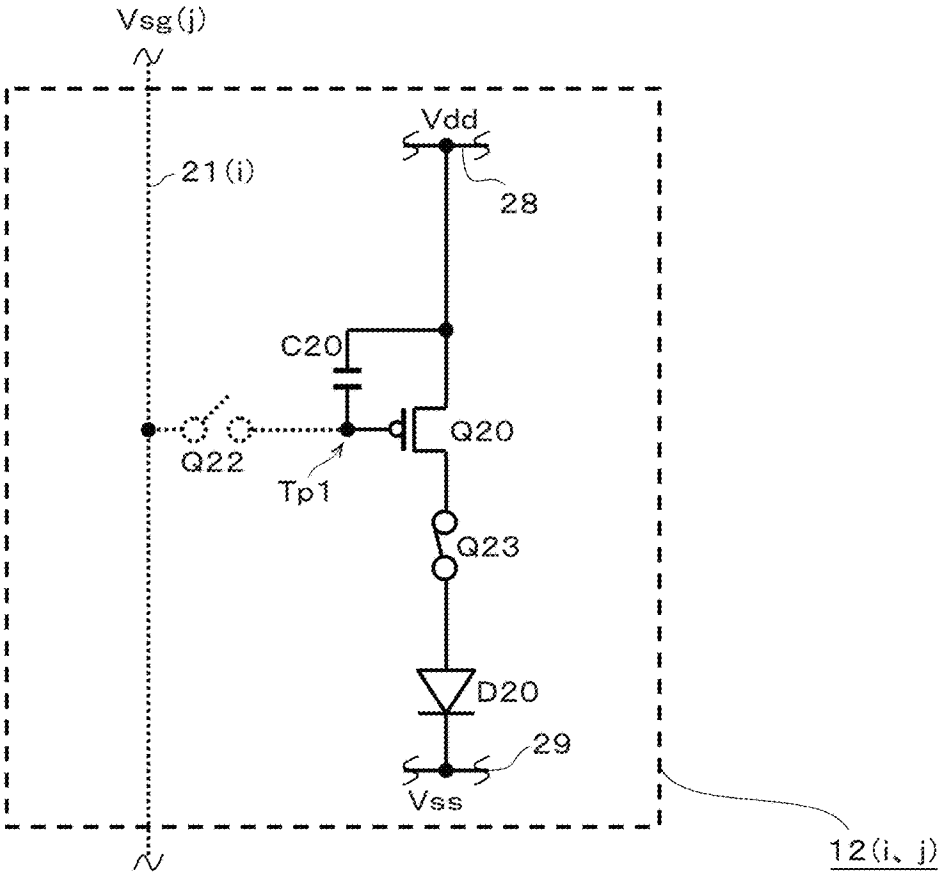
FIG. 6 is a diagram for explaining an operation in a display period of the pixel circuit according to Embodiment 1.

FIG. 6 is a diagram for describing an operation in the display period Td performed by the pixel circuits 12(*i, j*) of the image display apparatus 10 according to the present embodiment.

While the write controlling signal CNT22(*i*) is set at the voltage V22off to maintain the OFF state of the transistor Q22, the display control signal CNT23(*i*) is set at the ON voltage level (V23on) to turn ON the transistor Q23. Then, the drain voltage of the driving transistor Q20 increases, and a current according to the voltage between the gate and the source (Vdd−Vsg(j)) flows through the EL element D20.

As described above, in the display period Td, the EL element D20 emits light at a luminance according to the video signal voltage Vsg(j) which has been written in the writing period Tw.

It is to be noted that, since the light emitting period of the EL element D20 becomes longer as the display period Td is set longer, it is possible to improve the luminance of the image display apparatus 10. According to the present embodiment, most part of the one field period other than the writing period Tw is the display period Td.

Next, an operation of the image display apparatus 10 according to the present embodiment will be described.

Figure 7:
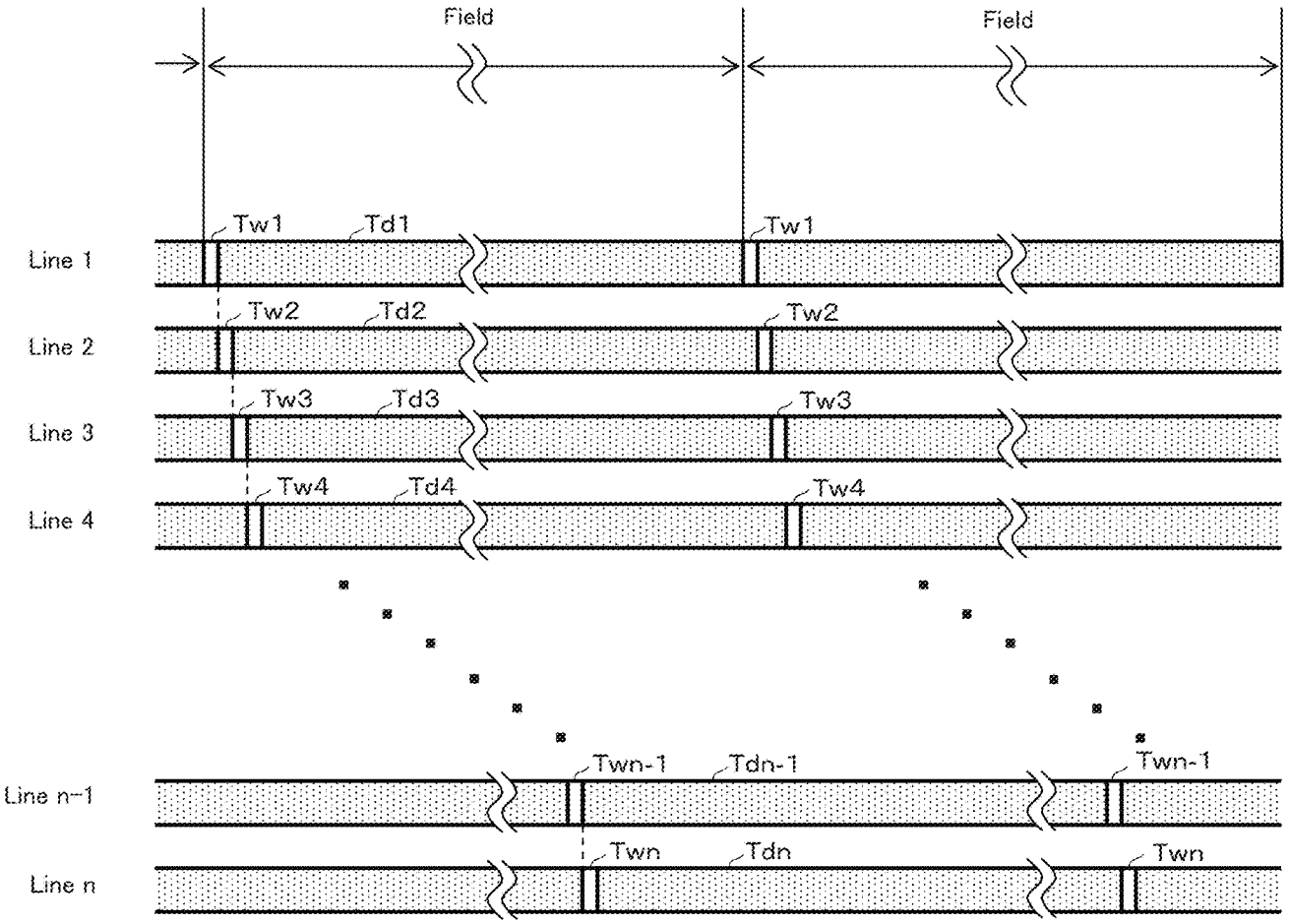
FIG. 7 is a timing chart illustrating an operation according to Embodiment 1.

FIG. 7 is a timing chart illustrating an operation of the image display apparatus 10 according to the present embodiment. It is to be noted that, in the following description, a pixel row including the pixel circuits 12(*i*, 1) to 12(*i, m*) arranged in the row direction at the ith row is simply referred to as a line i.

According to the present embodiment of the present disclosure, the writing period Tw1 of the pixel circuits 12(1, 1) to 12(1, *m*) in the line 1 is set to start first in the one field period (or the one frame period), and a predetermined period between the writing period Tw1 and the next writing period Tw1 is set as the display period Td1 of the pixel circuits 12(1, 1) to 12(1, *m*) in the line 1.

In addition, the writing period Tw2 of the pixel circuits 12(2, 1) to 12(2, *m*) in the line 2 is set to start immediately after the end of the writing period Tw1, and a predetermined period between the writing period Tw2 and the next writing period Tw2 is set as the display period Td2 of the pixel circuits 12(2, 1) to 12(2, *m*) in the line 2.

In the same manner as above, the writing period Twi of the pixel circuits 12(*i*, 1) to 12(*i, m*) in the line i is set to start immediately after the end of the writing period Tw(i−1), and a predetermined period between the writing period Twi and the next writing period Twi is set as the display period Tdi of the pixel circuits 12(*i*, 1) to 12(*i, m*) in the line i.

As described above, the writing operation is sequentially performed starting from the pixel circuits 12(1, 1) to 12(1, *m*) in the line 1 to the pixel circuits 12(*n*, 1) to 12(*n, m*) in the line n, by setting the writing periods Tw1 to Twn. In addition, the display operation is performed in most of the time other than the writing period Tw in each of the pixel circuits, by setting the display periods Td1 to Tdn as described above.

Figure 8:
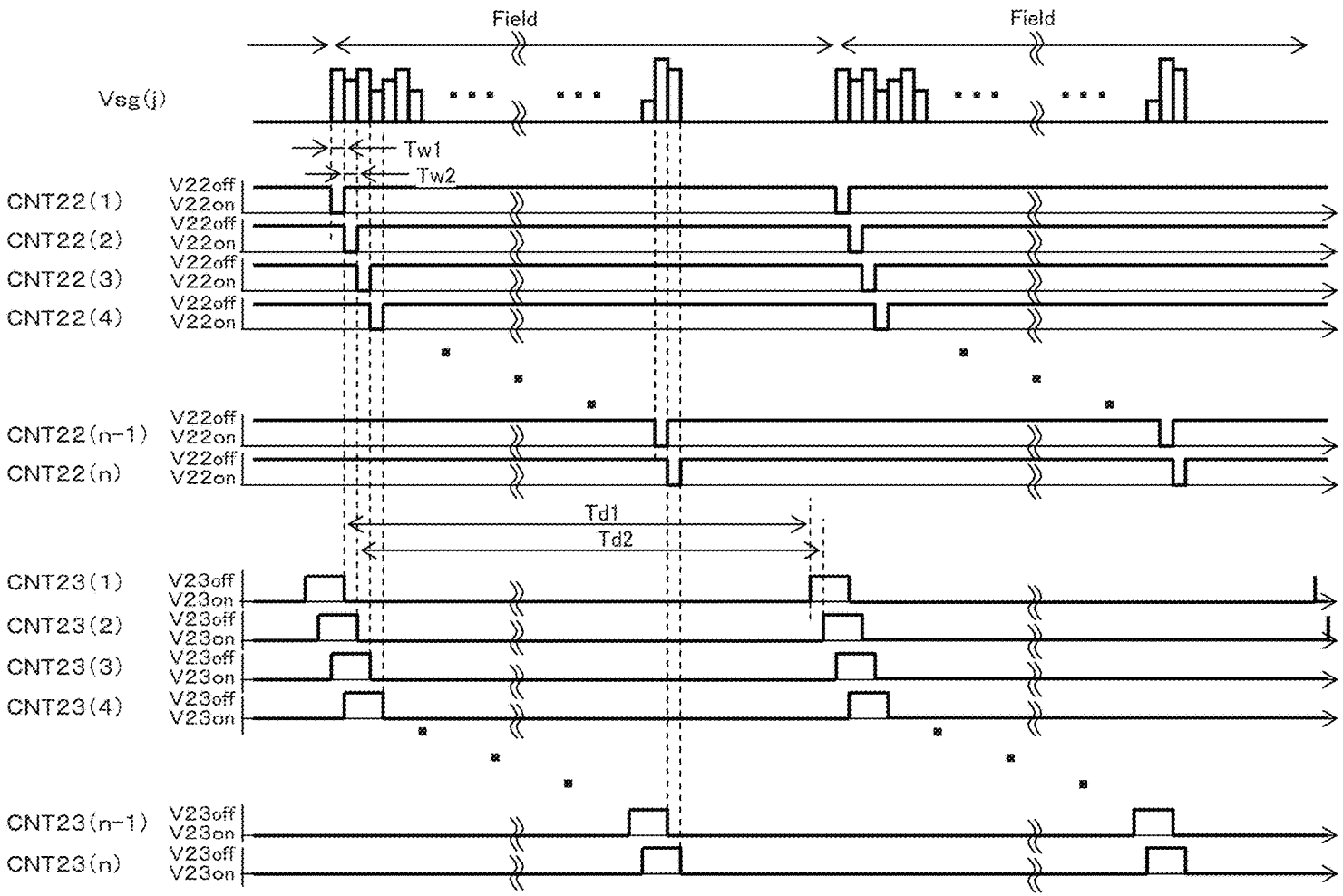
FIG. 8 is a timing chart of a video signal voltage, write controlling signal, and a display controlling signal according to Embodiment 1.

FIG. 8 is a timing chart of the video signal voltages Vsg(1) to Vsg(m), the write controlling signals CNT22(1) to CNT22(*n*), and the display controlling signals CNT23(1) to CNT23(*n*), of the image display apparatus 10 according to the present embodiment. It is to be noted that, only the video signal voltage Vsg(j) is illustrated in FIG. 8.

During the writing period Twi of the line 1, the source driver circuit 16 supplies the source signal lines 21(1) to 21(*m*) with the video signal voltages Vsg(1) to Vsg(m), respectively, to be displayed on the pixel circuits 12(1, 1) to 12(1, *m*) in the first line. Then, the gate driving circuit sets the write controlling signal CNT22(1) in the line 1 to the ON voltage level (V22on), and the writing operation is performed in the pixel circuits 12(1, 1) to 12(1, *m*) in the first line. After that, the gate driving circuit resets the write controlling signal CNT22(1) in the line 1 to the OFF voltage level (V22off).

During the writing period Tw2 of the line 2, the source driver circuit 16 supplies the source signal lines 21(1) to 21(*m*) with the video signal voltages Vsg(1) to Vsg(m), respectively, to be displayed on the pixel circuits 12(2, 1) to 12(2, *m*) in the second line. Then, the gate driving circuit sets the write controlling signal CNT22(2) in the line 2 to the ON voltage level (V22on), and the writing operation is performed in the pixel circuits 12(2, 1) to 12(2, *m*) in the line 2. After that, the gate driving circuit resets the write controlling signal CNT22(2) to the OFF voltage level (V22off).

During the writing period Twi in the line i, the source driver circuit 16 supplies the source signal lines 21(1) to 21(*m*) with the video signal voltages Vsg(1) to Vsg(m), respectively, to be displayed on the pixel circuits 12(*i*, 1) to 12(*i, m*) in the ith line. Next, the gate driving circuit sets the write controlling signal CNT22(*i*) in the line i to the voltage V22on to perform the writing operation in the pixel circuits 12(*i*, 1) to 12(*i, m*) in the line i. After that, the gate driving circuit resets the write controlling signal CNT22(*i*) to the voltage V22off.

With the above-described timing, the gate driving circuit sequentially applies the pulsed voltage V22on to each of the write controlling signals CNT22(1) to CNT22(*n*) so as not to overlap with each other, and sequentially performs the writing operation in the pixel circuits of the lines 1 to n.

In the display period Td1 of the line 1, the gate driving circuit sets the display controlling signal CNT23(1) in the line 1 to the voltage V23on, and the display operation is performed in the pixel circuits 12(1, 1) to 12(1, *m*) in the line 1. Then, the gate driving circuit sets the display controlling signal CNT23(1) to the voltage V23off at the end of the display period Td1, to end the display operation.

In the display period Td2 of the line 2, the gate driving circuit sets the display controlling signal CNT23(2) in the line 2 to the voltage V23on, and the display operation is performed in the pixel circuits 12(2, 1) to 12(2, *m*) in the line 2. Then, the gate driving circuit sets the display controlling signal CNT23(2) to the voltage V23off at the end of the display period Td2, to end the display operation.

In the same manner as above, in the display period Tdi of the line i, the gate driving circuit sets the display controlling signal CNT23(*i*) in the line i to the voltage V23on, and the display operation is performed in the pixel circuits 12(*i*, 1) to 12(*i, m*) in the line i. Then, the gate driving circuit sets the display controlling signal CNT23(*i*) to the voltage V23off at the end of the display period Tdi, to end the display operation.

With the above-described timing, the gate driving circuit applies the voltage V22on in most of the time in the one field period other than the writing period Tw to each of the display controlling signals CNT23(1) to CNT23(*n*), and the display operation is sequentially performed in the pixel circuits in the lines 1 to n.

It is to be noted that the amount of time of the writing period Tw to be allocated to one line is short as described above, and set as 1 μs according to the present embodiment. For performing the writing operation within the short writing period Tw, it is necessary to turn ON or OFF the transistor Q22 of each of the pixel circuits 12(*i, j*) at high speed. However, impedance of each of the gate signal lines 22(*i*) rises as the size of the display screen of the display panel 11 increases, and attached additional capacity also increases.

For that reason, assuming that the gate signal line 22(*i*) is supplied with the write controlling signal CNT22(*i*) from only the first gate driver circuit 14 disposed on the left side of the display panel 11, for example, a voltage waveform substantially equivalent to an output waveform of the first gate driver circuit 14 is applied to the gate terminal of the transistor Q22 of the pixel circuit disposed on the supply side; that is, on the left side. Accordingly, it is possible to turn ON or OFF the transistor Q22 at high speed.

However, in the gate signal line 22(*i*), the voltage waveform rounds with distance from the supply side. Accordingly, it is impossible to turn ON or OFF at high speed the transistor Q22 of the pixel circuit disposed on the right side. For that reason, crosstalk, luminance gradient, display unevenness, etc. occur as the position of the pixel circuit becomes closer to the right side of the display screen, causing a decrease in the image display quality.

According to the present embodiment, however, the bilateral driving is applied to the gate signal line 22(*i*) which supplies the write controlling signal CNT22(*i*). More specifically, the write controlling signal CNT22(*i*) is supplied to the gate signal line 22(*i*) from both sides of the first gate driver circuit 14 disposed on the left side of the display panel 11 and the second gate driver circuit 15 disposed on the right side of the display panel 11. For that reason, it is possible to significantly suppress the rounding of the voltage waveform. In addition, since it is possible to turn ON or OFF at high speed the transistor Q22 of the pixel circuit 12(*i, j*) in the entire display screen, a high quality image can be displayed.

On the other hand, the bilateral driving is applied to the gate signal line 23(*i*) which supplies the display controlling signal CNT23(*i*) during the display period Td. More specifically, the display controlling signal CNT23(*i*) is supplied to the gate signal line 23(*i*) only from the first gate driver circuit 14 disposed on the left side of the display panel 11. For that reason, in the gate signal line 23(*i*), the voltage waveform rounds with distance from the supply side. The switching transistor Q23 is connected to the gate signal line 23(*i*). However, the rounding of the voltage waveform of the display controlling signal CNT23(*i*) delays only slightly the start and the end of the display operation of the pixel circuits, and thus image display quality does not decrease.

Next, the first gate driver circuit 14 and the second gate driver circuit 15 will be described in detail. As illustrated in FIG. 8, the write controlling signals CNT22(1) to CNT22(*n*) each have a voltage waveform having the voltage V22on or the voltage V22off, and it is possible to generate the write controlling signals CNT22(2) to CNT22(*n*) by sequentially shifting the write controlling signal CNT22(1).

Furthermore, the display controlling signals CNT23(1) to CNT23(*n*) each have a voltage waveform having the voltage V23on or the voltage V23off, and it is possible to generate the display controlling signals CNT23(2) to CNT23(*n*) by sequentially shifting the display controlling signal CNT23(1).

For that reason, each of the first gate driver circuit 14 and the second gate driver circuit 15 can be formed using a shift register unit which shifts and outputs a digital signal per clock input and a voltage outputting unit which selectively outputs a voltage from among a plurality of voltages.

According to the present embodiment, circuits each including a combination of the shift register unit and the voltage outputting unit are grouped per plural outputs, and integrated as a single monolithic IC. In the following description, the IC is referred to as a gate driver integrated circuit. In addition, the circuit including the combination of the shift register unit and the voltage outputting unit is referred to as a gate signal line driving unit.

In the following description, it is assumed that the number of pixels in the row direction of the display panel 11 is n=128 for the purpose of illustration. It is also assumed that the gate signal line driving units each having 64-pixel outputs are integrated for two circuits in a single gate driver integrated circuit. However, the number of pixels in the row direction of the display panel 11, and the number of gate signal line driving units and the number of outputs thereof, according to the present disclosure are not limited to those described above.

Figure 9:
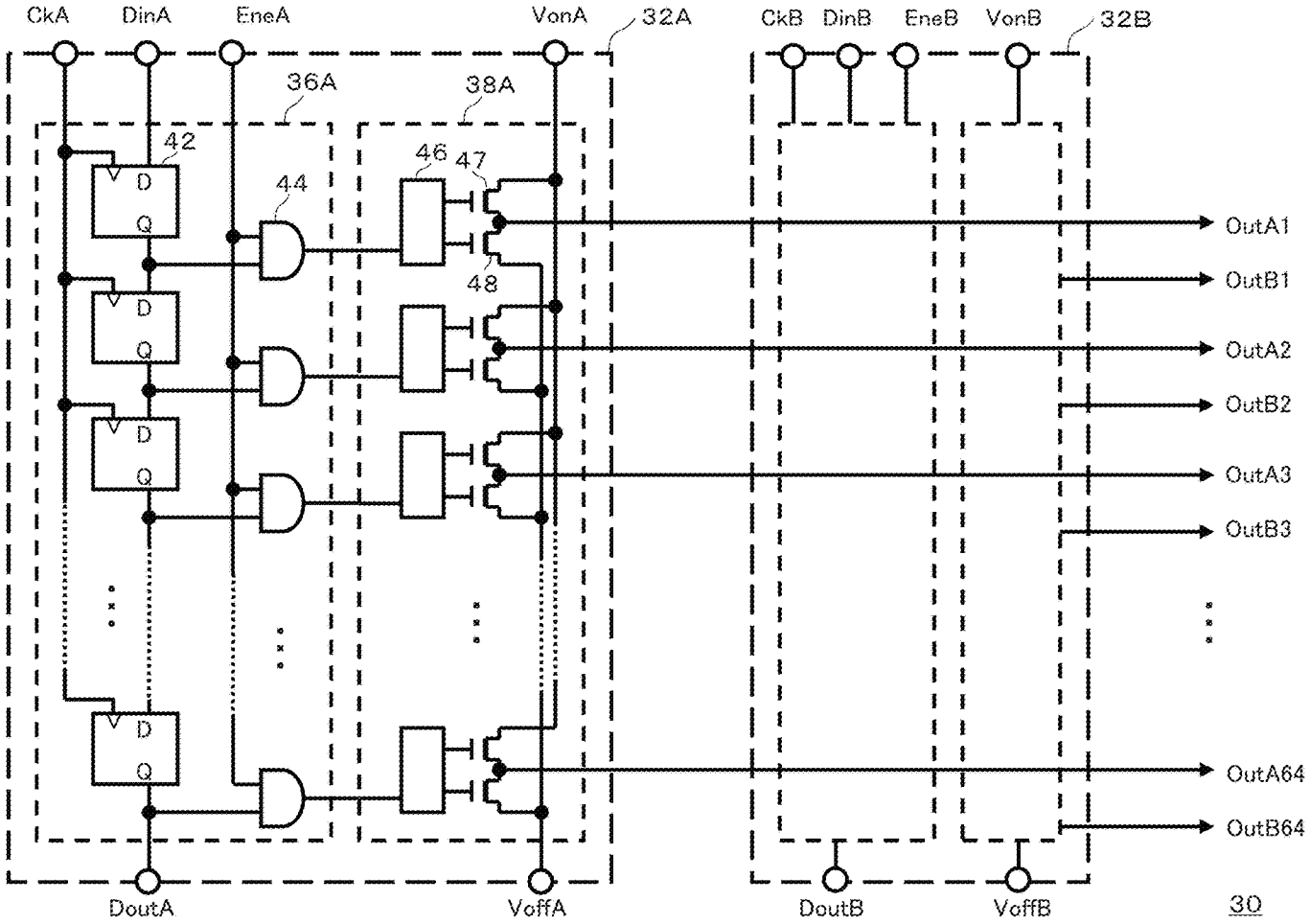
FIG. 9 is a circuit diagram of a gate driver integrated circuit according to Embodiment 1.

FIG. 9 is a circuit diagram illustrating a gate driver integrated circuit 30 of the image display apparatus 10 according to the present embodiment. The gate driver integrated circuit 30 includes two gate signal line driving units 32A and 32B. The gate signal line driving unit 32A includes a shift register unit 36A and a voltage outputting unit 38A.

The shift register unit 36A includes 64 D-type flip-flops 42, and 64 AND gates 44 provided on a one-to-one basis to the outputs of the D-type flip-flops 42.

Each of the clock terminals of the D-type flip-flops 42 is connected to the clock input terminal CkA of the gate driver integrated circuit 30. 64 D-type flip-flops 42 are connected in a cascade arrangement, a data terminal of the D-type flip-flop 42 at the top is connected to a data input terminal DinA of the gate driver integrated circuit 30, and an output terminal of the D-type flip-flops 42 at the end is connected to a data output terminal DoutA of the gate driver integrated circuit 30. One of the input terminals of each of the AND gates 44 is connected to the output terminal of a corresponding one of the D-type flip-flops 42, and the other is connected to an enable input terminal EneA of the gate driver integrated circuit 30.

The shift register unit 36A sequentially shifts, per clock, a digital signal supplied to the data input terminal DinA, and outputs the digital signal from the output terminal of each of the D-type flip-flops 42. At this time, when the enable input terminal EneA is at a high level, the output of each of the D-type flip-flops 42 is outputted from each of the corresponding AND gates 44. In addition, when the enable input terminal EneA is at a low level, a low level is outputted from all of the AND gates 44 irrespective of the output of the D-type flip-flop 42.

The voltage outputting unit 38A includes: 64 level shift units 46; 64 transistors 47; and 64 transistors 48. Each of the level shift units 46 shifts the level of the output of a corresponding one of the AND gates 44 to a voltage that can control ON or OFF of the transistors 47 and the transistors 48.

Each of the transistors 47 is a transistor which operates as a switch and includes (i) one terminal connected to a power supply terminal VonA of the gate driver integrated circuit 30 and (ii) the other terminal connected to an output terminal OutAi ($1 \leq i \leq 64$) of the gate driver integrated circuit 30. Furthermore, each of the transistors 48 is a transistor which operates as a switch and includes (i) one terminal connected to a power supply terminal VoffA of the gate driver integrated circuit 30 and (ii) the other terminal connected to an output terminal OutAi of the gate driver integrated circuit 30.

The transistor 47 is turned ON and the transistor 48 is turned OFF, thereby selecting and outputting a voltage of the power supply terminal VonA. In addition, the transistor 47 is turned OFF and the transistor 48 is turned ON, thereby selecting and outputting a voltage of the power supply terminal VoffA.

The gate signal line driving unit 32B has the same configuration as the gate signal line driving unit 32A, and thus detailed description will be omitted. However, the gate signal line driving unit 32B includes: a clock input terminal CkB; a data input terminal DinB; a data output terminal DoutB; an enable input terminal EneB; a power supply terminal VonB; a power supply terminal VoffB; and output terminals OutB1 to OutB64, which respectively correspond to: the clock input terminal CkA; the data input terminal DinA; the data output terminal DoutA; the enable input terminal EneA; the power supply terminal VonA; the power supply terminal VoffA; and the output terminals OutA1 to OutA64, which are included in the gate signal line driving unit 32A.

As described above, the gate driver integrated circuit 30 according to the present embodiment includes: the clock input terminals CkA and CkB; the enable input terminals EneA and EneB; and the data input terminals DinA and DinB, which are independent of each other, and integrally includes the shift register units (36A and 36B) each having the length corresponding to half or smaller than the number of pixel circuit rows included in the display panel.

As an example, the number of the shift register units 36 formed in the gate driver integrated circuit 30 or the gate driver circuits 14 and 15, or the number of gate driver circuits 14 and 15 according to the present disclosure is at least m when the number of the gate signal lines of the pixel circuits 12 is m. It should be understood that the above-described explanation is applied to other embodiments as well.

Figure 10:
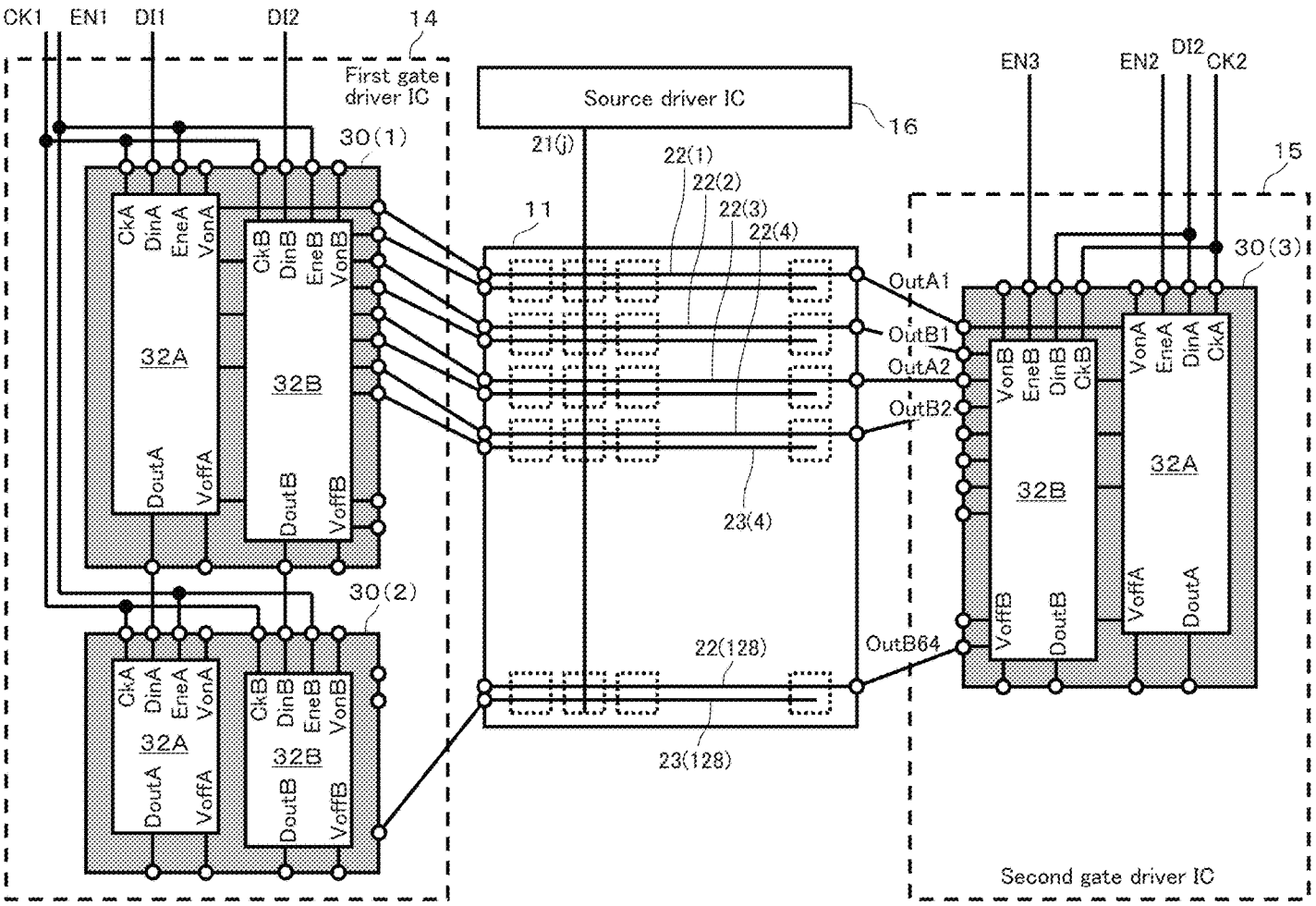
FIG. 10 is a configuration diagram illustrating a first gate driver circuit and a second gate driver circuit according to Embodiment 1.

FIG. 10 is a configuration diagram illustrating the first gate driver circuit 14 and the second gate driver circuit 15 of the image display apparatus 10 according to the present embodiment.

The first gate driver circuit 14 includes two gate driver integrated circuits 30(1) and 30(2), and the second gate driver circuit 15 includes one gate driver integrated circuit 30(3). Here, each of the gate driver integrated circuits 30(1) to 30(3) has the same circuit configuration as the circuit configuration of the gate driver integrated circuit 30 illustrated in FIG. 9.

Output terminals of the gate driver integrated circuit 30(1) and the gate driver integrated circuit 30(2) mounted on the first gate driver circuit 14 are connected to the gate signal lines 22(1) to 22(128) and the gate signal lines 23(1) to 23(128) which are drawn to the left side of the display panel 11.

According to the present embodiment, the gate signal line 22(1) is connected to the output terminal OutA1 of the gate driver integrated circuit 30(1), the gate signal line 22(2) is connected to the output terminal OutA2 of the gate driver integrated circuit 30(1), the gate signal line 22(3) is connected to the output terminal OutA3 of the gate driver integrated circuit 30(1), . . . , and the gate signal line 22(64) is connected to the output terminal OutA64 of the gate driver integrated circuit 30(1).

In addition, the gate signal line 23(1) is connected to the output terminal OutB1 of the gate driver integrated circuit 30(1), the gate signal line 23(2) is connected to the output terminal OutB2 of the gate driver integrated circuit 30(1), . . . , and the gate signal line 23(64) is connected to the output terminal OutB64 of the gate driver integrated circuit 30(1).

In addition, the gate signal line 22(65) is connected to the output terminal OutA1 of the gate driver integrated circuit 30(2), the gate signal line 22(66) is connected to the output terminal OutA2 of the gate driver integrated circuit 30(2), the gate signal line 22(67) is connected to the output terminal OutA3 of the gate driver integrated circuit 30(2), . . . , and the gate signal line 22(128) is connected to the output terminal OutA64 of the gate driver integrated circuit 30(2).

In addition, the gate signal line 23(65) is connected to the output terminal OutB1 of the gate driver integrated circuit 30(2), the gate signal line 23(66) is connected to the output terminal OutB2 of the gate driver integrated circuit 30(2), . . . , and the gate signal line 23(128) is connected to the output terminal OutB64 of the gate driver integrated circuit 30(2).

The clock input terminal CkA and the clock input terminal CkB of the gate driver integrated circuit 30(1), and the clock input terminal CkA and the clock input terminal CkB of the gate driver integrated circuit 30(2), are connected to each other, and a first clock CK1 is supplied.

In addition, the enable input terminal EneA and the enable input terminal EneB of the gate driver integrated circuit 30(1), and the enable input terminal EneA and the enable input terminal EneB of the gate driver integrated circuit 30(2), are connected to each other, and an enable signal EN1 is supplied.

The data output terminal DoutA of the gate driver integrated circuit 30(1) is connected to the data input terminal DinA of the gate driver integrated circuit 30(2), and the data output terminal DoutB of the gate driver integrated circuit 30(1) is connected to the data input terminal DinB of the gate driver integrated circuit 30(2).

The gate driver integrated circuit 30(1) and the gate driver integrated circuit 30(2) are connected in the cascade arrangement. The data input terminal DinA of the gate driver integrated circuit 30(1) is supplied with a signal DI1 for generating write controlling signals 22(1) to 22(128), and the data input terminal DinB of the gate driver integrated circuit 30(1) is supplied with a signal DI2 for generating display controlling signals 23(1) to 23(128).

Furthermore, the power supply terminal VonA of the gate driver integrated circuit 30(1) is connected to the power supply terminal VonA of the gate driver integrated circuit 30(2) and the voltage V22on is applied, and the power supply terminal VoffA of the gate driver integrated circuit 30(1) is connected to the power supply terminal VoffA of the gate driver integrated circuit 30(2) and the voltage V22off is applied.

Furthermore, the power supply terminal VonB of the gate driver integrated circuit 30(1) is connected to the power supply terminal VonB of the gate driver integrated circuit 30(2) and the voltage V23on is applied, and the power supply terminal VoffB of the gate driver integrated circuit 30(1) is connected to the power supply terminal VoffB of the gate driver integrated circuit 30(2) and the voltage V23off is applied.

Meanwhile, output terminals of the gate driver integrated circuit 30(3) mounted on the second gate driver circuit 15 are connected to the gate signal lines 22(1) to 22(128) which are drawn to the left side of the display panel 11.

According to the present embodiment, among the gate signal lines 22(1) to 22(128), the gate signal line 22(1), the gate signal line 22(3), the gate signal line 22(5), . . . , and the gate signal line 22(127), which are the odd-numbered gate signal lines, are connected respectively to the output terminal OutA1 of the gate driver integrated circuit 30(3), the output terminal OutA2 of the gate driver integrated circuit 30(3), the output terminal OutA3 of the gate driver integrated circuit 30(3), . . . , and the output terminal OutA64 of the gate driver integrated circuit 30(3).

In addition, the gate signal line 22(2), the gate signal line 22(4), the gate signal line 22(6), . . . , and the gate signal line 22(128), which are the even-numbered gate signal lines, are connected respectively to the output terminal OutB1 of the gate driver integrated circuit 30(3), the output terminal OutB2 of the gate driver integrated circuit 30(3), the output terminal OutB3 of the gate driver integrated circuit 30(3), . . . , and the output terminal OutB64 of the gate driver integrated circuit 30(3).

The clock input terminal CkA and the clock input terminal CkB of the gate driver integrated circuit 30(3) are connected to each other and a second clock CK2 is supplied. Furthermore, the enable input terminal EneA and the enable input terminal EneB of the gate driver integrated circuit 30(3) are supplied with an enable signal EN2 and an enable signal EN3, respectively. The data input terminal DinA and the data input terminal DinB of the gate driver integrated circuit 30(3) are connected to each other, and the signal DI2 for generating write controlling signals 22(1) to 22(128) are supplied.

Furthermore, the power supply terminal VonA and the power supply terminal VonB of the gate driver integrated circuit 30(3) are connected to each other, and the voltage V22on is applied. The power supply terminal VoffA and the power supply terminal VoffB of the gate driver integrated circuit 30(3) are connected to each other, and the voltage V22off is applied.

The gate driver circuit has (i) a first operation mode in which a scanning signal including an ON voltage and a first OFF voltage is applied to the gate signal lines and (ii) a second operation mode in which a scanning signal including the ON voltage, the first OFF voltage, and a second OFF voltage is applied to the gate signal lines, and selects one of the first operation mode and the second operation mode based on a logic signal applied to the control terminal of the gate driver circuit.

Figure 11:
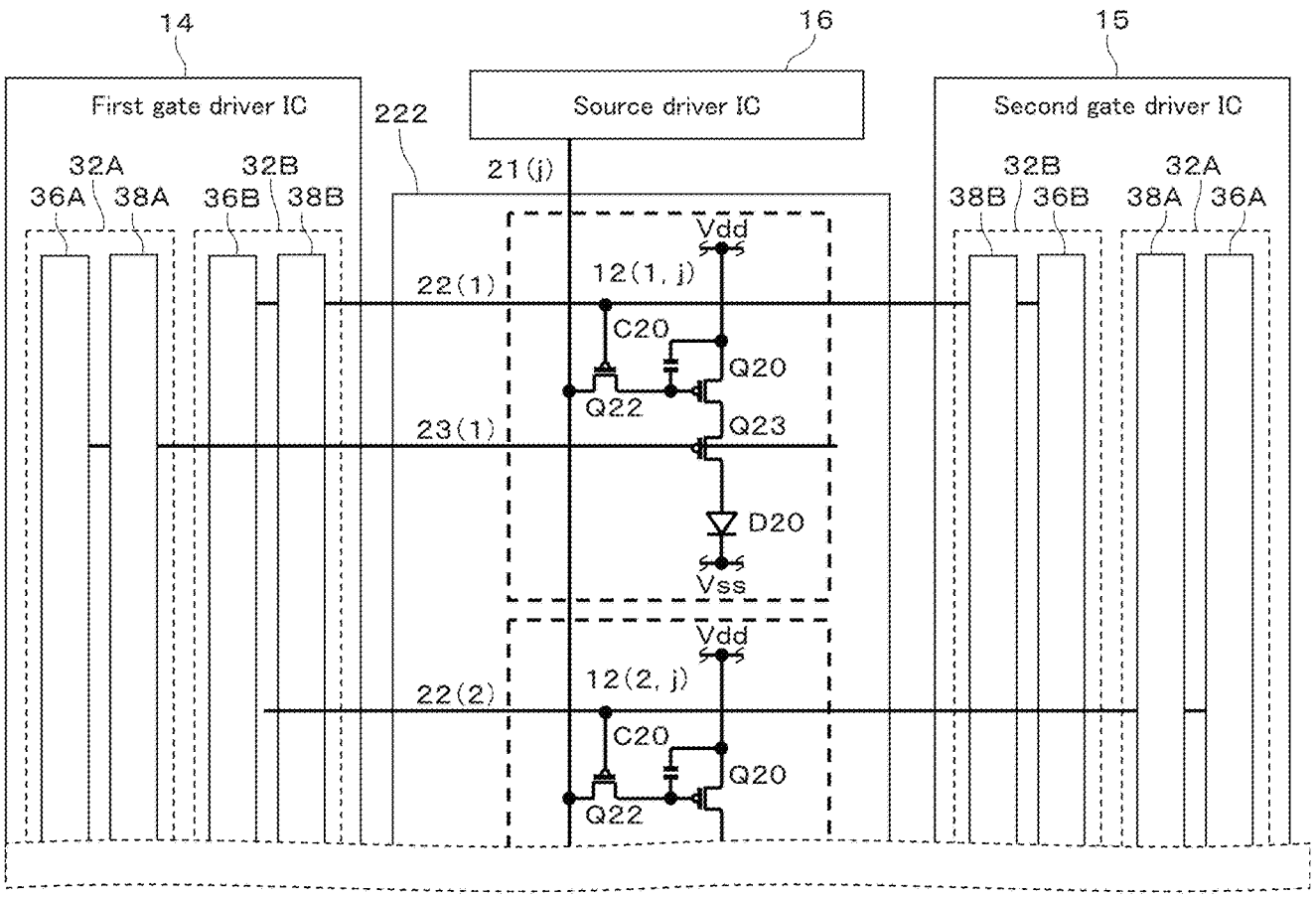
FIG. 11 is a configuration diagram of the image display apparatus according to Embodiment 1.

FIG. 11 is a diagram explaining the connection state between the first gate driver circuit 14, the second gate driver circuit 15, and the pixel circuits 12. The gate driving circuit includes two gate signal line driving units. The first gate driver circuit 14 and the second gate driver circuit 15 drive the gate signal line 22, and the first gate driver circuit 14 further drives the gate signal line 23.

The gate signal line driving unit 32A of the first gate driver circuit 14 and the gate signal line driving unit 32A of the second gate driver circuit 15 drive the gate signal line 23(*i*). The gate signal line driving unit 32B of the first gate driver circuit 14 drives the gate signal line 22(*i*).

The gate signal line 23(*i*) is a signal line to which a signal for turning ON or OFF the switching transistor Q23 is applied. Accordingly, the switching transistor Q23 does not require the high slew rate operation. Thus, the gate signal line 23(*i*) may also be driven by the unilateral driving.

The first gate driver circuit 14 disposed on the left side drives all of the gate signal lines formed on the display panel 11, whereas the second gate driver circuit 15 disposed on the right side drives half of the gate signal lines disposed on the display panel 11. Accordingly, the number of the second gate driver circuits 15 disposed on the right side may be half the number of the first gate driver circuits 14 disposed on the left side. For the reasons described above, it is possible to realize cost reduction.

Figure 12:
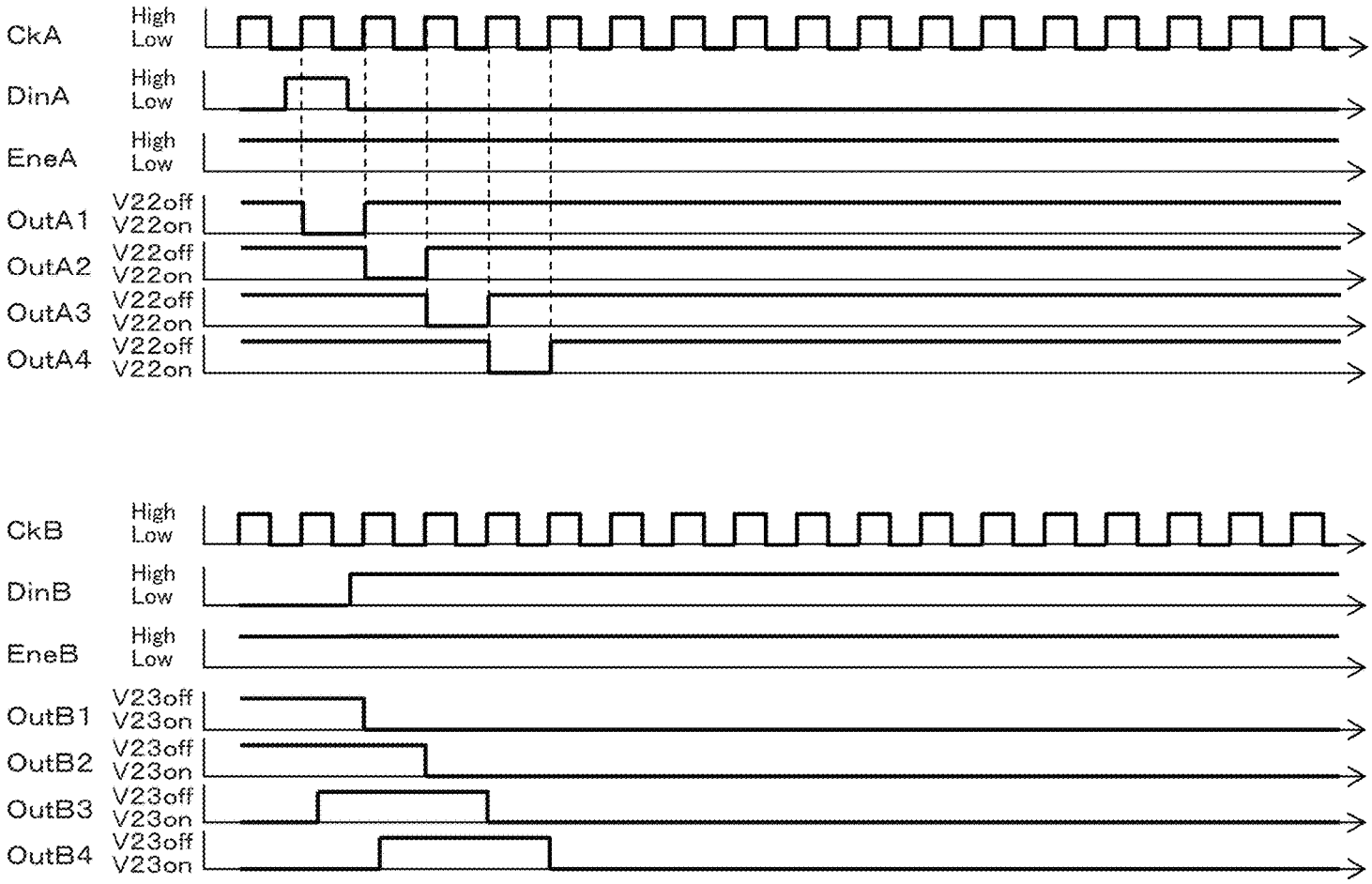
FIG. 12 is a timing chart illustrating an operation of the first gate driver circuit according to Embodiment 1.

FIG. 12 is a timing chart illustrating an operation of the first gate driver circuit 14 of the image display apparatus 10 according to the present embodiment.

The first clock CK1 having a cycle of 1 μs is supplied to the clock input terminal CkA of the gate signal line driving unit 32A of each of the gate driver integrated circuit 30(1) and the gate driver integrated circuit 30(2), and the enable input terminal EneA is fixed to the high level. The signal DI1 having a pulse width of approximately 1 μs is supplied to the data input terminal DinA of the gate driver integrated circuit 30(1).

The shift register unit 36A shifts and outputs the signal DI1 for each input of the clock CK1. The voltage outputting unit 38A outputs the voltage V22off when the output of the shift register unit 36A is at a low level, and the outputs the voltage V22on when the output of the shift register unit 36A is at a high level.

In such a manner as described above, the output terminal OutA1 of the gate driver integrated circuit 30(1) outputs the write controlling signal CNT22(1), the output terminal OutA2 outputs the write controlling signal CNT22(2), . . . , and the output terminal OutA64 outputs the write controlling signal CNT22(64). In addition, since the gate driver integrated circuit 30(1) and the gate driver integrated circuit 30(2) are connected in the cascade arrangement, the output terminal OutA1 of the gate driver integrated circuit 30(2) outputs the write controlling signal CNT22(65), the output terminal OutA2 outputs the write controlling signal CNT22(66), . . . , and the output terminal OutA64 outputs the write controlling signal CNT22(128).

The first clock CK1 having a cycle of 1 μs is also supplied to the clock input terminal CkB of the gate signal line driving unit 32B of each of the gate driver integrated circuit 30(1) and the gate driver integrated circuit 30(2), and the enable input terminal EneB is fixed to the high level. The signal DI2 which stays at a high level during most of the 1 field period other than the high level period of the signal DI1 is supplied to the data input terminal DinB of the gate driver integrated circuit 30(1).

The shift register unit 36B shifts and outputs the signal DI2 for each input of the clock CK1. The voltage outputting unit 38A outputs the voltage V23off when the output of the shift register unit 36B is at a low level, and the outputs the voltage V23on when the output of the shift register unit 36B is at a high level.

In such a manner as described above, the output terminal OutB1 of the gate driver integrated circuit 30(1) outputs the display controlling signal CNT23(1), the output terminal OutB2 outputs the display controlling signal CNT23(2), . . . , and the output terminal OutB64 outputs the display controlling signal CNT23(64).

In addition, the output terminal OutB1 of the gate driver integrated circuit 30(2) outputs the display controlling signal CNT23(65), the output terminal OutB2 outputs the display controlling signal CNT23(66), . . . , and the output terminal OutB64 outputs the display controlling signal CNT23(128).

Figure 13:
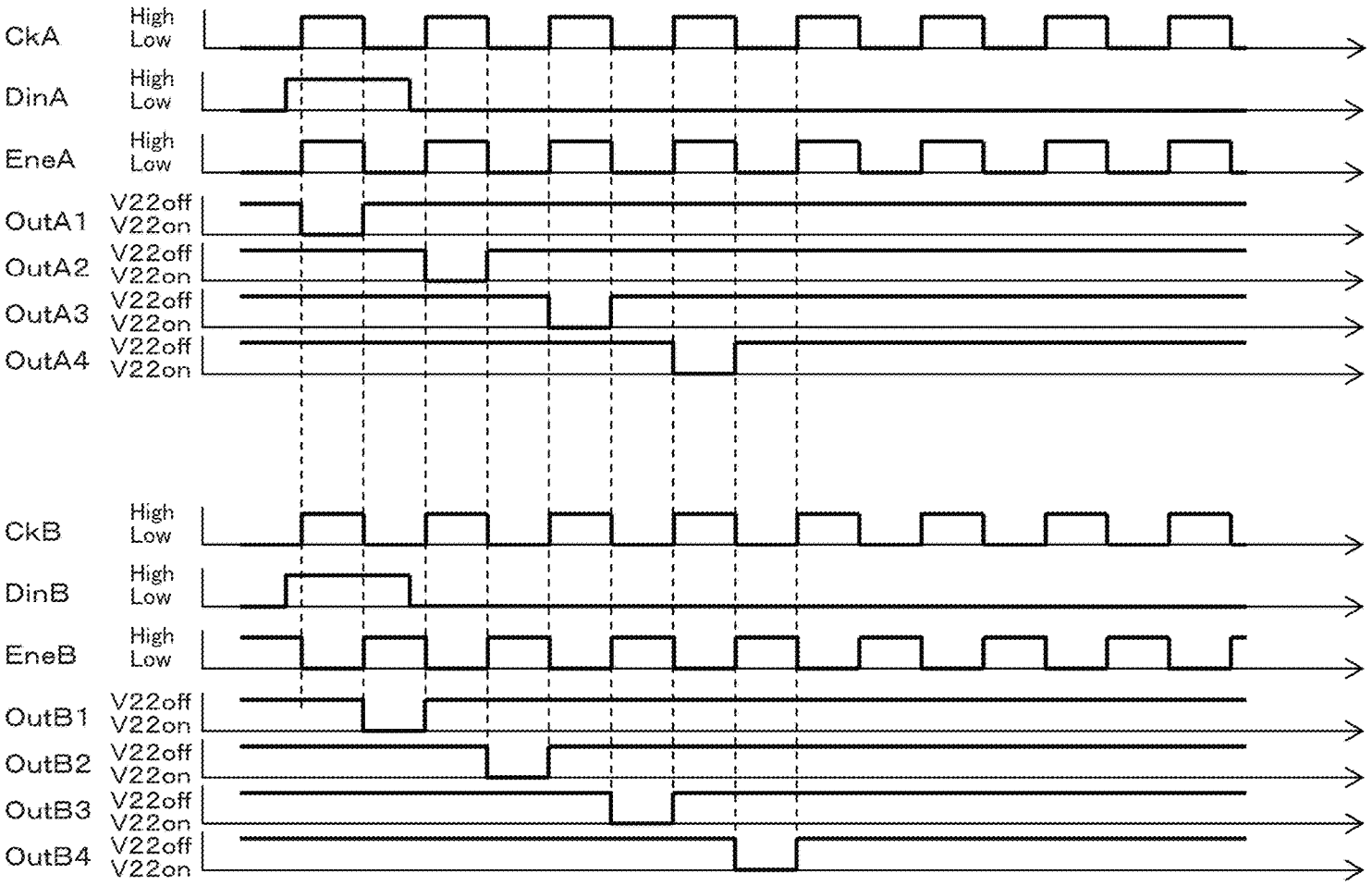
FIG. 13 is a timing chart illustrating an operation of the second gate driver circuit according to Embodiment 1.

FIG. 13 is a timing chart illustrating an operation of the second gate driver circuit 15 of the image display apparatus 10 according to the present embodiment.

The second clock CK2 having a cycle of 2 μs that is twice as long as the cycle of the first clock CK1 is supplied to the clock input terminal CkA of the gate signal line driving unit 32A of the gate driver integrated circuit 30(3), and the enable signal EN2 having the same shape as the second clock CK2 is supplied to the enable input terminal EneA. The signal DI2 having a pulse width of approximately 2 μs is supplied to the data input terminal DinA. As described above, the first clock that is an operation clock of the shift register of the first gate driver circuit 14 is different from the second clock that is an operation clock of each of the shift register of the second gate driver circuit 15.

The shift register unit 36A shifts the signal DI2 for each input of the clock CK2 and outputs a logical AND of the signal DI2 and the enable signal EN2. The voltage outputting unit 38A outputs the voltage V22off when the output of the shift register unit 36A is at a low level, and the outputs the voltage V22on when the output of the shift register unit 36A is at a high level.

In such a manner as described above, the gate signal line driving unit 32A outputs write controlling signals for odd-numbered lines. In other words, the output terminal OutA1 outputs the write controlling signal CNT22(1), the output terminal OutA2 outputs the write controlling signal CNT22(3), . . . , and the output terminal OutA64 outputs the write controlling signal CNT22(127).

Meanwhile, although the second clock CK2 is supplied to the clock input terminal CkB of the gate signal line driving unit 32B of the gate driver integrated circuit 30(3), the enable signal EN3 having the same cycle as the second clock CK2 and a shape with a phase being different hundred-and-eighty-degree from the second clock CK2 is supplied to the enable input terminal EneB. The signal DI2 is supplied to the data input terminal DinB.

The shift register unit 36B shifts the signal DI2 for each input of the clock CK2 and outputs a logical AND of the signal DI2 and the enable signal EN3. The voltage outputting unit 38B outputs the voltage V22off when the output of the shift register unit 36B is at a low level, and the outputs the voltage V22on when the output of the shift register unit 36B is at a high level.

In such a manner as described above, the gate signal line driving unit 32B outputs write controlling signals for even-numbered lines. In other words, the output terminal OutB1 outputs the write controlling signal CNT22(2), the output terminal OutB2 outputs the write controlling signal CNT22(4), . . . , and the output terminal OutB64 outputs the write controlling signal CNT22(128).

As described above, according to the present embodiment, the first gate driver circuit 14 and the second gate driver circuit 15 are configured using the gate driver integrated circuit 30 which includes circuits that each include a combination of the shift register units 36A and 36B and the voltage outputting units 38A and 38B, and are grouped per plural outputs and integrated as a single monolithic IC.

As described above, with the image display apparatus 10 according to the present embodiment, it is possible to make the gate driver circuit 14 compact by integration. Accordingly, the area for mounting is reduced, making it possible to reduce the costs.

The gate driver integrated circuit 30(1) and the gate driver integrated circuit 30(2) are connected in a cascade arrangement in the first gate driver circuit 14, and thus the first gate driver circuit 14 includes the first shift register unit having at least the same number of stages as the number of pixel circuit rows included in the display panel 11; that is, the shift register unit 36A of the gate driver integrated circuit 30(1) and the shift register unit 36A of the gate driver integrated circuit 30(2) which are connected in the cascade arrangement, and supplies, from one side of the pixel circuit rows, each of the first gate signal lines (gate signal lines 22(*i*)) with the first control signal (write controlling signal CNT22(*i*)) generated by the first shift register unit using the first clock CK1.

In addition, the second gate driver circuit 15 includes N second shift registers (N=2, in the present embodiment) each having the length corresponding to at least 1/N of the number of the pixel circuit rows included in the display panel 11 (i.e., the shift register unit 36A and the shift register unit 36B of the gate driver integrated circuit 30(3)), and supplies, from the other side of the pixel circuit rows, each of the first gate signal lines (gate signal lines 22(*i*)) with the first control signal (write controlling signal CNT22(*i*)) generated by each of the second shift register units using the second clock CK2 having the Nth cycle of the first clock CK1.

It is to be noted that, when L effective pixel rows are included in the display screen, the first gate driver circuit 14 may include the first shift register unit having L stages, and the second gate driver circuit 15 may include N second shift register units each having L/N stages.

Figure 14:
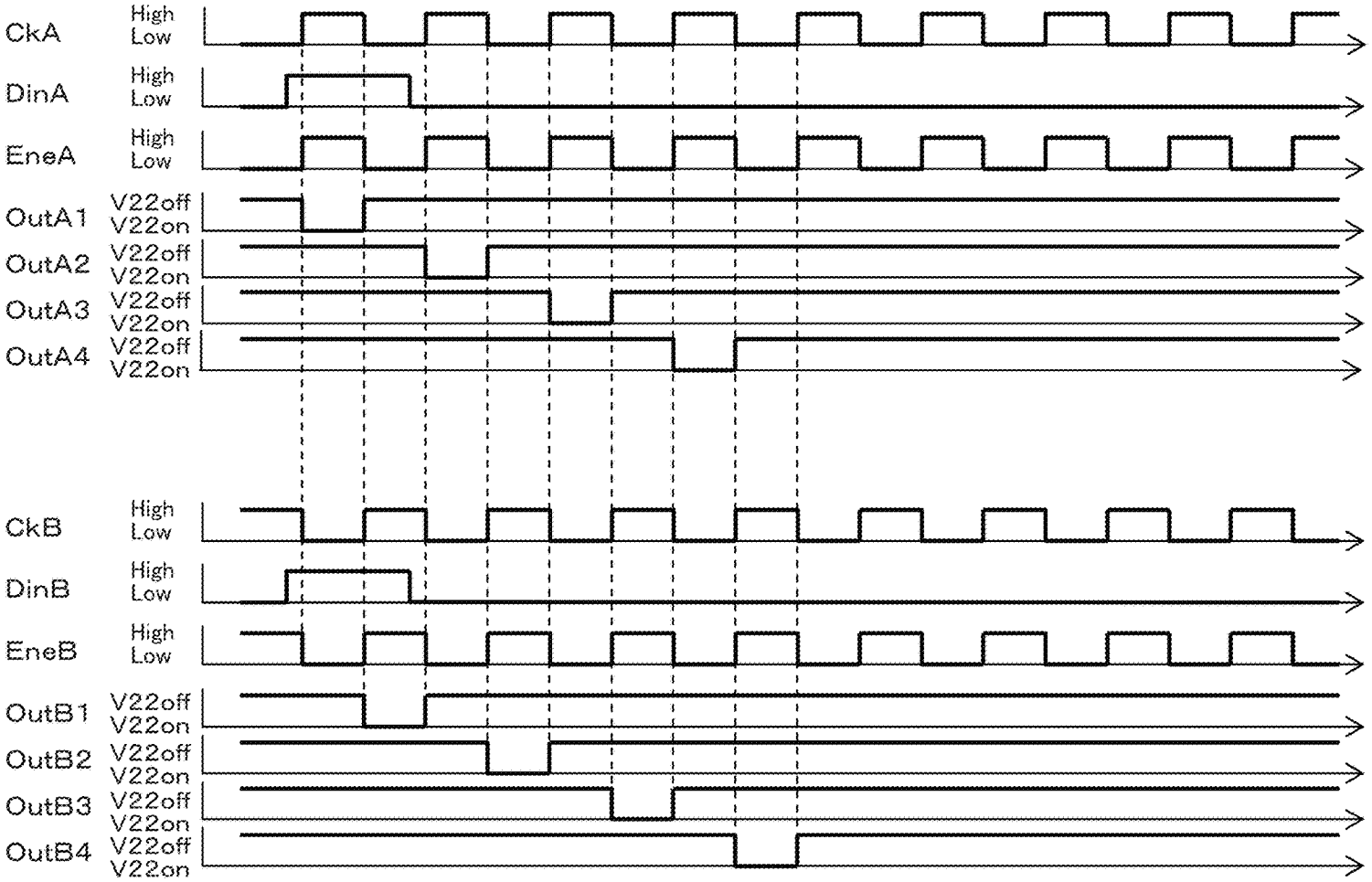
FIG. 14 is a timing chart illustrating another example of the operation of the second gate driver circuit according to Embodiment 1.

It is to be noted that the various signals supplied to the gate driver integrated circuit 30 are not limited to those described above. FIG. 14 is a timing chart illustrating another example of the operation of the second gate driver circuit 15 of the image display apparatus 10 according to the present embodiment.

The second clock CK2 is supplied to the clock input terminal CkA of the gate signal line driving unit 32A of the gate driver integrated circuit 30(3), the enable signal EN2 having the same shape as the second clock CK2 is supplied to the enable input terminal EneA, and the signal DI2 is supplied to the data input terminal DinA.

The clock CK3 having the same cycle as the second clock CK2 and a phase that is different hundred-and-eighty-degree from the second clock CK2 is supplied to the clock input terminal CkB of the gate signal line driving unit 32B of the gate driver integrated circuit 30(3). The enable signal EN3 having the same shape as the clock CK3 is supplied to the enable input terminal EneB. The signal DI2 is supplied to the data input terminal DinB.

In the above-described manner, it is also possible to output the write controlling signals for odd-numbered lines from the gate signal line driving unit 32A, and to output the write controlling signals for even-numbered lines from the gate signal line driving unit 32B.

It is to be noted that the gate driver integrated circuit 30(3), the gate driver integrated circuit 30(1), and the gate driver integrated circuit 30(2) are integrated circuits configured according to the same specification, and thus the package and the arrangement of the input and output terminals are the same among the integrated circuits. For that reason, the gate driver integrated circuit 30(3) needs to be mounted so as to be opposite to the gate driver integrated circuit 30 of the first gate driver circuit 14 and the gate driver integrated circuit 30 of the second gate driver circuit 15, with respect to the image display surface.

For example, when the gate driver integrated circuit 30(1) and the gate driver integrated circuit 30(2) are mounted on the front surface side of the first gate driver circuit 14 and the second gate driver circuit 15 illustrated in FIG. 10, the gate driver integrated circuit 30(3) needs to be mounted on the rear surface side of the first gate driver circuit 14 and the second gate driver circuit 15 illustrated in FIG. 10.

However, by adding a function of inverting a signal to be supplied, to the output terminals OutA1 to OutA64 and the output terminals OutB1 to OutB64 of the gate driver integrated circuit 30, it is possible to mount, on the same surface side, the gate driver integrated circuit 30(1) and the gate driver integrated circuit 30(2) of the first gate driver circuit 14, and the gate driver integrated circuit 30(3) of the second gate driver circuit 15.

Figure 15:
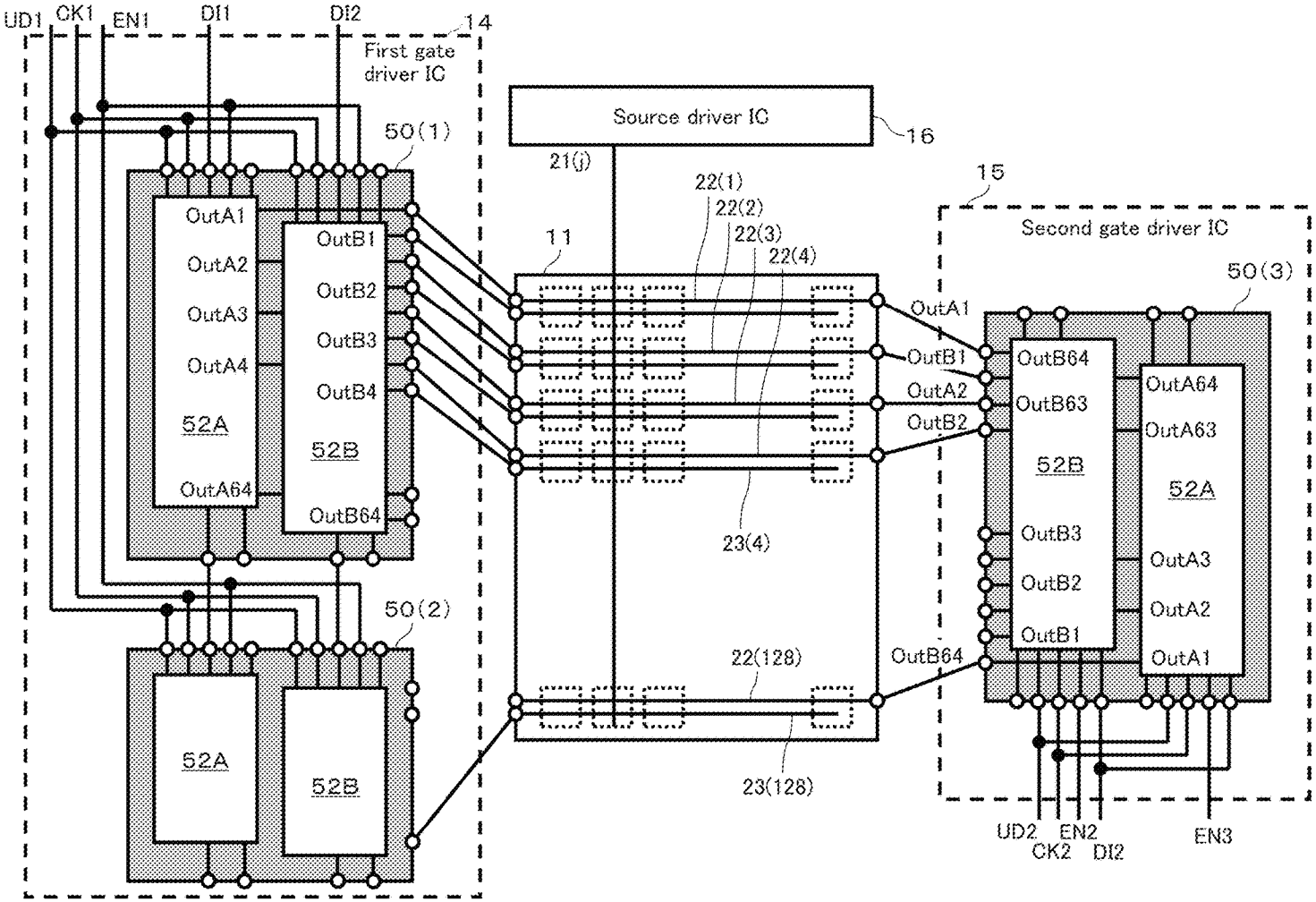
FIG. 15 is configuration diagram illustrating the first gate driver circuit and the second gate driver circuit according to Embodiment 1.

FIG. 15 is a configuration diagram illustrating the first gate driver circuit 14 and the second gate driver circuit 15 of the image display apparatus 10 according to the present embodiment. The first gate driver circuit 14 and the second gate driver circuit 15 each include a gate driver integrated circuit 50 in which the function of inverting the order of signals to be supplied is added to the output terminals OutA1 to OutA64 and the output terminals OutB1 to OutB64.

By inverting the order of signals to be outputted from the gate driver integrated circuit 50(3) disposed on the second gate driver circuit 15, it is possible to mount the gate driver integrated circuit 50(3) of the second gate driver circuit 15 on the same surface side as the gate driver integrated circuit 50(1) and the gate driver integrated circuit 50(2) which are disposed on the first gate driver circuit 14.

Figure 16:
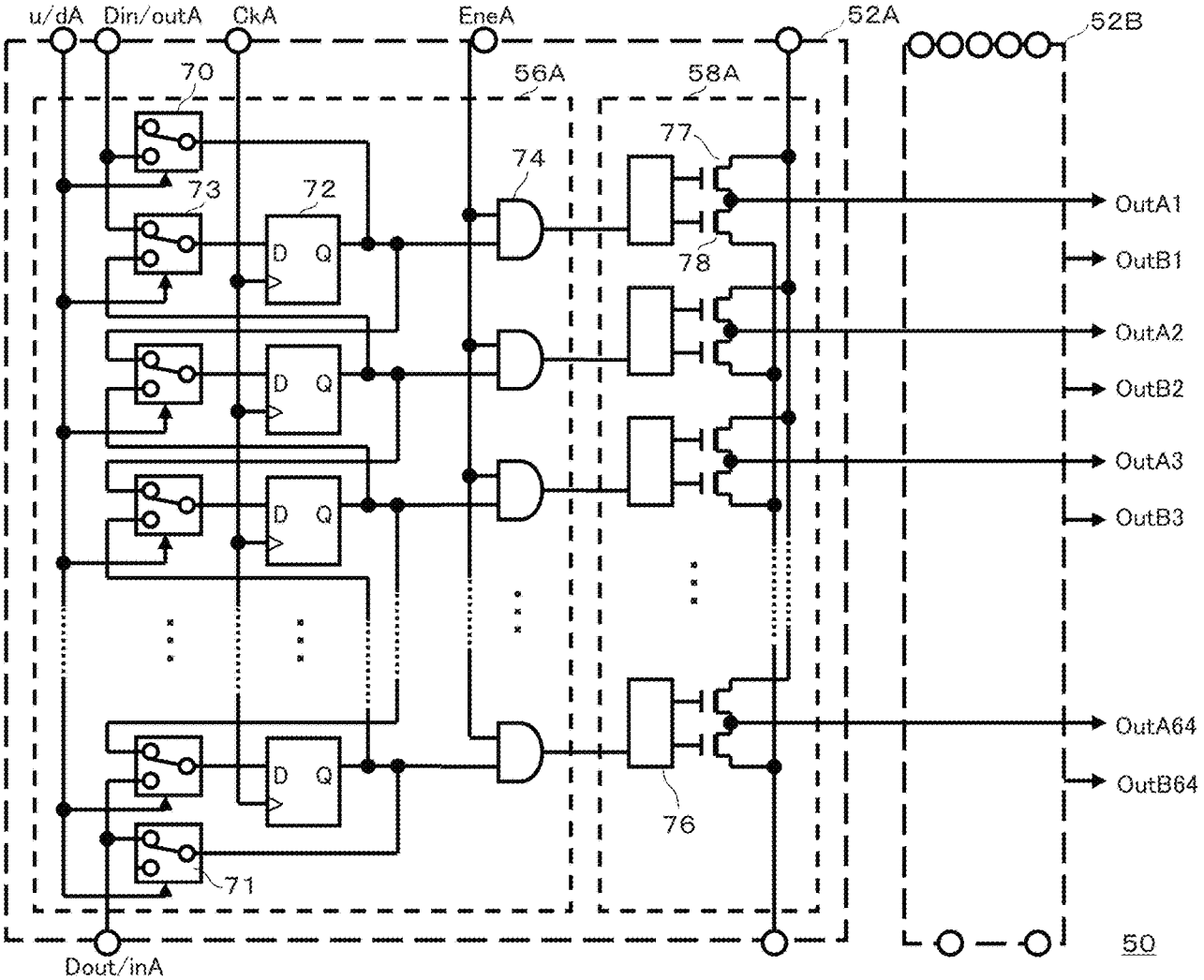
FIG. 16 is a circuit diagram of another gate driver integrated circuit according to Embodiment 1.

FIG. 16 is a circuit diagram illustrating another example of the gate driver integrated circuit 50 of the image display apparatus 10 according to the present embodiment. More specifically, FIG. 16 is a circuit diagram of the gate driver integrated circuit 50 to which the function of inverting the order of signals to be outputted is added to the output terminals.

The gate driver integrated circuit 50 includes two gate signal line driving units 52A and 52B. The gate signal line driving unit 52A includes a shift register unit 56A and a voltage outputting unit 58A. The gate signal line driving unit 52B has the same circuit configuration as the gate signal line driving unit 52A. The gate signal line driving unit 52B includes a shift register unit 56B and a voltage outputting unit 58B. In addition, the voltage outputting unit 58A has the same circuit configuration as the voltage outputting unit 38A of the gate driver integrated circuit 30. Thus, the shift register unit 56A will be described in detail below.

The shift register unit 56A includes 64 D-type flip-flops 72, a selector 73 provided on the input of each of the D-type flip-flops 72, and 64 AND gates 74 provided on the output of each of the D-type flip-flops 72.

Each of the clock terminals of the D-type flip-flops 72 is connected to the clock input terminal CkA of the gate driver integrated circuit 50. 64 D-type flip-flops (DFF) 72 are connected in a cascade arrangement via the selectors 73 each of which performs selection to invert the shift direction of the shift register. The selectors 70 and 71 each switch input and output of a corresponding one of the data input and output terminals Din/outA and Dout/inA of the shift register unit 56A.

One of the input terminals of each of the AND gates 74 is connected to the output terminal of a corresponding one of the D-type flip-flops 72, and the other is connected to an enable input terminal EneA of the gate driver integrated circuit 50.

When the control terminal u/dA of the selectors 70, 71, and 73 is at a high level, the shift register unit 56A sequentially shifts in the forward direction, per clock, a digital signal supplied to the data input and output terminal Din/outA, and outputs the digital signal from the output terminal of each of the D-type flip-flops 42. In addition, when the control terminal u/dA is at a low level, the shift register unit 56A sequentially shifts in the opposite direction, per clock, a digital signal supplied to the data input and output terminal Dout/inA, and outputs the digital signal from the output terminal of each of the D-type flip-flops 42.

At this time, when the enable input terminal EneA is at a high level, the output of each of the D-type flip-flops 72 is outputted from a corresponding one of the AND gates 74. When the enable input terminal EneA is at a low level, all of the AND gates 74 output low level irrespective of the output of the D-type flip-flop 72.

According to the configuration described above, it is possible to add the function of inverting the order of signals to be outputted, to the output terminals OutA1 to OutA64 of the gate signal line driving unit 52A.

It is to be noted that, in the present embodiment, in order to simplify the description, the display panel 11 is exemplified which includes the pixel circuits 12(*i, j*) arranged in a matrix each of which includes the gate signal line 22(*j*) that is applied with the bilateral driving, and the gate signal line 23(*j*) that is applied with the unilateral driving. However, the number of the gate signal lines of the pixel circuit is generally not limited to the number described above, and the number of the gate signal lines which are applied with the bilateral driving and the number of the gate signal lines which are applied with the unilateral driving are optimally determined according to the configuration of the pixel circuit 12(*i, j*).

For example, according to an exemplary embodiment, three gate signal lines are formed on the pixel circuit 12(*i, j*), two of the three gate signal lines are applied with the bilateral driving, and the remaining gate signal line is applied with the unilateral driving. It should be understood that the above-described explanation is applied to other embodiments of the present disclosure as well.

It is to be noted that, in the image display apparatus 10 that operates according to the timing chart in FIG. 12 etc., the output voltages of OutA and OutB are two kinds of voltages, the voltage Von and the voltage Voff. However, the voltages are not limited to these voltages according to the present disclosure. For example, the gate driver circuit or the like may be configured such that three voltages are applied to the gate signal line as illustrated in (b) in FIG. 17.

Figure 17:
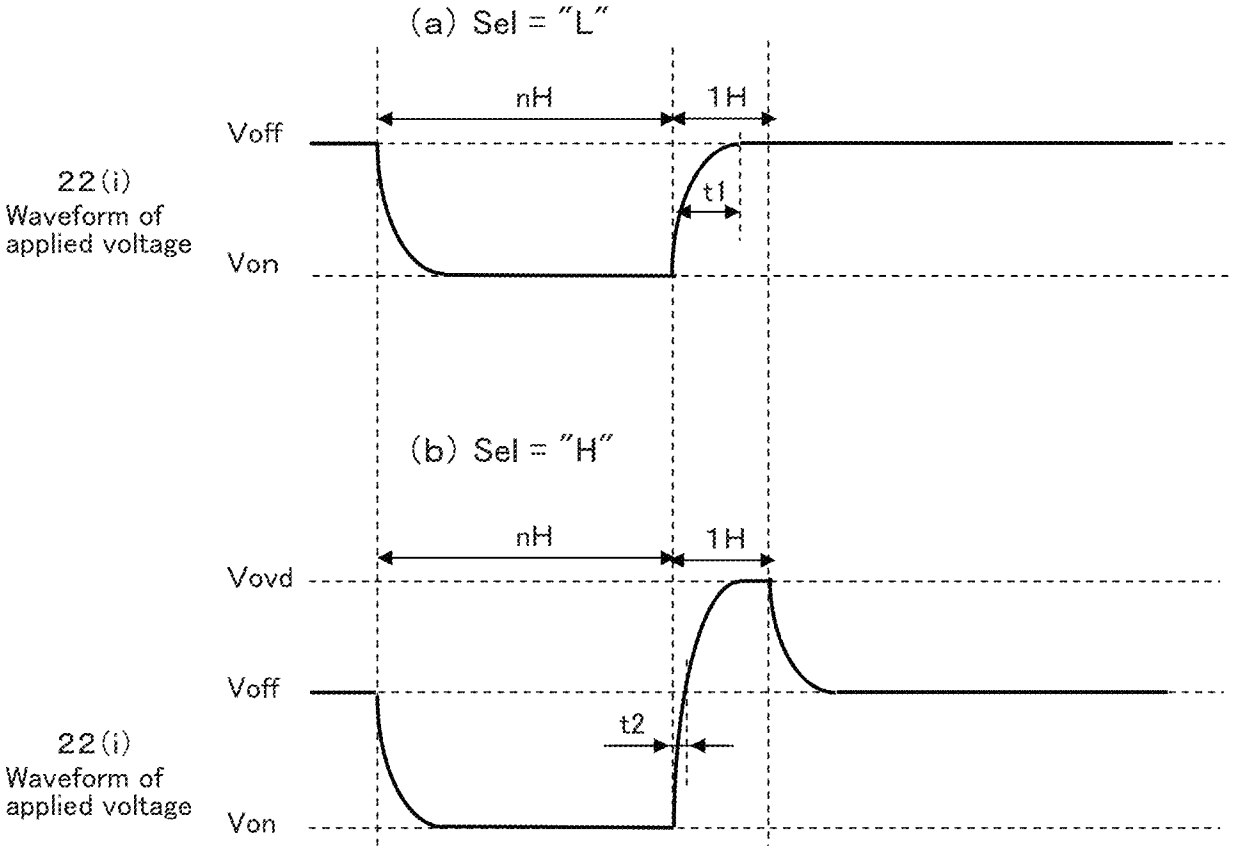
FIG. 17 is an output waveform diagram of the gate driver integrated circuit according to Embodiment 1.

In FIG. 17, (a) illustrates the driving system of applying two voltages, the voltage Von and the voltage Voff, to the gate signal line in the same manner as FIG. 12, etc. The driving system of applying two voltages is referred to as gate voltage binary driving. The operation according to the gate voltage binary driving corresponds to the first operation mode according to the present embodiment.

The driving system of applying three voltages, the voltage Von, the voltage Voff, and a voltage Vovd, to the gate signal line is illustrated in (b) in FIG. 17. The driving system of applying three voltages is referred to as gate voltage ternary driving. The operation according to the gate voltage ternary driving corresponds to the second operation mode according to the present embodiment.

The gate voltage ternary driving is applied to the gate signal line 22(*i*) to which the gate terminal of the transistor Q22 to be applied with the video signal voltage is connected. In other words, the gate voltage ternary driving is performed on the gate signal line which requires the bilateral driving. The gate voltage binary driving is applied to gate signal line 22(*i*) to which the gate terminal of the transistor Q23 is connected. In other words, the gate voltage binary driving is performed on the gate signal line which does not require a high slew rate and to which the unilateral driving is applied.

Figure 18:
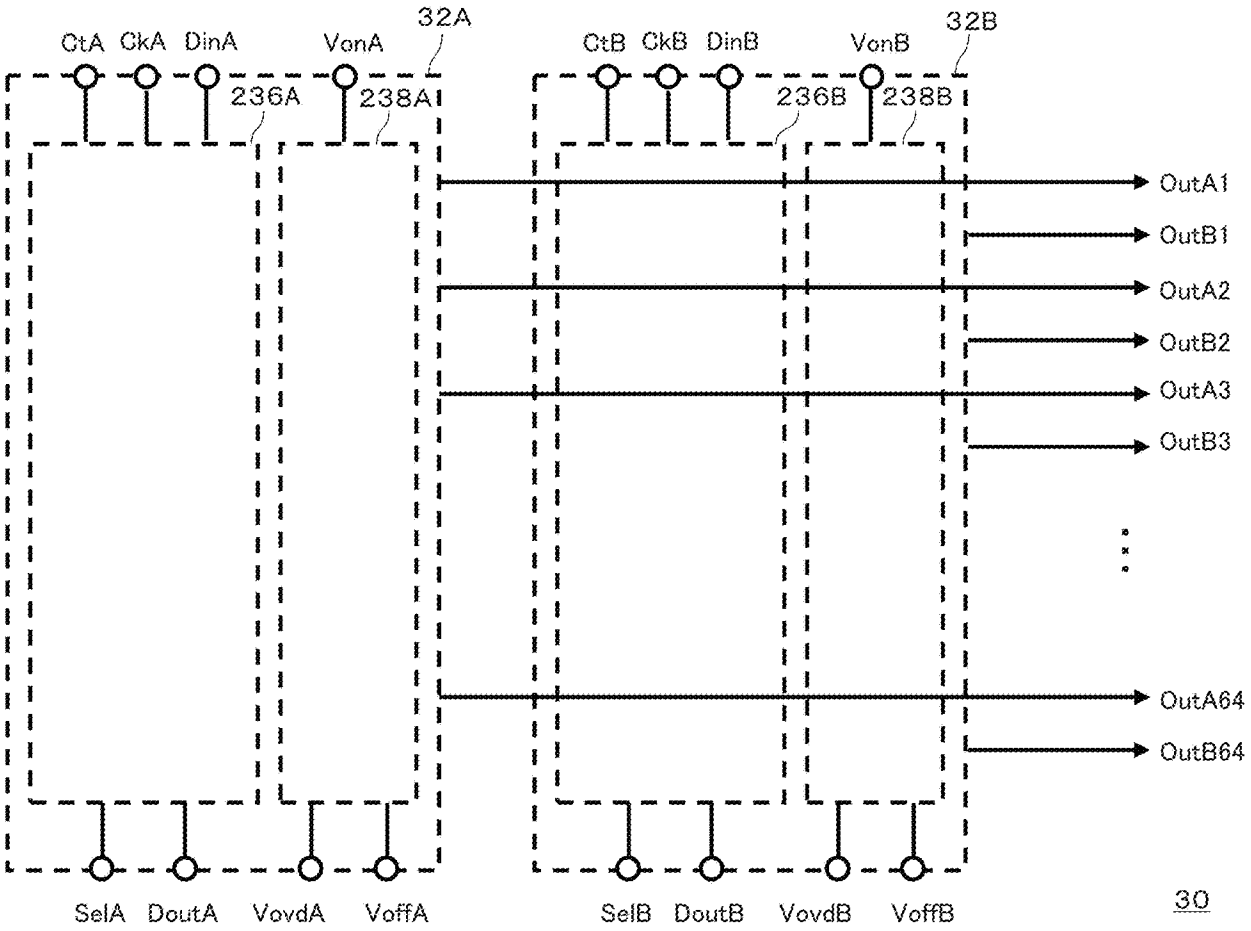
FIG. 18 is a circuit diagram of another gate driver integrated circuit according to Embodiment 1.

FIG. 18 is a diagram explaining a driver gate signal line driving unit which is capable of performing both of the gate voltage binary driving and the gate voltage ternary driving. The configuration of the gate driver circuit illustrated in FIG. 18 differs from the configuration of the gate driver circuit illustrated in FIG. 9 and FIG. 16 in that the shift register units (236A and 236B) in FIG. 18 includes terminals Sel (SelA and SelB) and terminals Ct (CtA and CtB). It is to be noted that portions and items unnecessary for description are omitted in the diagram. According to the configuration, the voltage Von, the voltage Voff, and the voltage Vovd are applied to the voltage outputting unit 38, and these three voltages allow the gate voltage ternary driving to be selected and performed.

Figure 19:
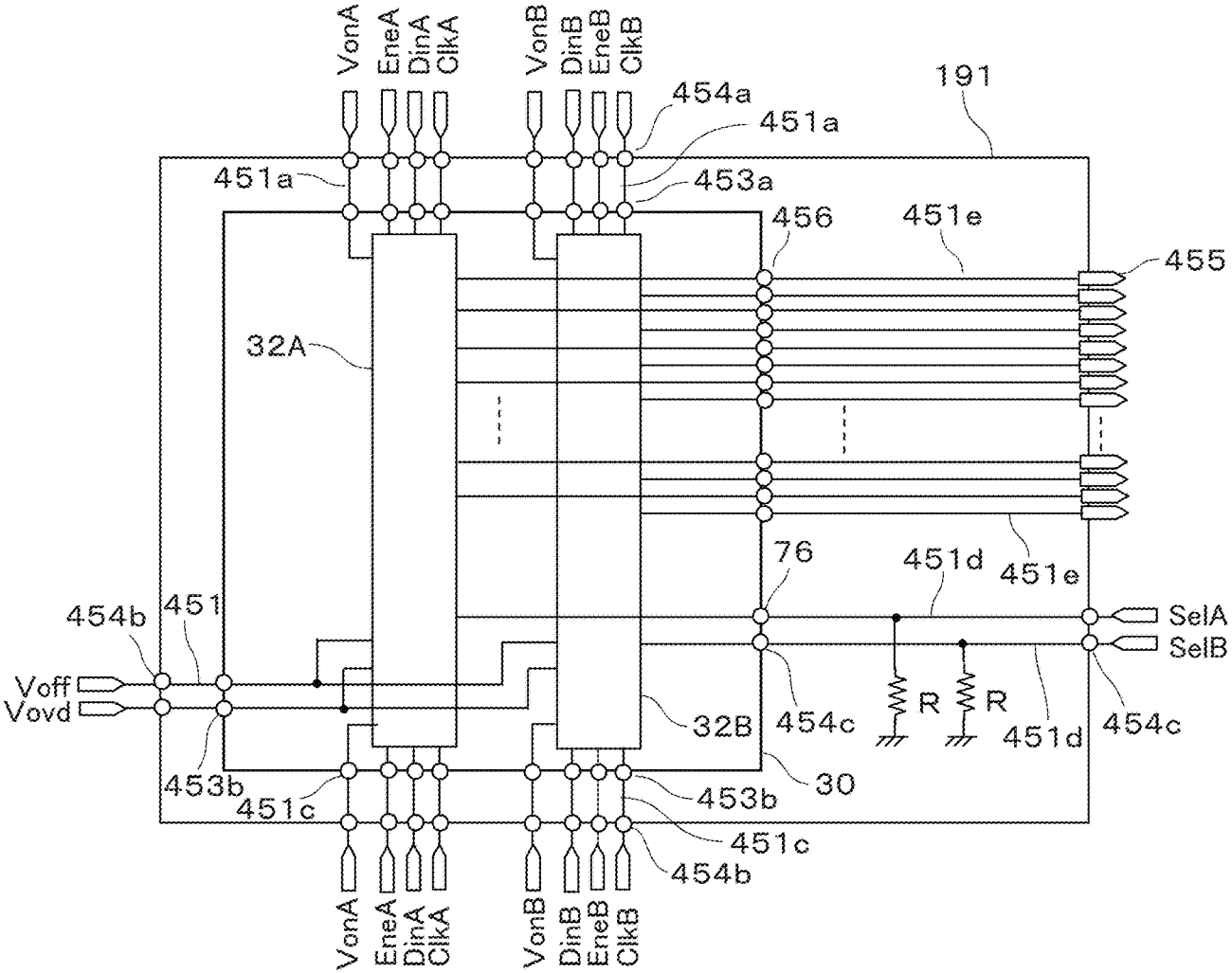
FIG. 19 is a diagram illustrating a gate driver circuit according to Embodiment 1.

FIG. 19 is a diagram schematically illustrating the state in which the gate driver integrated circuit 30 is mounted on the COF 191.

The data input terminal (DinA) which inputs data to the shift register (not illustrated), the enable input terminal (EneA) which enables (provides an ON voltage to the gate signal line) or disables (provides an OFF voltage to the gate signal line) an output of the shift register (not illustrated), and the clock input terminal (ClkA) which inputs a clock that shifts data in the shift register (not illustrated), are connected to or disposed in the gate signal line outputting circuit (gate signal line driving unit) 32*a*.

The data input terminal (DinB) which inputs data to the shift register (not illustrated), the enable input terminal (EneB) which enables (provides an ON voltage to the gate signal line) or disables (provides an OFF voltage to the gate signal line) an output of the shift register (not illustrated), and the clock input terminal (ClkB) which inputs a clock that shifts data in the shift register (not illustrated), are connected to or disposed in the gate signal line driving unit 32B.

A COF line 451 is formed on a flexible substrate (COF) 191, and each terminal is applied with a signal or a voltage from a driver input terminal 453 to the gate driver integrated circuit 30 via the COF line 451, and a signal or a voltage is applied.

An output of the gate driver integrated circuit 30 is connected to a connecting terminal 455 via a driver output terminal 456 and a COF line 451*e*. The gate signal line 22 is connected to the connecting terminal 455.

As illustrated in FIG. 19, the driver input terminals 453 (453*a* and 453*b*) is disposed at one or more positions on each longitudinal side of the chip of the driver integrated circuit. With this configuration, the effect of potential drop of a voltage is reduced, and an operation of the driver integrated circuit is not affected when one of the driver input terminals (453*a* and 453*b*) becomes disconnected.

As illustrated in FIG. 19, the terminals SEL (SelA and SelB) and the terminals Voff are disposed between the input terminals Von (VonA and VonB) and the gate output terminal 456. Each of the control terminals such as DinA, EneA, ClkA, DinB, EneB, and ClkB is formed or disposed on two ore more positions of the gate driver integrated circuit 30. It is preferable that the two or more positions may be arranged so as to be line symmetric with respect to a center line of the short side of the gate driver integrated circuit.

In an input stage of each of the control terminals such as DinA, EneA, ClkA, DinB, EneB, and ClkB, an input stage circuit such as Schmitt circuit and a hysteresis circuit is formed. In addition, the gate signal line driving unit 32 is configured so as to latch an input signal.

For example, a clock which is supplied to the connecting terminal 454*a* at ClkB is applied to the driver input terminal 453*a* via the COF line 451*a*. A noise component of a clock signal applied to the driver input terminal 453*a* is removed in the Schmitt circuit of the gate signal line driving unit 32B and the clock signal is latched by the latch circuit (not illustrated). Clock data that is latched is outputted to the driver input terminal 453*b* via a line (not illustrated) formed inside the gate signal line driving unit 32A. The clock data ClkB outputted from the driver input terminal 453*b* is outputted from the connecting terminal 454*b* via the COF line 451*c*.

It is to be noted that a COF line (not illustrated) may be formed between the driver input terminal 453*a* and the driver input terminal 453*b*. With the COF line, it is possible to stabilize transmission of control data.

A plurality of input terminals for ON voltages Von (VonA and VonB) are disposed or formed.

According to the embodiment illustrated in FIG. 19, the gate signal line driving unit 32A and the gate signal line driving unit 32B are formed or disposed on the gate driver integrated circuit 30. Selecting terminals (SelA and SelB) are connected to the gate signal line driving units 32 (32A and 32B). Two OFF voltage input terminals (Voff and Vovd) and one ON voltage input terminal (VonA for the gate signal line driving unit 32A, and VonB for the gate signal line driving unit 32B) are connected.

The terminals SEL (SelA and SelB) are pulled down. The terminals SEL are logic terminals for switching between the gate voltage ternary driving and the gate voltage binary driving.

The gate driver integrated circuit 30 outputs from the driver output terminal 456 an ON voltage and an OFF voltage to be applied to the gate signal line 22. The driver output terminal 456 and the connecting terminal 455 are electrically connected by the COF line 451*e* formed on the COF 191.

The driver input terminal 453*a* and the connecting terminal 454*a* are electrically connected by the COF line 451*e* formed on the COF 191. In addition, the driver input terminal 453*b* and the connecting terminal 454*b* are electrically connected by the COF line 451*c* formed on the COF 191.

Logic terminals such as SEL are each applied with a predetermined voltage such as a logic voltage from the connecting terminal 454*c* of a panel. The above-described voltage is applied to an operating terminal 457 of the gate driver integrated circuit 30 via a line 451*d* which is formed on the COF 191 and connects one point in the COF and a connecting terminal.

The operating terminal 457 of the gate driver integrated circuit 30 is disposed or formed: one of between the driver output terminal 456 and the driver input terminal 453*a* and or between the driver output terminal 456 and the driver input terminal 453*b*; or both of between the driver output terminal 456 and the driver input terminal 453*a* and between the driver output terminal 456 and the driver input terminal 453*b*.

It is to be noted that "high" and "low" of the logic signal may be expressed or denoted as "H" and "L", respectively, in some cases.

As illustrated in FIG. 19, a pulldown setting is applied to the terminals Sel using the resistance R, the transistor, or the like, in the COF 191 or the gate driver integrated circuit 30. This means that the terminals Sel are set at "low" by default, in other words, set as the gate voltage binary driving.

In addition, the voltage Voff is configured so that a common voltage can be applied to the gate signal line driving units 32A and 32B. Furthermore, the voltage Voff can be set by an external power supply of the COF 191 or the gate driver integrated circuit 30.

In addition, the voltage Vovd is configured so that a common voltage can be applied to the gate signal line driving units 32A and 32B. Furthermore, the voltage Vovd can be set by an external power supply of the COF 191 or the gate driver integrated circuit 30.

Figure 40:
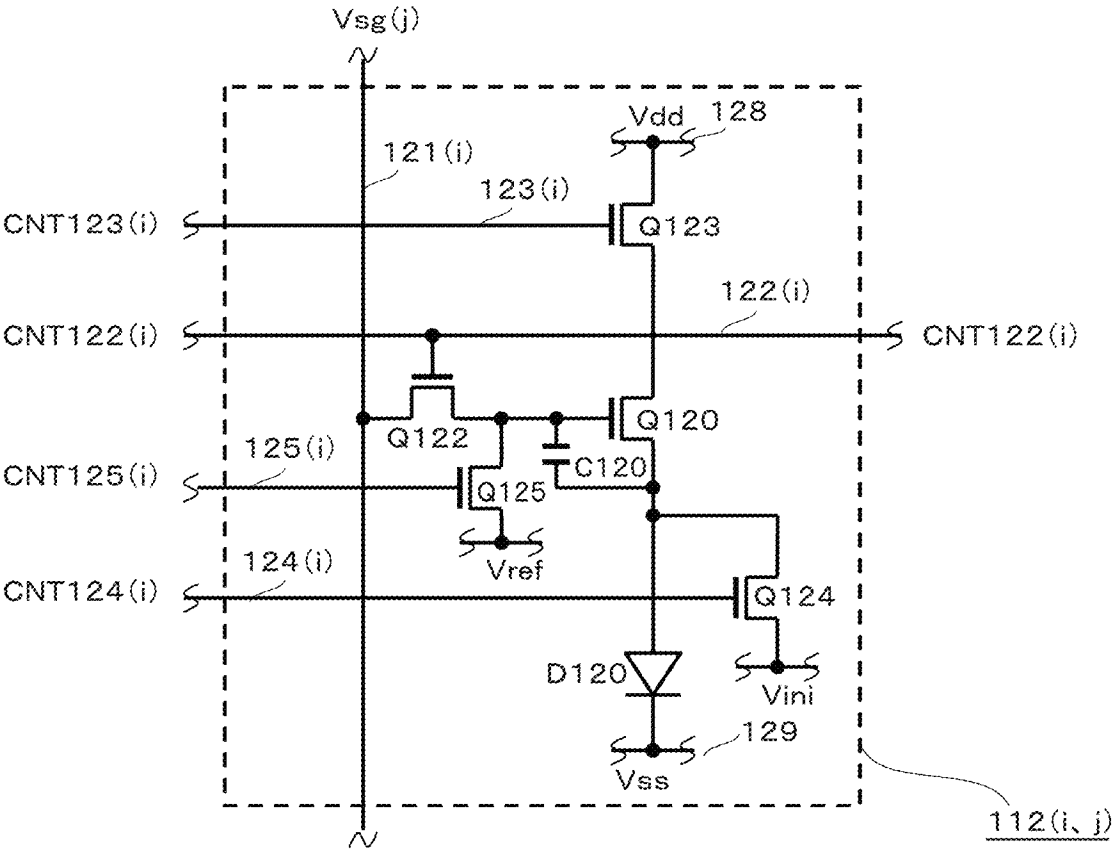
FIG. 40 is a circuit diagram illustrating a pixel circuit of an image display apparatus according to Embodiment 2.

The voltage Von is configured so that an independent voltage can be applied to the gate signal line driving units 32A and 32B (terminal VonA and terminal VonB. Furthermore, the voltage Von can be set by an external power supply of the COF 191 or the gate driver integrated circuit 30. For example, the voltage Von of the switching transistor Q123 in FIG. 40 is set higher than the voltage Von of the other transistors (when the transistors are N-channel transistors). This is because it is possible to reduce an ON resistance of the transistor Q123 and lower the Vdd voltage by setting the ON voltage of the transistor Q123 higher, and thus it is possible to reduce power for the panel.

It is to be noted that, in the configuration illustrated in FIG. 19, the gate signal line driving unit 32 includes two sets of gate signal line driving units, the gate signal line driving unit 32A and the gate signal line driving unit 32B; however, the present disclosure is not limited to this. When two gate signal lines are included in the pixel circuit 12 (FIG. 2, for example), two sets of the gate signal line driving unit 32 are employed in the gate driver integrate circuit 30. When four gate signal lines are included in the pixel circuit 12 (not illustrated), four sets of the gate signal line driving unit 32 are employed in the gate driver integrate circuit 30. More specifically, when the number of the gate signal lines in the pixel circuit 12 is m (m is an integer not less than one), m sets of the gate signal line driving unit 32 are employed in the gate driver integrated circuit 30.

Figure 20:
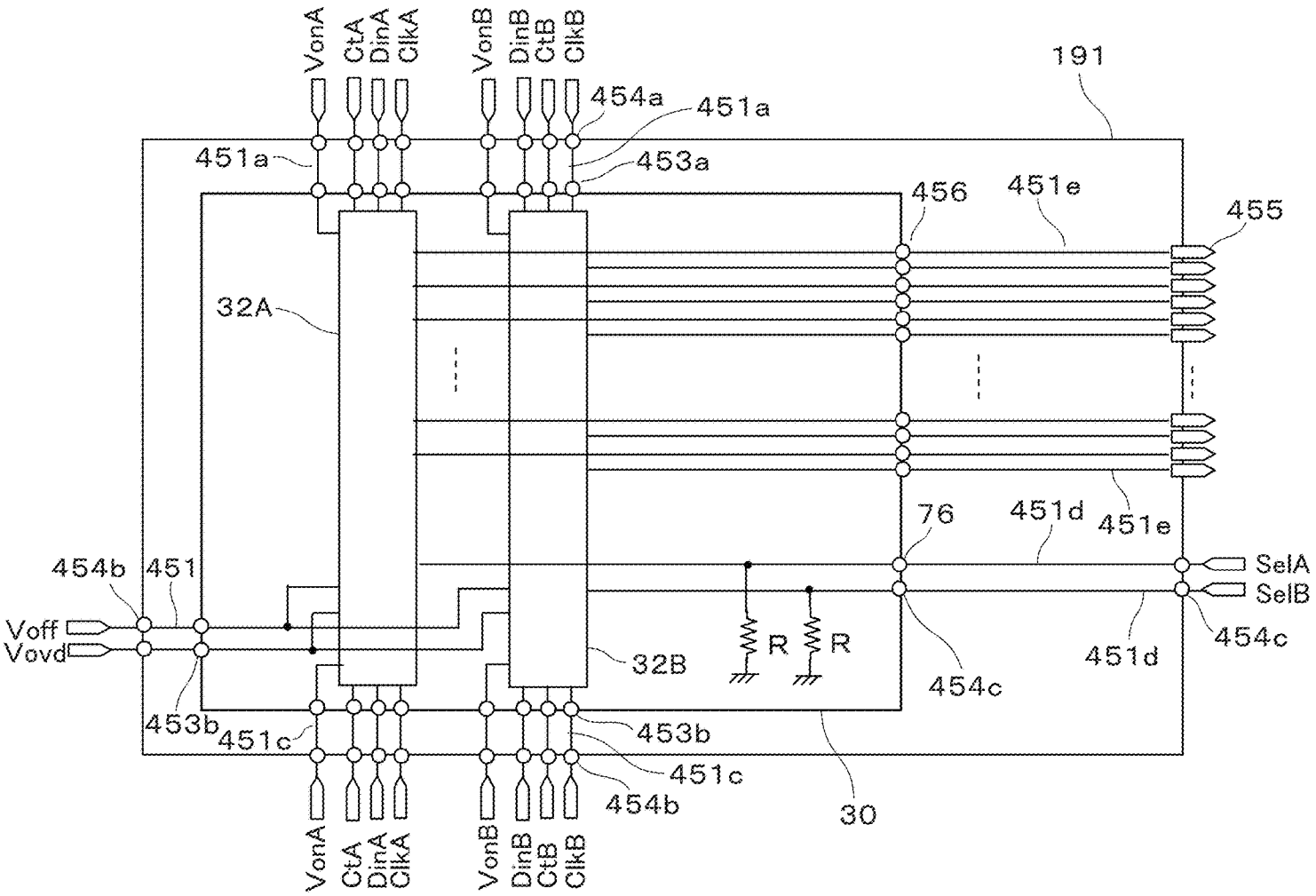
FIG. 20 is a diagram illustrating the gate driver circuit according to Embodiment 1.

FIG. 20 is a circuit diagram in which a pulldown setting is applied to the terminals Sel using the resistance R or the like in the gate driver integrated circuit 30.

It is to be noted that an image display apparatus illustrated in FIG. 20 includes a terminal Ct instead of the terminal Ene of the image display apparatus illustrated in FIG. 19. Furthermore, an image display apparatus illustrated in FIG. 21 includes a terminal Ct instead of the terminal Ene of the image display apparatus illustrated in FIG. 15. It is to be noted that the terminal Ct is explained in FIG. 18, FIG. 21, and the like.

In addition, in the image display apparatus according to the embodiments illustrated in FIG. 9, FIG. 10, FIG. 15, FIG. 16, FIG. 42, FIG. 43, FIG. 19, etc., the gate signal line driving unit 32 is controlled using the terminal Ene, and thus the clock CK of the gate driver circuit 14 needs to be different from the clock CK of the gate driver circuit 15. However, in the image display apparatus illustrated in FIG. 18, FIG. 20, FIG. 32 to FIG. 39, and FIG. 21, the gate signal line driving unit 32 is controlled using the terminal Ct, and thus the clock CK of the gate driver circuit 14 may be the same as the clock CK of the gate driver circuit 15. In addition, with the image display apparatus illustrated in FIG. 18, FIG. 20, and FIG. 21, it is possible to easily set or change the driving system of FIG. 23 to FIG. 39, by controlling or setting the terminals Ct and the terminals Sel.

The gate voltage binary driving and the gate voltage ternary driving are determined by a logic voltage applied to the selecting signal line (the terminal SelA and the terminal SelB) in FIG. 18.

As illustrated in (a) in FIG. 17, a long period of time t1 is required for changing the voltage Von to the voltage Voff with the gate voltage binary driving. When t1 is long, a video signal written on a pixel might leak during this period, and crosstalk might occur between pixels adjacent above or below.

By executing the gate voltage ternary driving illustrated in (b) in FIG. 17, the period of time taken for changing the voltage Von to the voltage Voff is reduced to t2 as in the diagram. Accordingly, leakage of a video signal written on a pixel or crosstalk between pixels adjacent above or below does not occur.

With the gate voltage ternary driving, after an application period of the voltage Von, the voltage Vovd is applied during a period of 1H or during a period shorter than 1H. It is to be noted that the period of 1H is one horizontal scanning period or a selecting period for one pixel row.

Subsequent to the application period of the voltage Vovd, the voltage Voff is applied to the gate signal line 22(*i*) corresponding to the selected pixel row, and the gate signal line 22(*i*) is kept at the voltage Voff during a period before the voltage Von is applied in the next frame period.

It is to be noted that the gate voltage binary driving and the gate voltage ternary driving are each set by a logic signal applied to the terminals Sel (Sel1 and Sel2). When the logic voltages applied to the terminals Sel are set at "L", the driving mode is set as the gate voltage binary driving. When the logic voltages applied to the terminals Sel are set at "H", the driving mode is set as the gate voltage ternary driving.

It is preferable that the period during which the voltage Vovd is applied is set as the period of 1H or during a period shorter than 1H.

The period during which the voltage Von is applied is set as nth of the period of 1H (N is an integer not less than one) and at least the period of 1H, and the value of n is variable.

Figure 22:
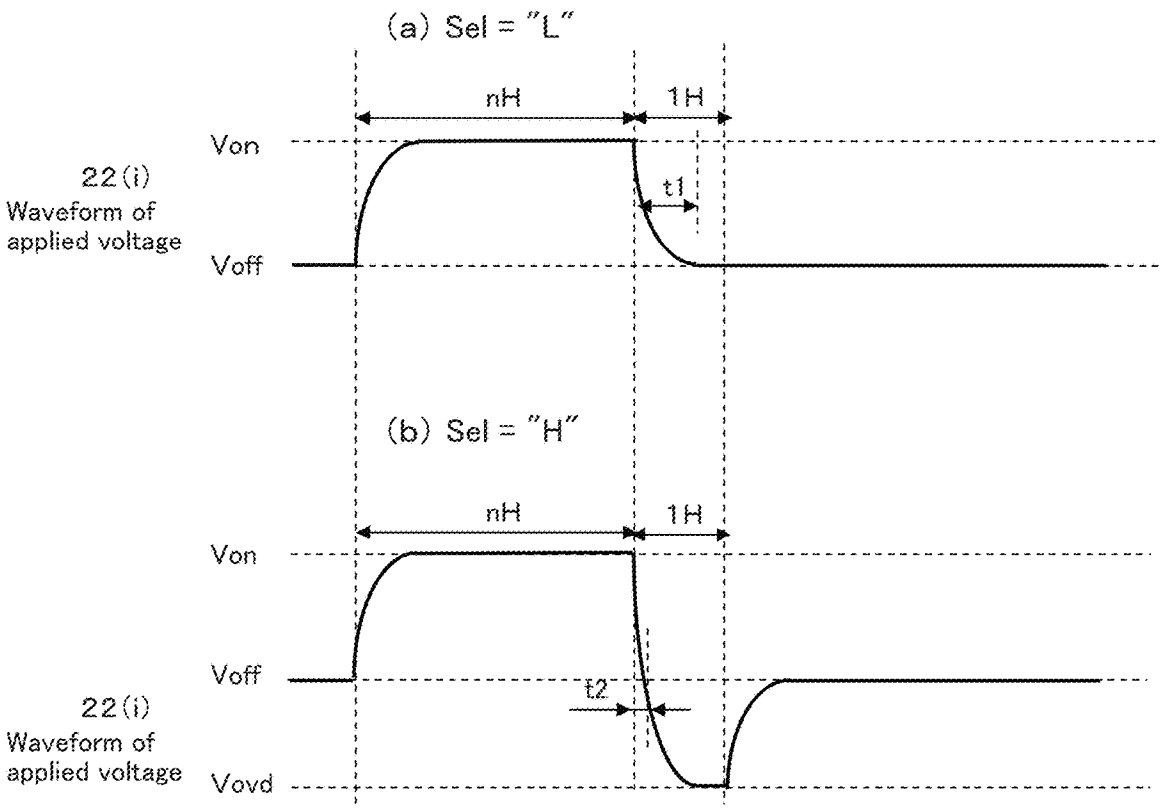
FIG. 22 is an output waveform diagram of the gate driver integrated circuit according to Embodiment 1.

FIG. 17 illustrates the case where the transistor Q is a P-channel (P polarity) transistor. FIG. 22 is a waveform diagram of the gate voltage binary driving ((a) in FIG. 22) and the gate voltage ternary driving ((b) in FIG. 22) in the case where the transistor Q is an N-channel (N polarity) transistor. The polarity of voltage waveforms is reversed between the case where the transistor Q is the N-channel transistor as in FIG. 22 and the case where the transistor Q is the P-channel transistor as in FIG. 17.

It is to be noted that the gate driving circuit (gate driver circuit) according to the present disclosure is adapted to the polarity of the switching transistor included in the pixel circuit so as to correspond to both of the driving system in FIG. 17 and the driving system in FIG. 22. Switch between FIG. 17 and FIG. 22 is performed by changing the voltage logic selected by the voltage outputting unit 38 of the gate driver circuit 14.

The transistor Q included in the pixel circuit according to the present disclosure may either be the P-channel transistor or be the N-channel transistor. Application of the gate voltage binary driving or the gate voltage ternary driving to the gate signal lines is carried out so as to correspond to the polarity of the transistor Q. The gate voltage ternary driving is selected by setting the terminals Sel at "high", and the gate voltage binary driving is selected by setting the terminals Sel at "low" or "open".

Figure 23:
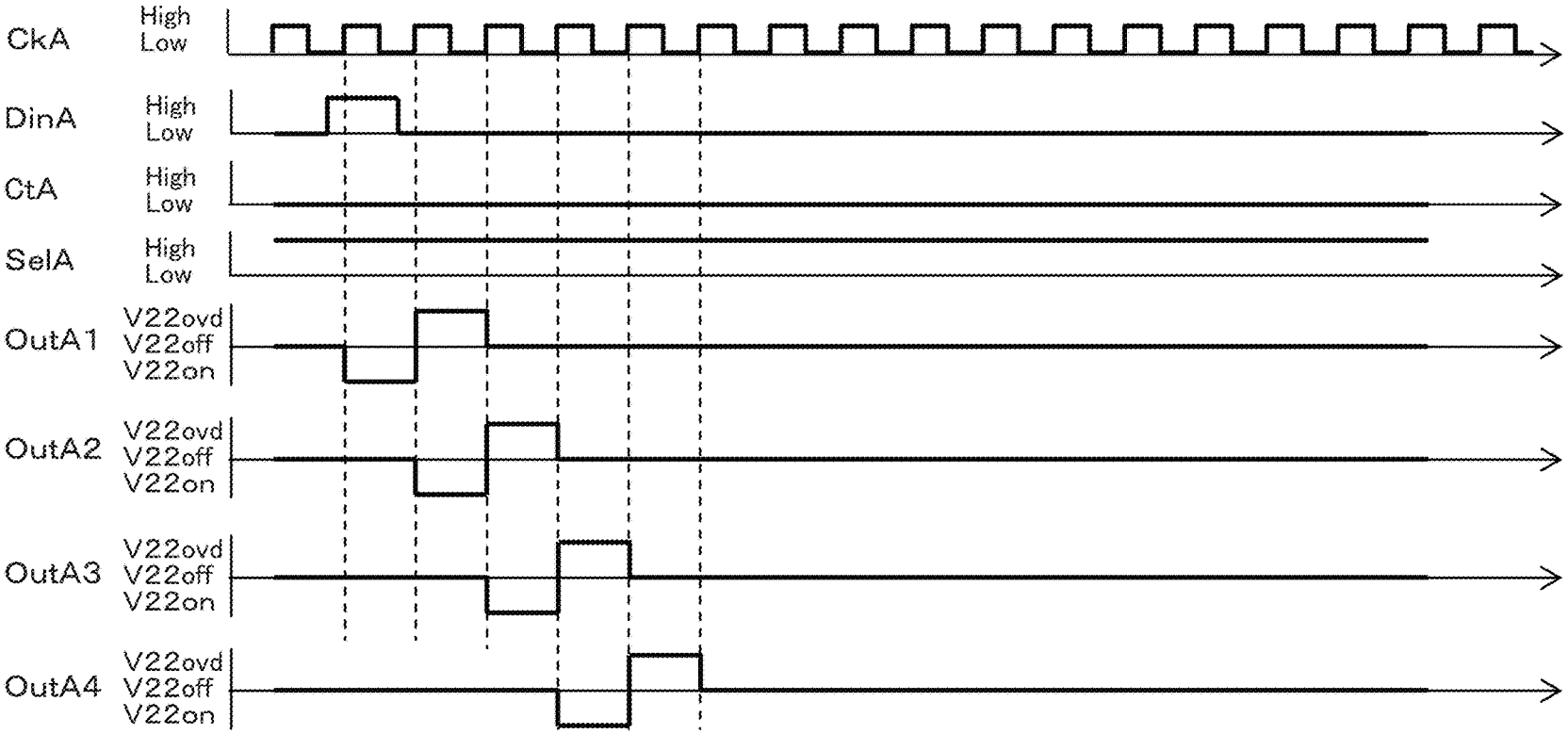
FIG. 23 is a timing chart illustrating an operation of the gate driver circuit according to Embodiment 1.

FIG. 23 is a timing chart illustrating an operation in the case of the gate voltage ternary driving. An output waveform of the terminal OutA is illustrated as an example. The terminal SelA is set at the level H. Accordingly, the gate voltage ternary driving is carried out. The voltage V22on is outputted to the terminal OutA1 by latching an input of data DinA by CkA. To the terminal OutA1, the voltage V22on is outputted during the period of 1H (the selecting period for one pixel row), and the voltage V22ovd is outputted during the next period of 1H. After the end of the next period of 1H, the voltage V22off is outputted, and the corresponding gate signal line is kept at the voltage V22off until the next selecting period after one frame or one field.

The terminals CtA (see FIG. 18, FIG. 20, and FIG. 56) are set at "low". The setting of the terminals Ct at "low" is an operation performed by the first gate driver circuit 14 illustrated in FIG. 1, and a data position (selected position) is shifted such that the shift register unit 36A of the first gate driver circuit 14 sequentially selects one pixel row at a time.

The voltage V22on is outputted to the terminal OutA2 with a delay of the period of 1H (a selecting period for one pixel row) with respect to the terminal OutA1. The voltage V22ovd is outputted during the next period of 1H. After the end of the next period of 1H, the voltage V22off is outputted, and the corresponding gate signal line is kept at the voltage V22off until the next selecting period.

In the same manner as above, the voltage V22on is outputted to the terminal OutA3 with a delay of the period of 1H (the selecting period for one pixel row) with respect to the terminal OutA2. The voltage V22ovd is outputted during the next period of 1H. After the end of the next period of 1H, the voltage V22off is outputted, and the corresponding gate signal line is kept at the voltage V22off until the next selecting period for one pixel row. The operation described above is performed to each of the terminals OutA.

The voltage Vovd is outputted during the period of 1H without depending on the application period of the voltage Von. The charge of the capacitance between the gate and the source or the charge of the capacitance between the gate and drain can be discharged in a short amount of time by applying the gate electrode of the transistor Q with the over-drive voltage Vovd when switching the transistor Q from the ON state to the OFF state as described above, and thus it is possible to quickly set the transistor Q to be in the OFF state. With this, a change in an image signal voltage or crosstalk between pixel circuits can be suppressed, and thus it is possible to further suppress luminance gradient, display unevenness, etc.

The reason why the voltage is set again to the Voff after applying the over-drive voltage Vovd for the period of 1H in the gate voltage ternary driving is to prevent a change in the characteristics of the transistor Q due to an excessive application of the over-drive voltage Vovd for a long period of time to the gate electrode of the transistor Q.

The gate signal line 22(*i*) is applied with the bilateral driving, and the switching transistor Q22 receives the OFF control at high-speed slew rate.

Figure 24:
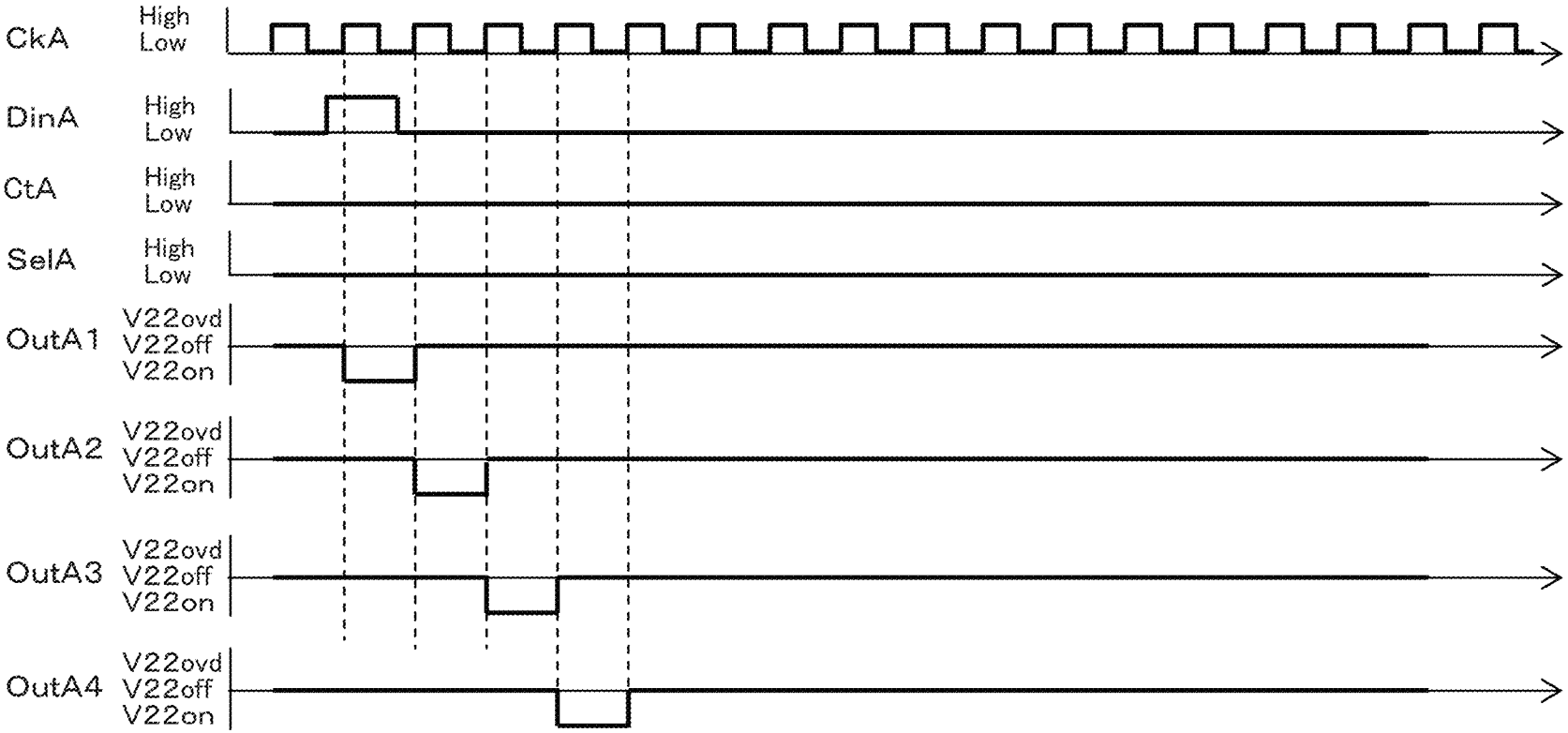
FIG. 24 is a timing chart illustrating an operation of the gate driver circuit according to Embodiment 1.

FIG. 24 is a timing chart illustrating an operation in the case of the gate voltage binary driving. The terminal SelA is set at the level L. The voltage V22on is outputted to the terminal OutA1 by latching an input of DinA data by CkA. The voltage V22on is outputted during the period of 1H and the voltage V22off is outputted during the next period of 1H to the terminal OutA1, and the corresponding gate signal line is kept at the voltage V22off until the next selecting period.

The voltage V22on is outputted to the terminal OutA2 with a delay of the period of 1H (the selecting period for one pixel row) with respect to the terminal OutA1. After the end of the next period of 1H, the voltage V22off is outputted, and the corresponding gate signal line is kept at the voltage V22off until the next selecting period.

In the same manner as above, the voltage V22on is outputted to the terminal OutA3 with a delay of the period of 1H (the selecting period for one pixel row) with respect to the terminal OutA2. After the end of the next period of 1H, the voltage V22off is outputted, and the corresponding gate signal line is kept at the voltage V22off until the next selecting period. The operation described above is performed to each of the terminals OutA.

The gate voltage ternary driving is applied to the gate signal lines which require high slew rate driving or which are applied with the bilateral driving. For example, the gate voltage ternary driving is applied to the gate signal line 22(*i*) in FIG. 2, the gate signal lines 122(*i*) and 123(*i*) in FIG. 40, and the gate signal line 122(*i*) in FIG. 47. The gate voltage binary driving is applied to the gate signal lines which do not require relatively high slew rate driving or which are applied with the unilateral driving.

Figure 25:
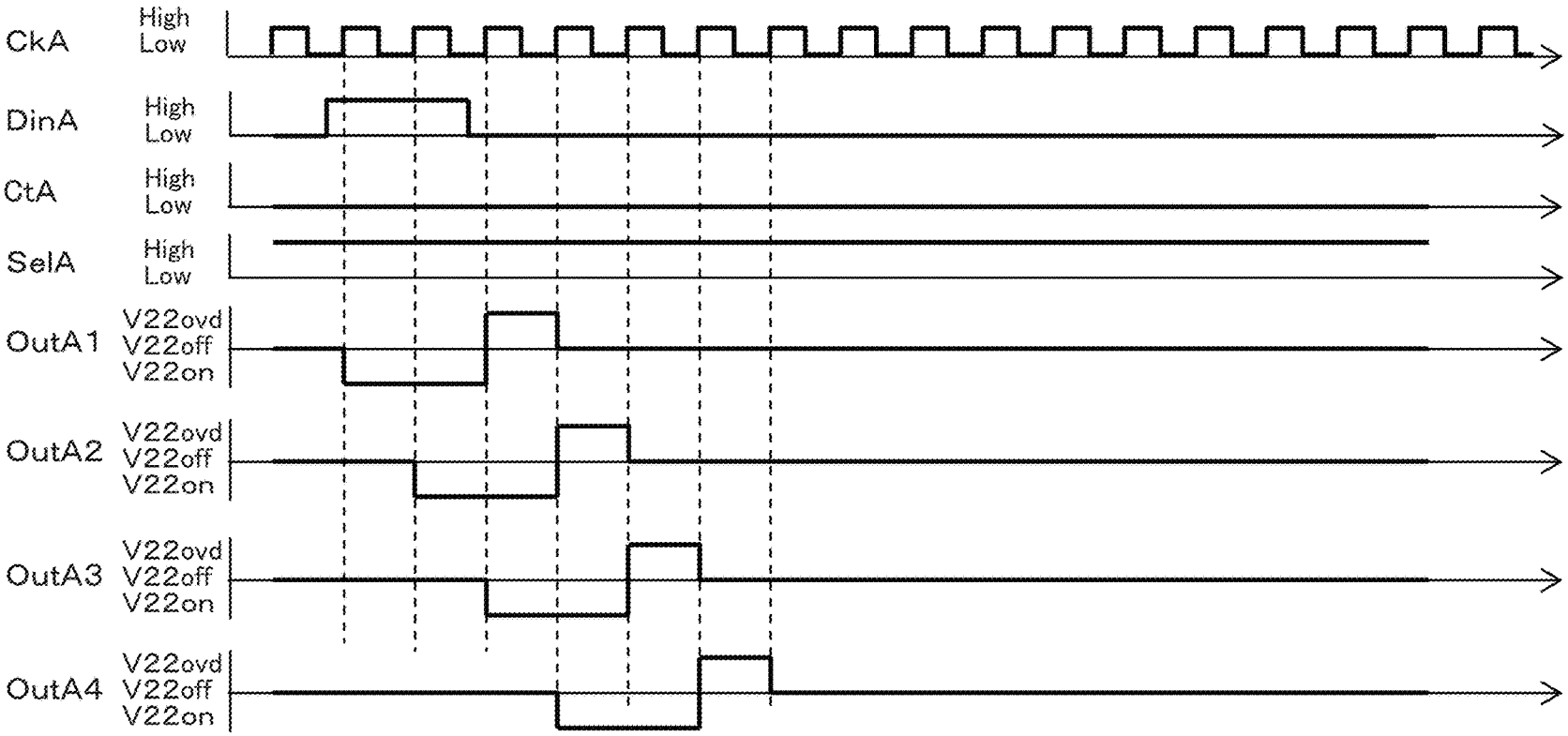
FIG. 25 is a timing chart illustrating an operation of the gate driver circuit according to Embodiment 1.

FIG. 25 is a timing chart illustrating an operation of a driving method in which the period to apply the voltage Von is 2H (the selecting period for two rows). Compared with FIG. 23, the DinA period is a period of 2H, and CkA is supplied twice during a period in which the DinA period is "high (H)".

The terminal SelA is set at the level H. The voltage V22on is outputted to the terminal OutA1 during the period of 2H by latching an input of the DinA data by CkA. The voltage V22ovd is outputted during the next period of 1H.

In the gate voltage ternary driving, the period during which the voltage Von is outputted is set as nH (N is an integer not less than one). The period during which the voltage Vovd is applied to the gate signal line is set as the 1H period also in the case where n is not less than two. The reason why the voltage Vovd is applied after application of the voltage Von is to reduce the period during which the transistor Q is OFF, by changing the application from the voltage Von to the voltage Vovd (FIG. 17 and FIG. 22). The voltage Vovd may be applied for longer than or equal to the period of 2H; however, there are instances where off-leakage occurs in the transistor Q due to the application of the voltage Vovd for a long period of time. After the application of the voltage Vovd, the voltage V22off is applied to the corresponding gate signal line and the state is kept until the next selecting period.

In FIG. 25, the voltage V22on is outputted to the terminal OutA1 during the period of 2H. The voltage V22off is outputted during the period of 1H after the application period of the voltage V22on. After the period of the voltage V22ovd, the voltage V22off is applied to the corresponding gate signal line and the state is kept until the next selecting period.

The voltage V22on is outputted during the period of 2H to the terminal OutA2 with a delay of the period of 1H (the selecting period for one pixel row) with respect to the terminal OutA1. The voltage V22off is outputted during the period of 1H after the application period of the voltage V22on. After the period of the voltage V22ovd, the voltage V22off is applied to the corresponding gate signal line and the state is kept until the next selecting period.

The voltage V22on is outputted during the period of 2H to the terminal OutA3 with a delay of the period of 1H (the selecting period for one pixel row) with respect to the terminal OutA2. The voltage V22off is outputted during the period of 1H after the application period of the voltage V22on. After the period of the voltage V22ovd, the voltage V22off is applied to the corresponding gate signal line and the state is kept until the next selecting period.

In the same manner as above, the voltage Von, the voltage Vovd, and the voltage Voff are sequentially applied to the terminal OutA4.

As described above, according to the present disclosure, it is possible to select between or set the gate voltage ternary driving and the gate voltage binary driving by a logic signal applied to the terminals Sel. It is to be noted that although the terminal SelA is illustrated in the description in the exemplary embodiment, it is not limited to this, and the same description applies to the terminal SelB as well. The terminal Sel is disposed in each of the gate driver circuits formed in the gate driver circuit, and it is possible to set the gate voltage ternary driving and the gate voltage binary driving separately by a logic signal (logic level) applied to the terminal Sel.

In addition, the gate voltage ternary driving is applied when the terminal Sel is at the level H (high) and the gate voltage binary driving is applied when the terminal Sel is at the level L (low) according to the present embodiment; however the present embodiment is not limited to these settings. For example, the gate voltage ternary driving may be applied when the terminal Sel is at the level L (low) and the gate voltage binary driving may be applied when the terminal Sel is at the level H (high). In addition, the terminal Sel may be an open collector terminal. In addition, it is preferable that the pulldown setting is applied to the terminal Sel inside the driver (semiconductor IC) and the gate voltage binary driving is set by default.

According to the present disclosure, the voltage Von, the voltage Voff, and the voltage Vovd can be set independently for each of the gate signal line driving units. For example, the voltage Von can be set to be different between the voltage Von of the voltage outputting unit 238A and the voltage Von of the voltage outputting unit 238B. Likewise, the voltage Voff can be set to be different between the voltage Voff of the voltage outputting unit 238A and the voltage Voff of the voltage outputting unit 238B.

In addition, the voltage Vovd can be set to be different between the voltage Vovd of the voltage outputting unit 238A and the voltage Vovd of the voltage outputting unit 238B. However, it is preferable that the voltage Vovd is set commonly in a plurality of voltage outputting units. The reason for this is that the voltage Vovd is a voltage for turning OFF the transistor Q at high speed, and thus setting the voltage Vovd independently in each of the voltage outputting units produces little advantageous effect. It is possible to reduce the number of connecting lines to be set, by setting the common voltage Vovd between the voltage outputting units.

It should be understood that the above-described explanation is applied to other embodiments of the present disclosure as well.

Figure 26:
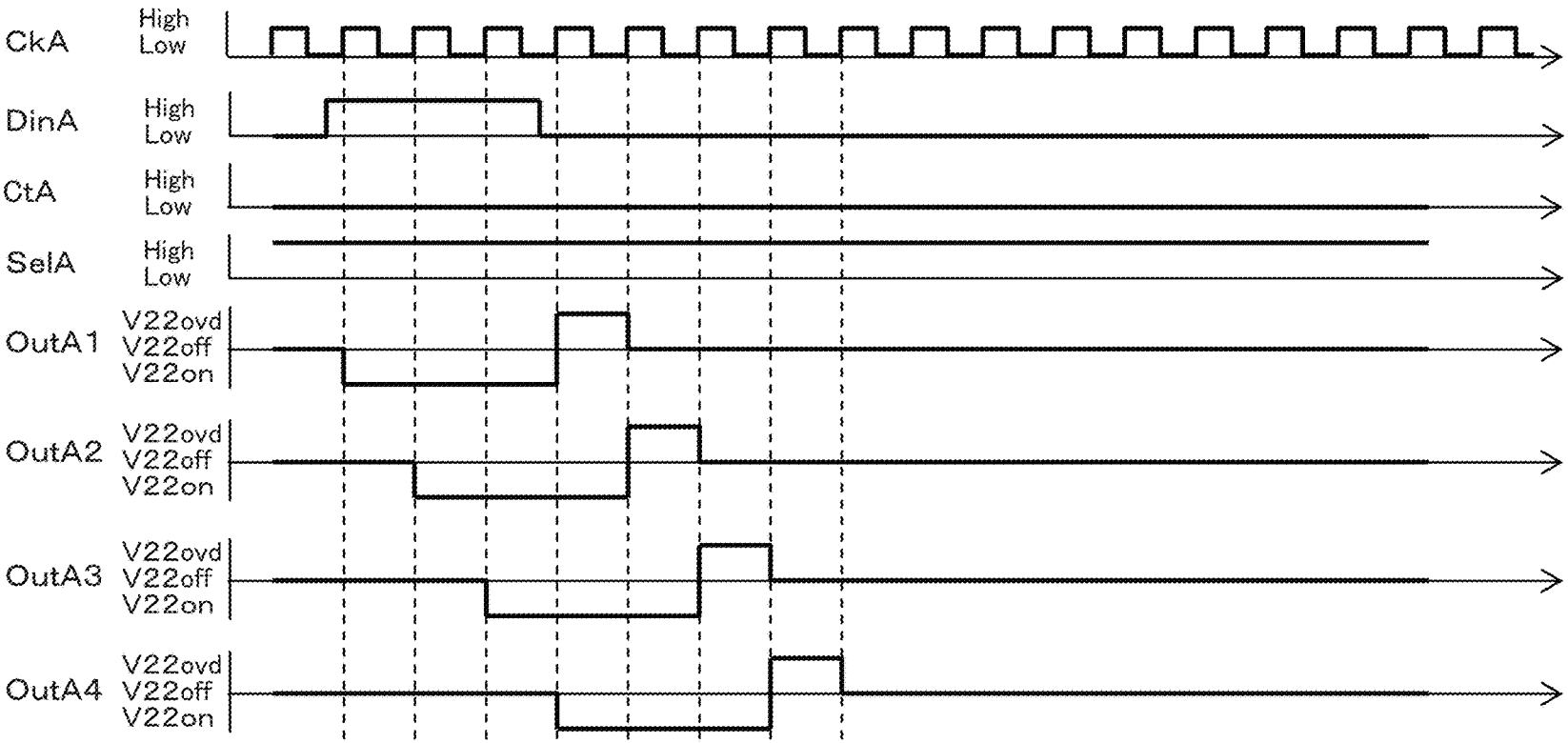
FIG. 26 is a timing chart illustrating an operation of the gate driver circuit according to Embodiment 1.

FIG. 26 is a timing chart illustrating an operation in the case where the period of applying the ON voltage Von is 3H (when nH is three), and the terminal SelA is set at the level H. The voltage V22on is outputted to the terminal OutA1 during the period of 3H (the selecting period for three pixel rows). The voltage V22off is outputted during the period of 1H after the application period of the voltage V22on. The voltage V22off is applied to the corresponding gate signal line and the state is kept until the next selecting period after the application period of the voltage V22ovd.

The voltage V22on is outputted during the period of 3H to the terminal OutA2 with a delay of the period of 1H (the selecting period for one pixel row) with respect to the terminal OutA1. The voltage V22off is outputted during the period of 1H after the application period of the voltage V22on. The voltage V22off is applied to the corresponding gate signal line and the state is kept until the next selecting period after the period of the voltage V22ovd.

The voltage V22on is outputted during the period of 3H to the terminal OutA3 with a delay of the period of 1H (the selecting period for one pixel row) with respect to the terminal OutA2. The voltage V22off is outputted during the period of 1H after the application period of the voltage V22on. The voltage V22off is applied to the corresponding gate signal line and the state is kept until the next selecting period after the period of the voltage V22ovd.

In the same manner as above, the voltage Von, the voltage Vovd, and the voltage Voff are sequentially applied to the terminal OutA4.

Figure 27:
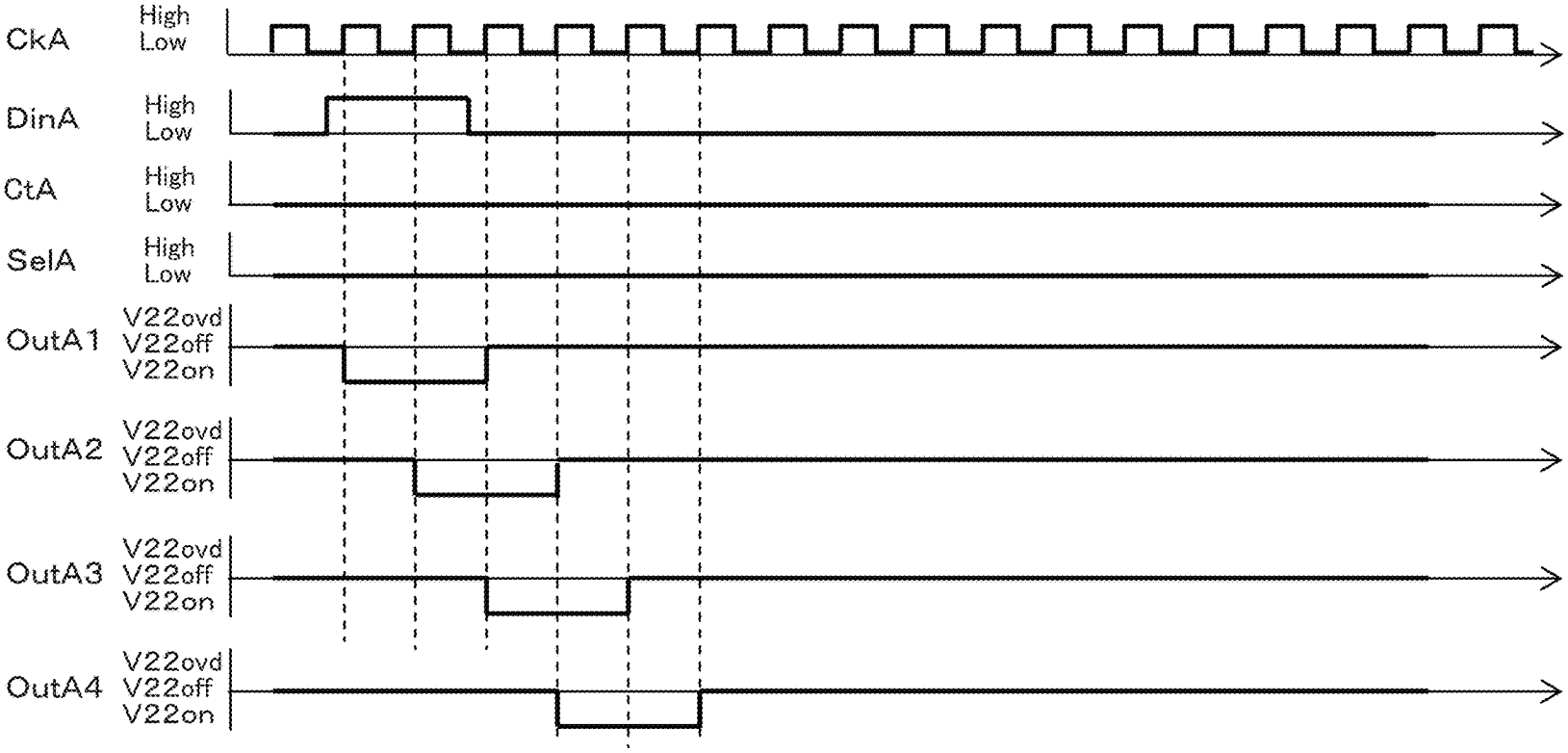
FIG. 27 is a timing chart illustrating an operation of the gate driver circuit according to Embodiment 1.

FIG. 27 is a timing chart illustrating an operation in the case where the terminal Sel is set at the level L (low level) and n=2. More specifically, FIG. 27 is a timing chart illustrating an operation in the case where the gate voltage binary driving is applied, and the application period of the voltage Von is 2H (the selecting period for two pixel rows).

In FIG. 27, the voltage V22on is outputted to the terminal OutA1 during the period of 2H. The voltage V22off is applied to the corresponding gate signal line and the state is kept until the next selecting period after the application period of the voltage V22on.

The voltage V22on is outputted during the period of 2H to the terminal OutA2 with a delay of the period of 1H (the selecting period for one pixel row) with respect to the terminal OutA1. The voltage V22off is applied to the corresponding gate signal line and the state is kept until the next selecting period after the application period of the voltage V22on.

The voltage V22on is outputted during the period of 2H to the terminal OutA3 with a delay of the period of 1H (the selecting period for one pixel row) with respect to the terminal OutA2. The voltage V22off is applied to the corresponding gate signal line and the state is kept until the next selecting period after the application period of the voltage V22on.

In the same manner as above, the voltage Von and the voltage Voff are sequentially applied to the terminal OutA4.

FIG. 23, FIG. 24, FIG. 25, FIG. 27, and FIG. 26 are each a timing chart illustrating an operation in the case where the transistor Q is a P-channel (P polarity) transistor. FIG. 28, FIG. 29, FIG. 30, and FIG. 31 are each a timing chart illustrating an operation in the case where the transistor Q is an N-channel (N polarity) transistor.

Figure 28:
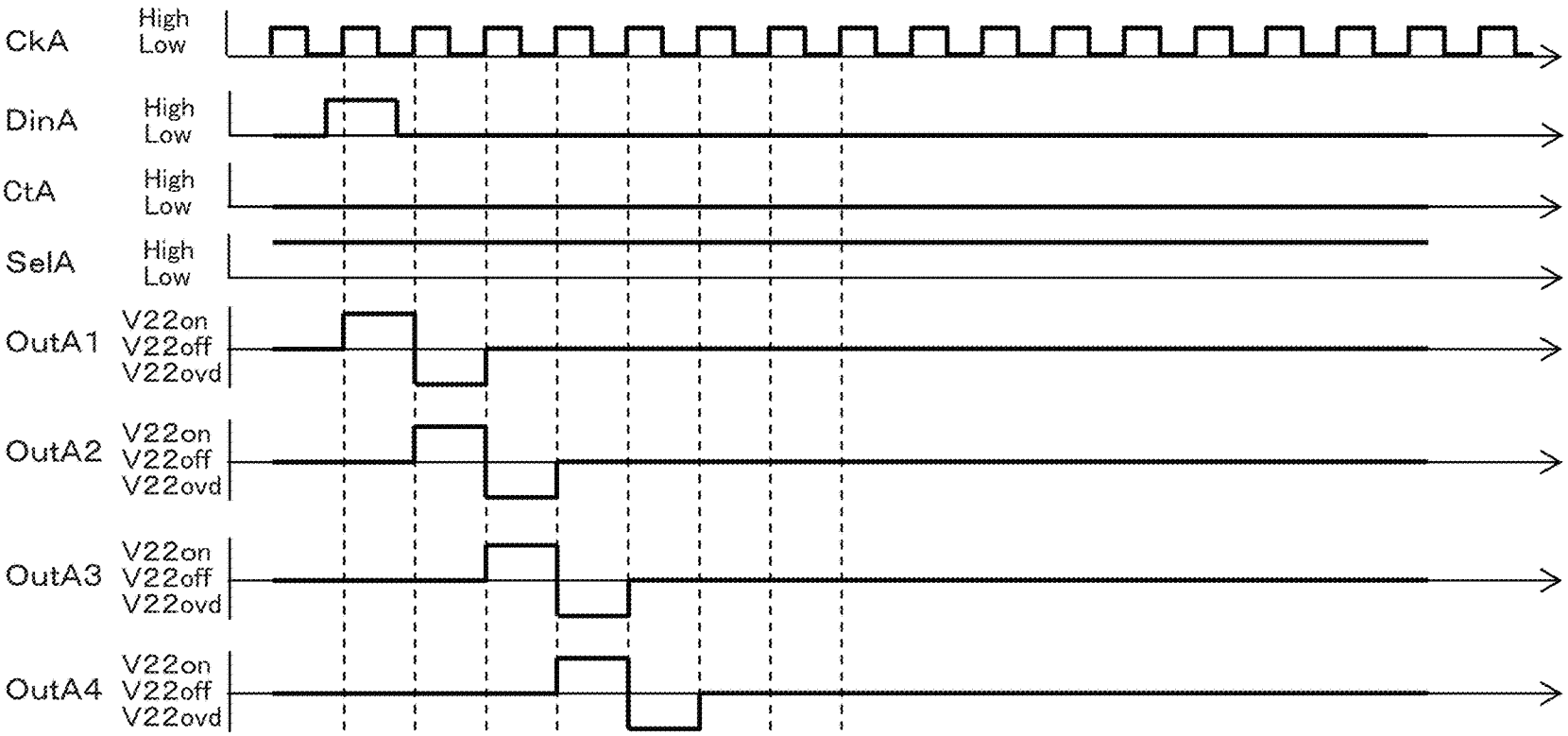
FIG. 28 is a timing chart illustrating an operation of the gate driver circuit according to Embodiment 1.

FIG. 23 is a timing chart of the case where the transistor Q is a P-channel transistor and the terminal Sel is set at the level H (gate voltage ternary driving). FIG. 28 is a timing chart of the case where the transistor Q is an N-channel transistor and the terminal Sel is set at the level H (gate voltage ternary driving). Description for the operation will be omitted because only the potential levels of the voltage Von, the voltage Voff, and the voltage Vovd are different.

Figure 29:
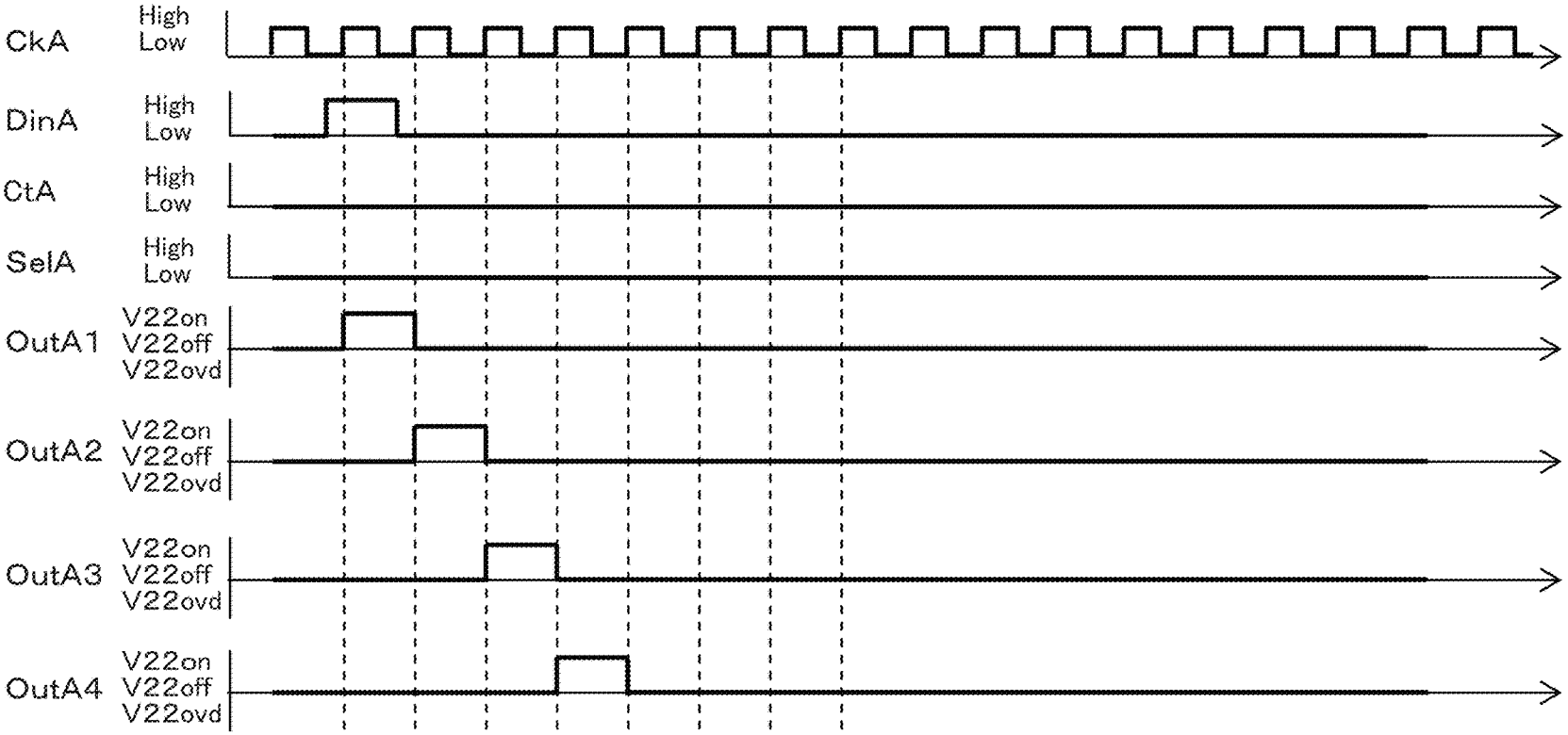
FIG. 29 is a timing chart illustrating an operation of the gate driver circuit according to Embodiment 1.

FIG. 24 is a timing chart of the case where the transistor Q is a P-channel transistor, the terminal Sel is set at the level L (gate voltage binary driving), and n=1. FIG. 29 is a timing chart of the case where the transistor Q is an N-channel transistor and the terminal Sel is set at the level L (gate voltage binary driving). Description for the operation will be omitted because only the potential levels of the voltage Von, the voltage Voff, and the voltage Vovd are different from those in FIG. 24.

Figure 30:
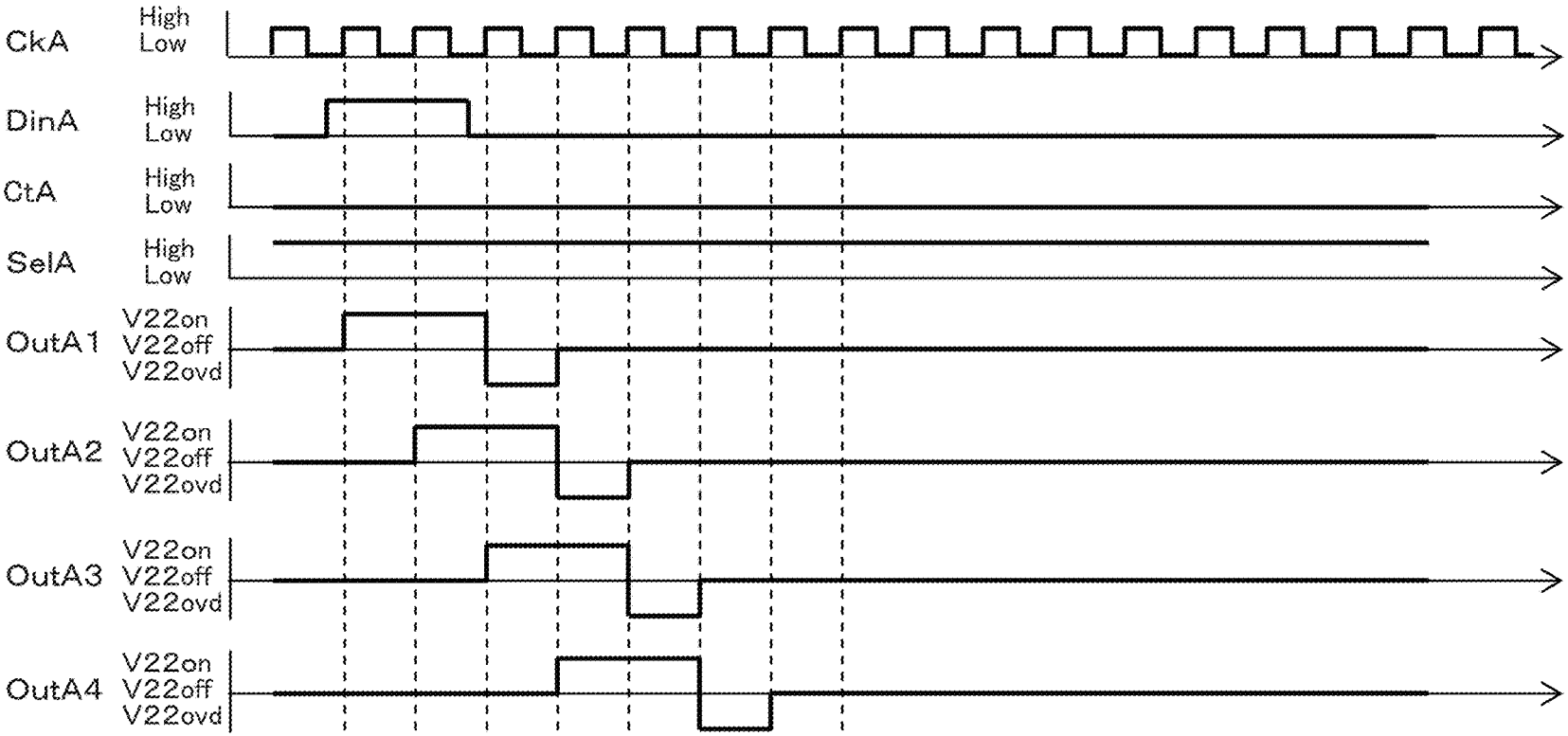
FIG. 30 is a timing chart illustrating an operation of the gate driver circuit according to Embodiment 1.

FIG. 25 is a timing chart of the case where the transistor Q is a P-channel transistor, the terminal Sel is set at the level H (gate voltage ternary driving), and n=2. FIG. 30 is a timing chart of the case where the transistor Q is an N-channel transistor, the terminal Sel is set at the level H (gate voltage ternary driving), and n=2. Description for the operation will be omitted because only the potential levels of the voltage Von, the voltage Voff, and the voltage Vovd are different from those in FIG. 25.

Figure 31:
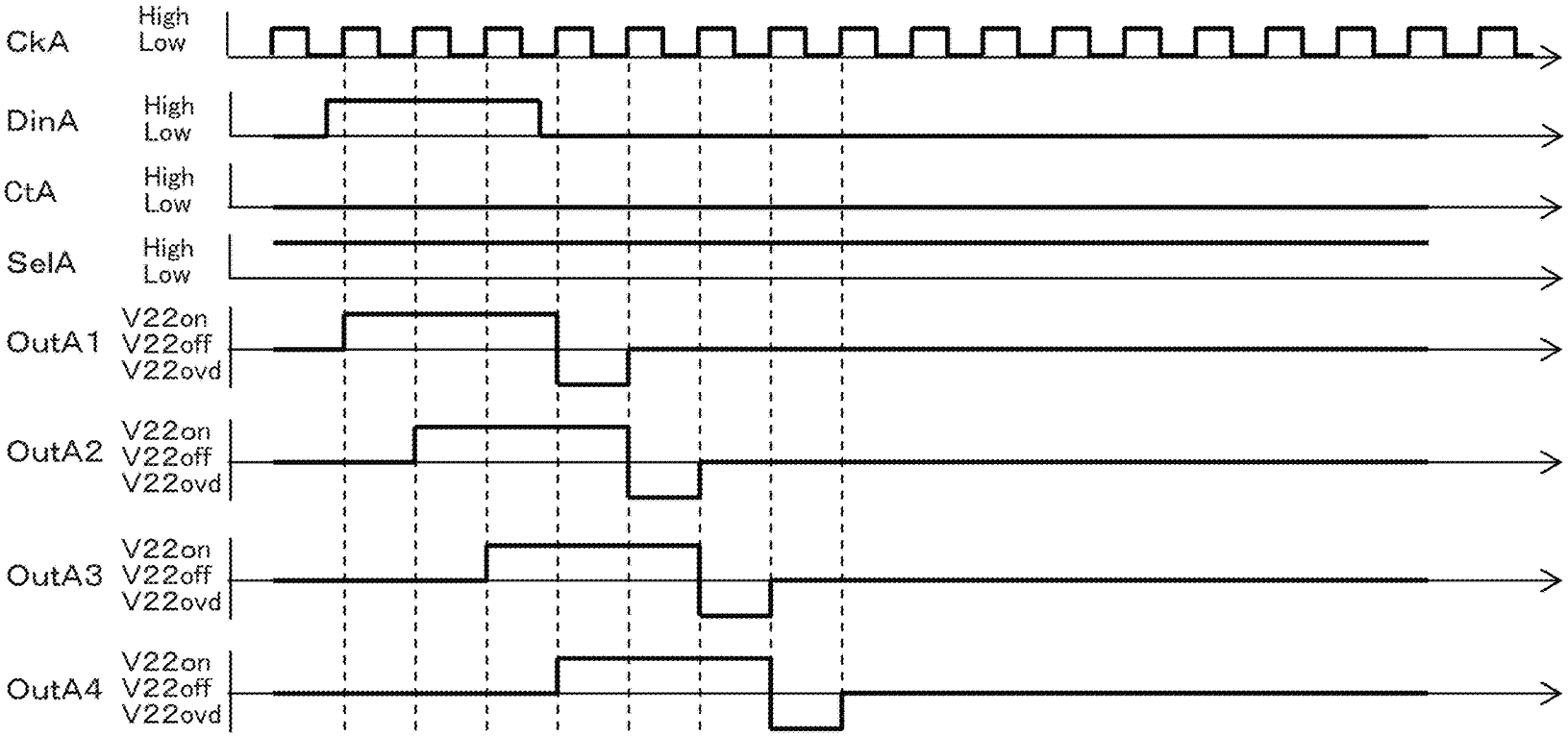
FIG. 31 is a timing chart illustrating an operation of the gate driver circuit according to Embodiment 1.

FIG. 26 is a timing chart of the case where the transistor Q is a P-channel transistor, the terminal Sel is set at the level H (gate voltage ternary driving), and n=3. FIG. 31 is a timing chart of the case where the transistor Q is an N-channel transistor, the terminal Sel is set at the level H (gate voltage ternary driving), and n=3. Description for the operation will be omitted because only the potential levels of the voltage Von, the voltage Voff, and the voltage Vovd are different from those in FIG. 26.

It should be understood that the above-described explanation is applied to other embodiments of the present disclosure as well.

FIG. 18 is a circuit diagram of the gate driver circuit according to the present disclosure which has a configuration partly changed from the configuration illustrated in FIG. 9 and FIG. 16. It is to be noted that portions and items unnecessary for description are omitted.

In FIG. 13 and FIG. 14 which are examples of the operation timing chart corresponding to FIG. 9, FIG. 10, FIG. 15, and FIG. 16, the terminal OutA and the terminal OutB are outputted to the gate signal line with a delay of the period of 1H. Accordingly, when the terminal OutA selects the gate signal line 22 of an odd-numbered pixel row, the terminal OutB selects the gate signal line 22 of an even-numbered pixel row.

For example, In FIG. 10, the gate signal line driving unit 32A of the gate driver circuit 15 sequentially selects the gate signal lines 22(*i*) which are odd-numbered pixel rows, and the gate signal line driving unit 32B of the gate driver circuit 15 sequentially selects the gate signal lines 22(*i*) which are even-numbered pixel rows. More specifically, the terminal OutA which is an output of the gate signal line driving unit 32A of the gate driver circuit 15 is connected to an odd-numbered pixel row, and performs ON or OFF control by selecting a transistor in an odd-numbered pixel row. The terminal OutB which is an output of the gate signal line driving unit 32B of the gate driver circuit 15 is connected to an even-numbered pixel row, and performs ON or OFF control by selecting a transistor in an even-numbered pixel row.

According to the exemplary embodiment illustrated in FIG. 13 and FIG. 14, selecting of the OutA and the OutB is implemented by control of the terminals Ene (terminal EneA and terminal EneB).

FIG. 18 illustrates an exemplary embodiment in which the gate driving circuit according to the present disclosure includes terminals Ct (terminal CtA and terminal CtB) formed or disposed instead of the terminals Ene or the like. As illustrated in the timing charts in FIG. 13 and FIG. 14, control on terminals Out (OutA and OutB) selected by the gate signal line driving unit is changed by a logic signal to the terminals Ct.

The logic circuit that selects every other pixel row illustrated in FIG. 13 and FIG. 14 can be easily configured using terminals Ct (CtA and CtB), and thus description for the configuration of the logic circuit will be omitted in the Description.

Figure 32:
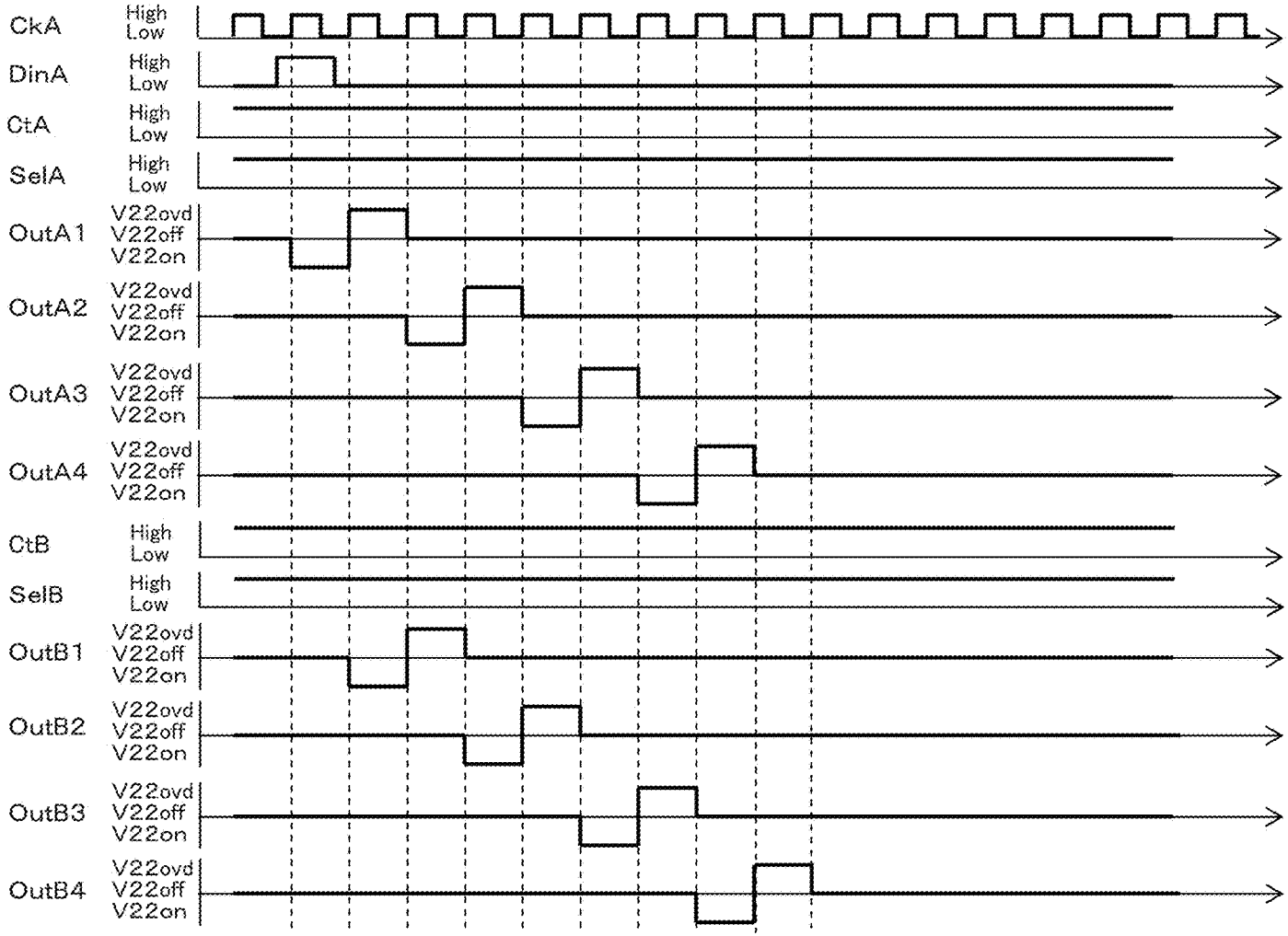
FIG. 32 is a timing chart illustrating an operation of the gate driver circuit according to Embodiment 1.

FIG. 32 is a timing chart of the case where the terminal CtA is set at the level H (high level) in the gate signal line driving unit illustrated in FIG. 18. The terminal SelA is set at the level H, and the gate voltage ternary driving is employed. In addition, the terminal CtA is set at the level H. Furthermore, n=1, and the transistor Q is a P-channel transistor.

It is possible to implement the timing chart illustrated at the top of FIG. 13 and FIG. 14, by setting the terminal CtA at "high" (level H). In addition, it is possible to implement the timing chart illustrated at the top of FIG. 13 and FIG. 12, by setting the terminal CtA at "low" (level L). It is possible to implement the timing chart illustrated at the bottom of FIG. 13 and FIG. 14, by setting the terminal CtB at "high" (level H). As described above, the timing charts of FIG. 13 and FIG. 14 are implemented by controlling the terminals Ct.

The setting of the terminals Ct at "high" is an operation performed by the gate driver circuit 15 illustrated in FIG. 1, and a data position (selected position) is shifted by the shift register circuit of the gate driver circuit 15 such that every other pixel row is skipped (for example, the shift register circuit 36A selects an odd-numbered pixel row, and the shift register unit 36B selects an even-numbered pixel row).

Figure 21:
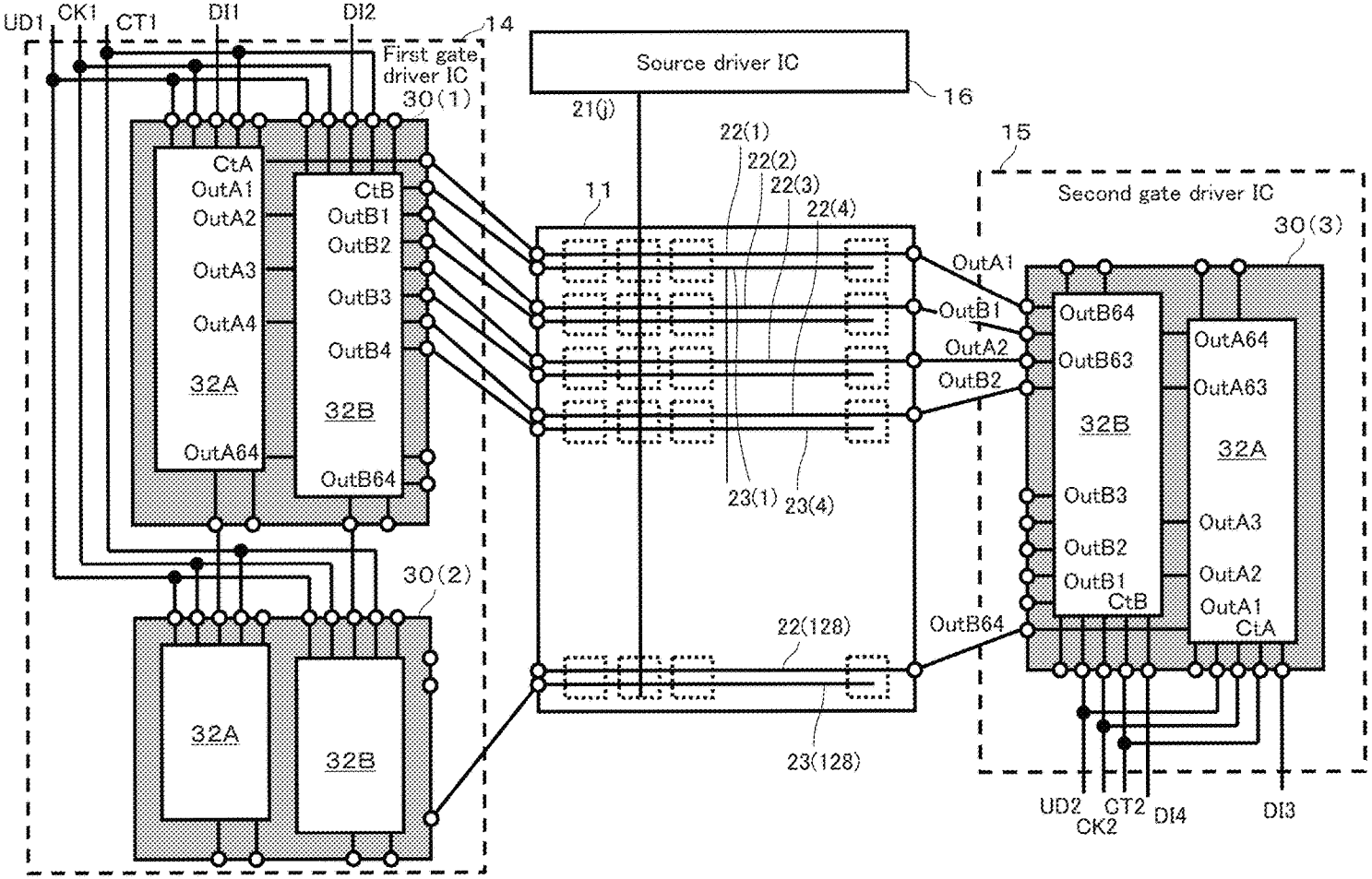
FIG. 21 is a configuration diagram of the image display apparatus according to Embodiment 1.

It is to be noted that the terminals Ct (CtA and CtB) of the gate signal line driving units 32A and 32B of the gate driver integrated circuit 30(1) are commonly connected in FIG. 21. The terminals Ct (CtA and CtB) of the gate signal line driving units 32A and 32B of the gate driver integrated circuit 30(3) are commonly connected. The gate signal line driving units 32A and 32B of the gate driver circuit 14 disposed to the left of the display panel 111 are operated by the same signals (UD1, CT1, and CK1). It is to be noted that the data inputs DI1 and DI2 are controlled so as to correspond to selected positions of the gate signal line. In the same manner as above, the gate signal line driving units 32A and 32B of the gate driver circuit 15 disposed to the right of the display panel 111 are operated by the same signals (UD2, CT2, and CK2). It is to be noted that the data inputs DI3 and DI4 are controlled so as to correspond to selected positions of the gate signal line.

According to the present disclosure, in FIG. 21, the scanning direction of the shift registers of the gate signal line driving units 32A and 32B of the gate driver integrated circuit 30(1) is opposite to the scanning direction of the shift registers of the gate signal line driving units 32A and 32B of the gate driver integrated circuit 30(3), and thus an opposite logic signal is applied to the terminals UD1 and UD2. In addition, the same clock is applied to the clocks CK1 and CK2. In addition, the CT1 is set at "low" and the CT2 is set at "high".

Figure 56:
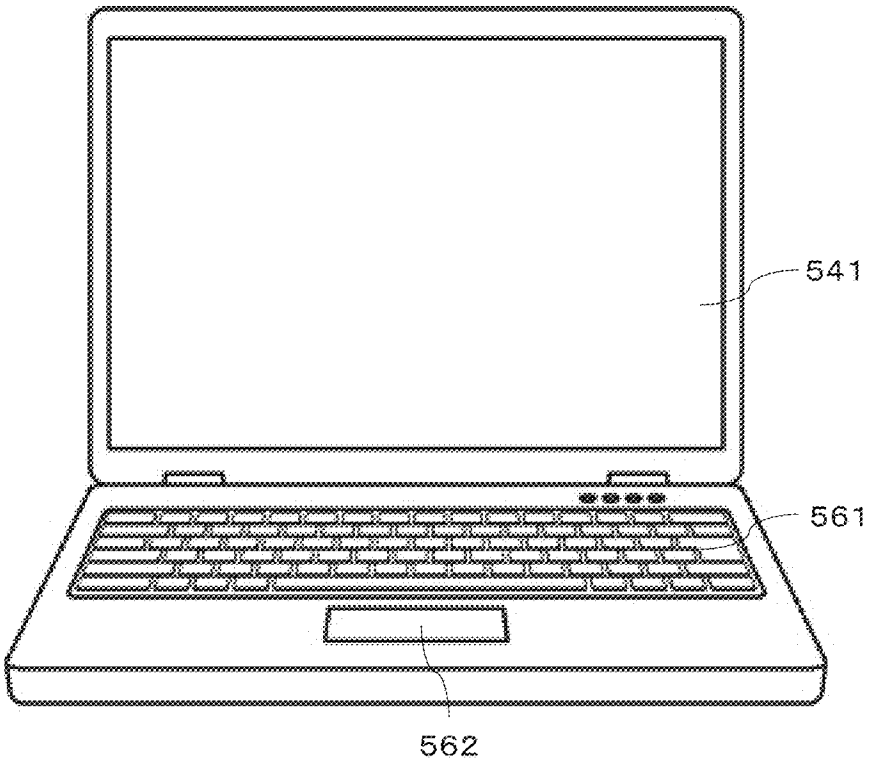
FIG. 56 is a diagram illustrating an image display apparatus.

It is to be noted that the explanation described above is also applied to the terminals CtB (see FIG. 18, FIG. 20, and FIG. 56). According to the above-described embodiment, the gate driver integrated circuit 30 includes two gate signal line driving units 32 (32A and 32B).

When m gate signal line driving units 32 are formed in the gate driver integrated circuit 30, the terminal Ct is disposed in each of the gate signal line driving units 32.

Two terminals Sel (SelA and SelB) are disposed so as to correspond to each of the gate signal line driving units 32 (32A and 32B).

When m gate signal line driving units 32 (32A, 32B, . . . , 32*m*) are disposed in the gate driver integrated circuit 30, it is preferable that the terminals Sel (SelA, SelB, . . . , Selm) are disposed so as to correspond to the gate signal line driving units 32 (32A, 32B, . . . , 32*m*), respectively. It is possible to set the gate voltage binary driving and the gate voltage ternary driving by applying a logic signal to terminals Sel disposed in each of the gate signal line driving unit 32.

It is to be noted that the terminals CtA are also set at "low" in FIG. 23, FIG. 24, FIG. 25, FIG. 26, FIG. 27, FIG. 28, FIG. 29, FIG. 30, and FIG. 31. The setting of the terminals CtA at "low" is an operation performed by the first gate driver circuit 14 illustrated in FIG. 1, and a data position (selected position) is shifted such that the shift register circuit 36A of the first gate driver circuit 14 sequentially selects one pixel row at a time. The setting of the terminals CtB is performed in the same manner as above. The setting of the terminals Ct (CtA and CtB) at "high" is an operation performed by the second gate driver circuit 15 illustrated in FIG. 1, and a data position (selected position) is shifted such that the shift register circuit 36 of the first gate driver circuit 14 sequentially selects one pixel row at a time or plural pixel rows at a time.

Figure 33:
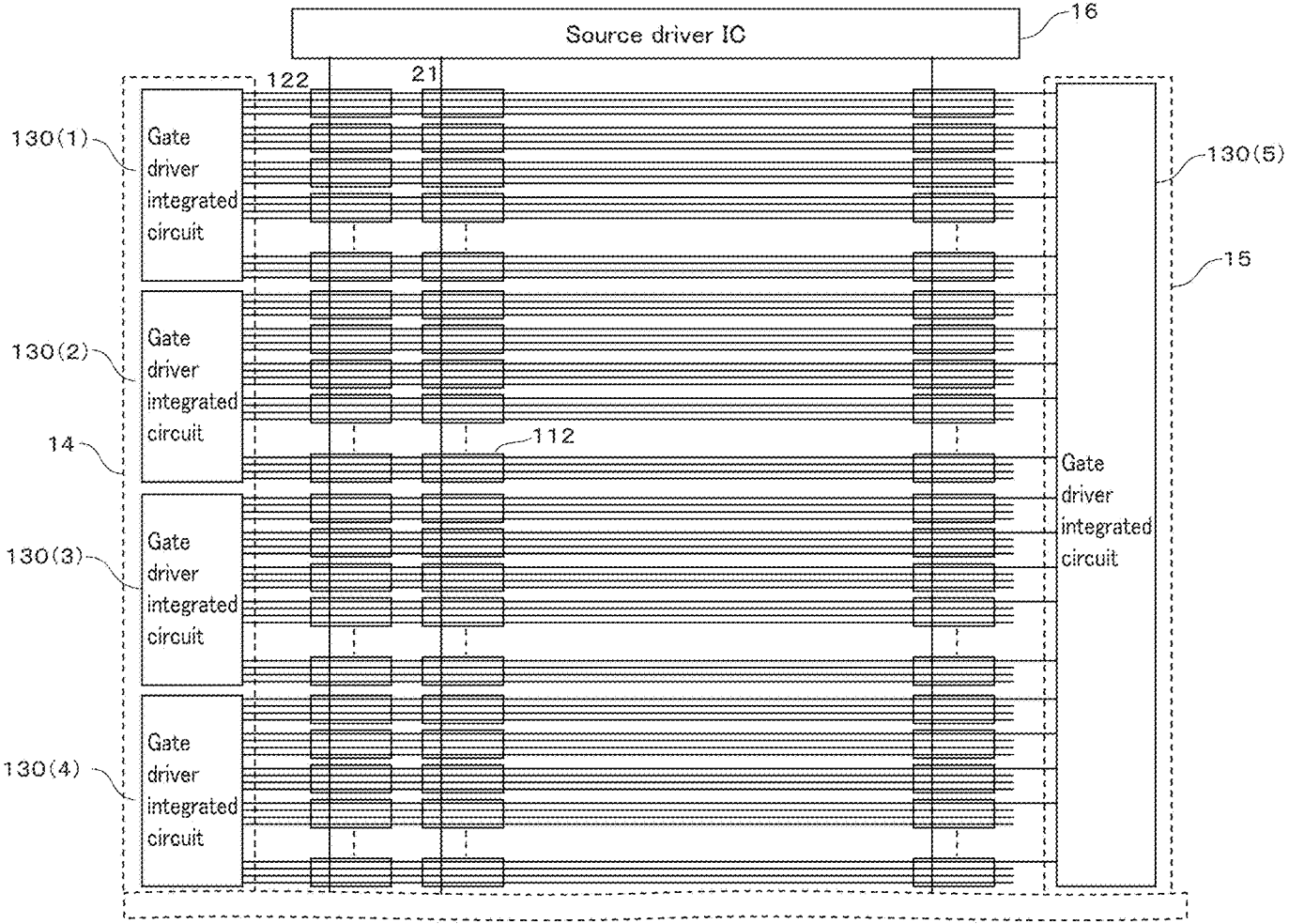
FIG. 33 is a configuration diagram of the image display apparatus according to Embodiment 1.
Figure 34:
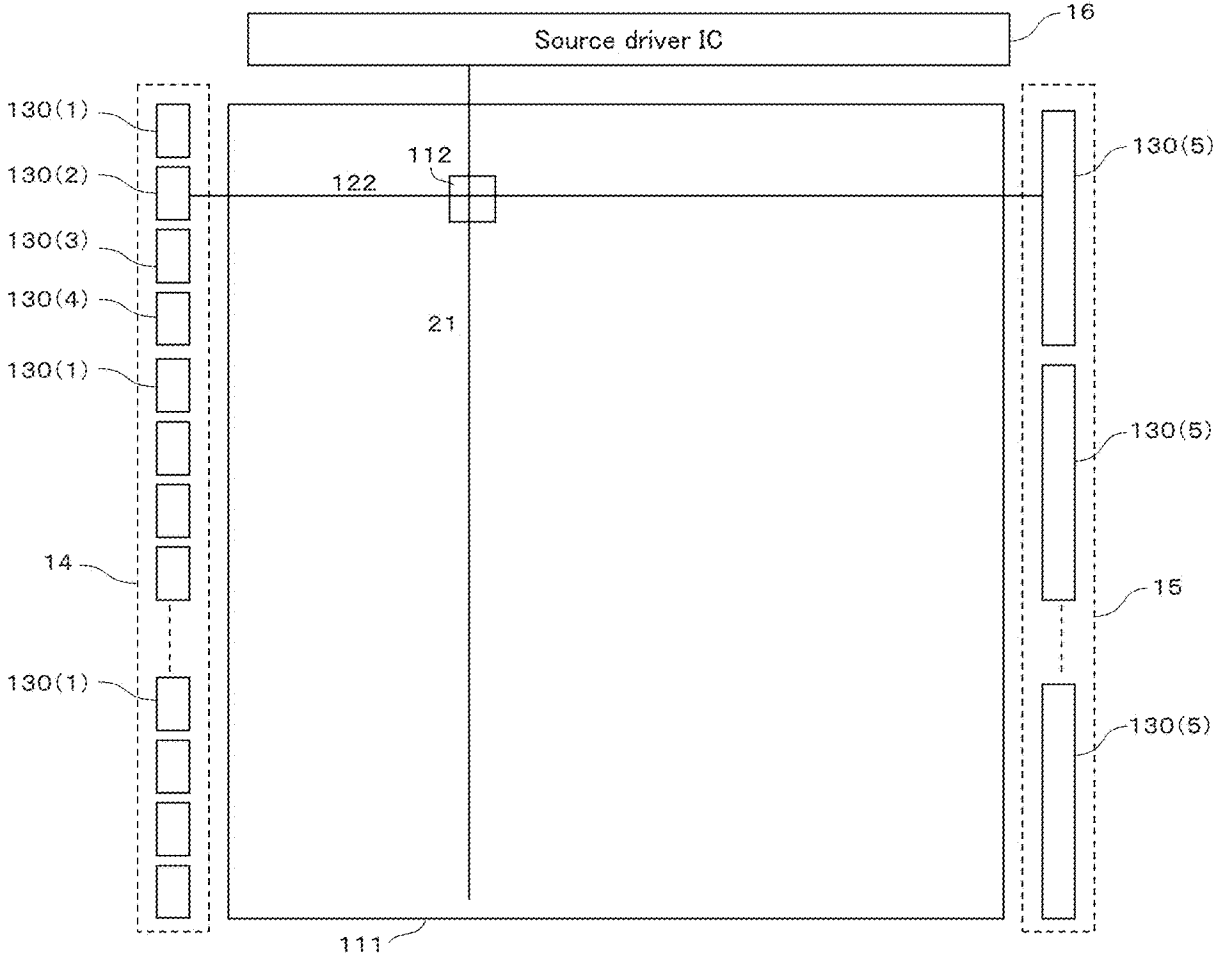
FIG. 34 is a configuration diagram of the image display apparatus according to Embodiment 1.
Figure 35:
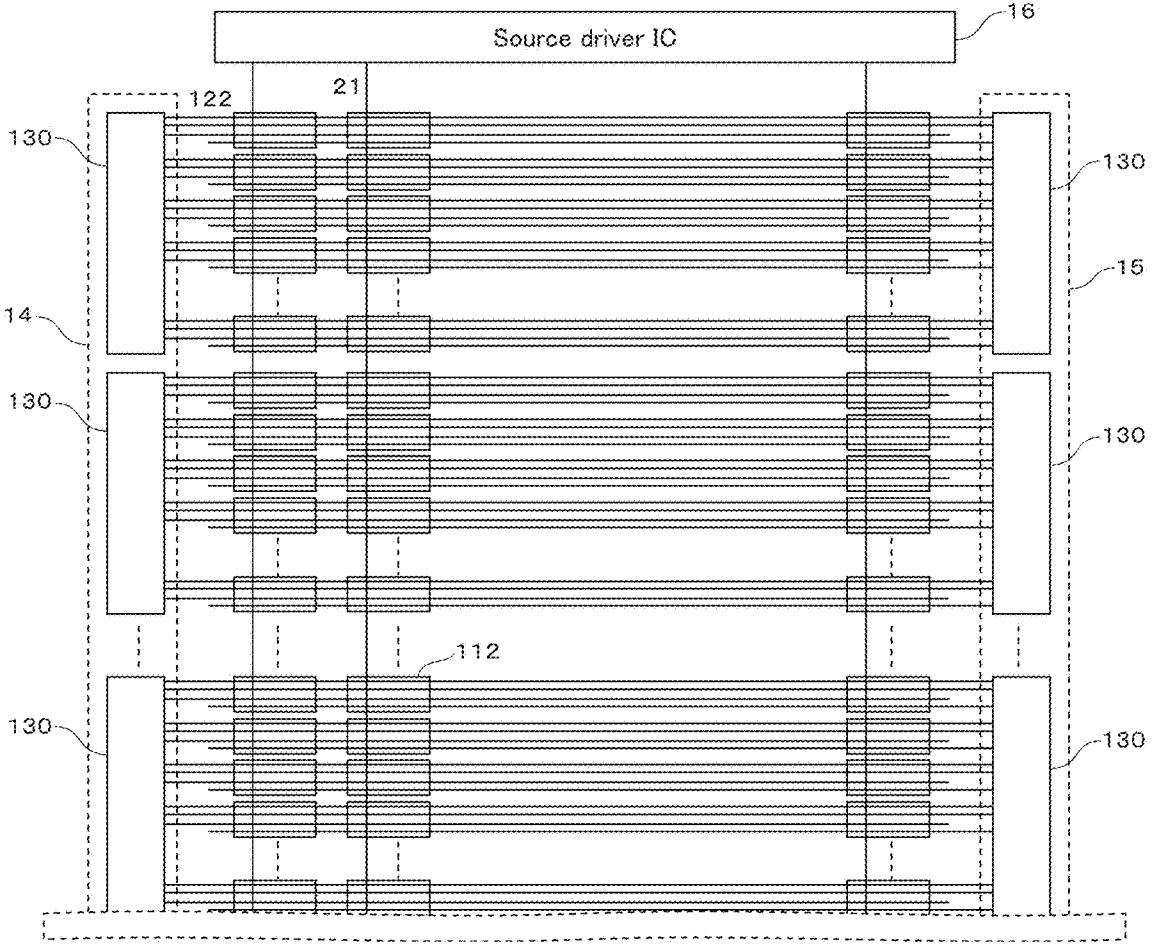
FIG. 35 is a configuration diagram of the image display apparatus according to Embodiment 1.
Figure 36:
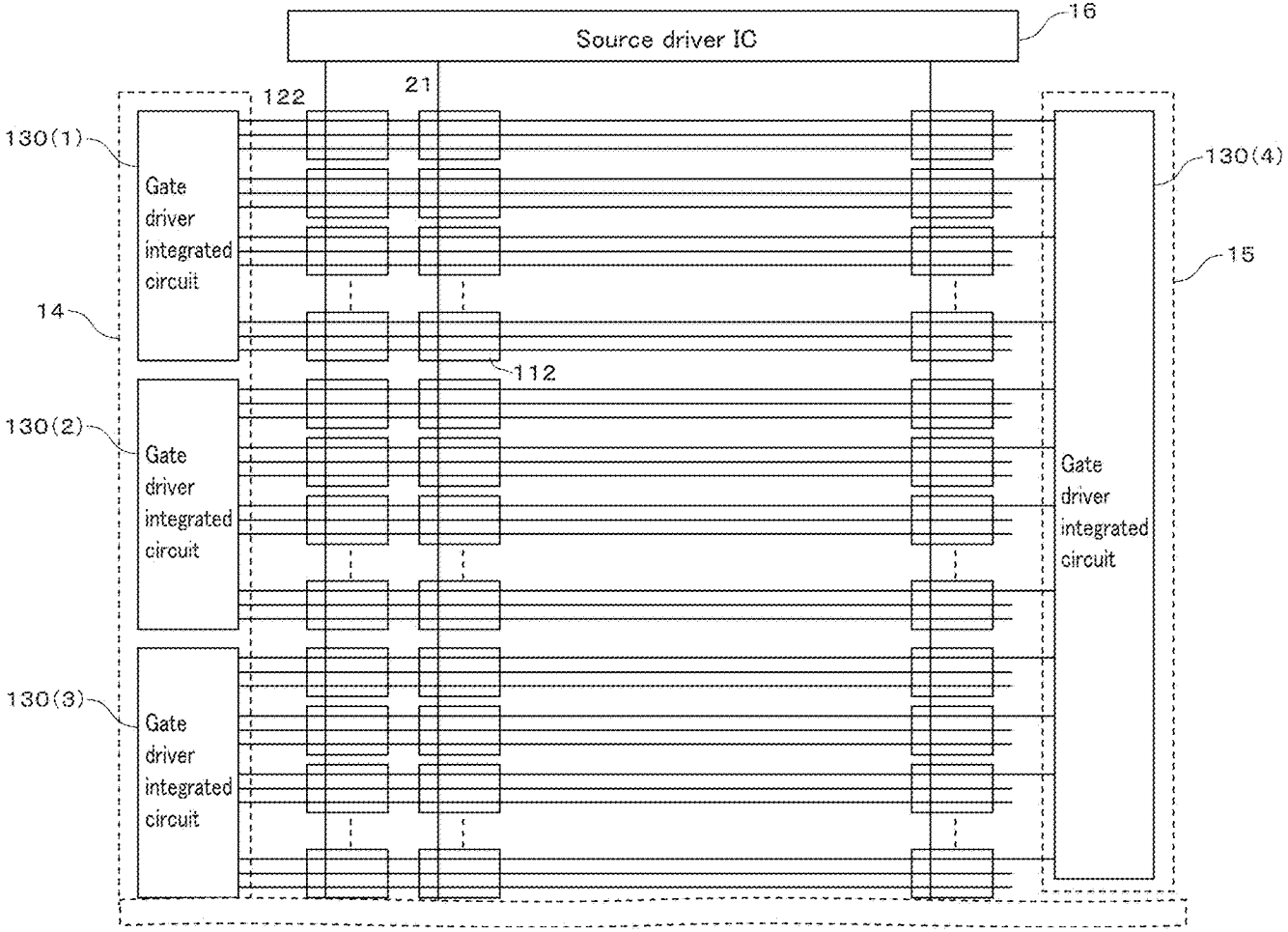
FIG. 36 is a configuration diagram of the image display apparatus according to Embodiment 1.
Figure 37:
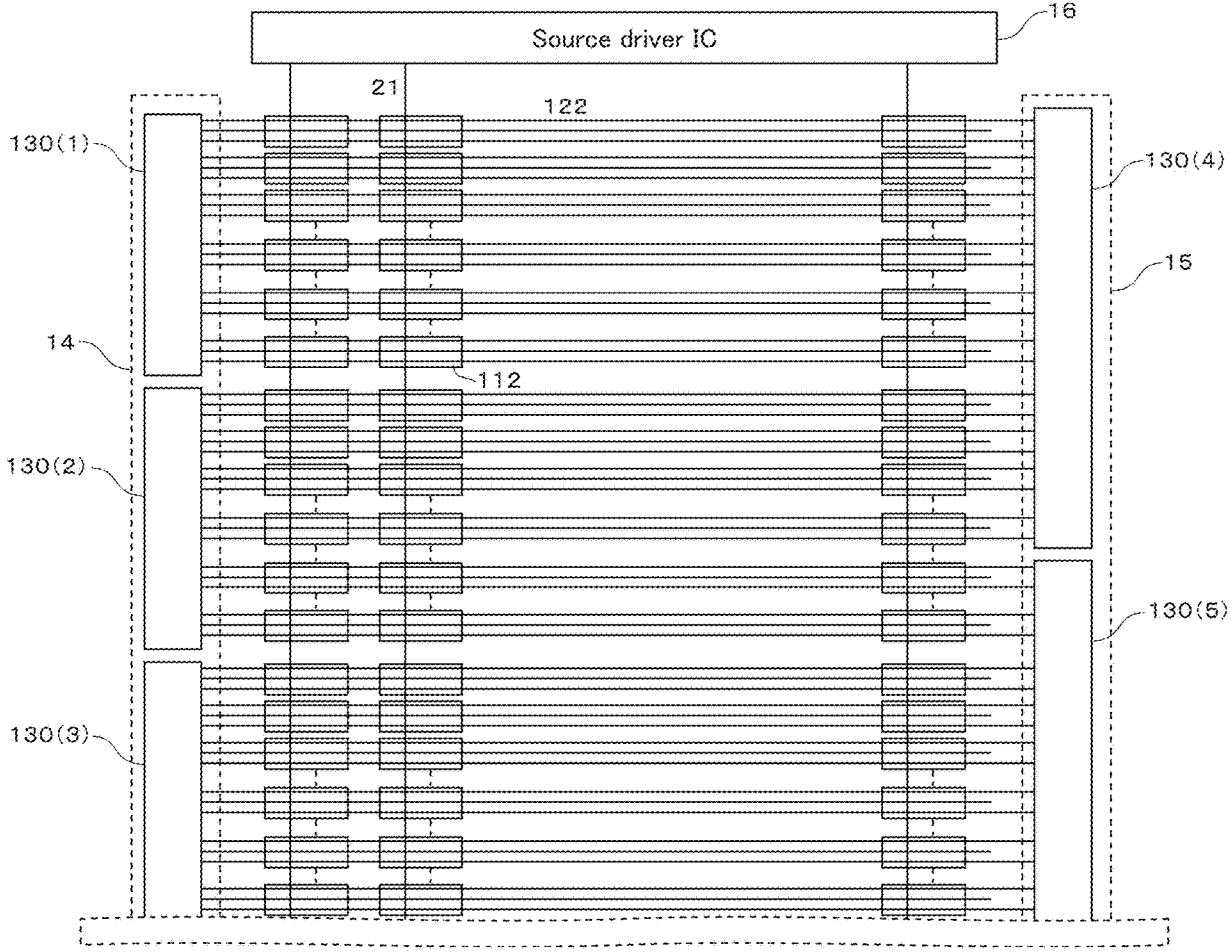
FIG. 37 is a configuration diagram of the image display apparatus according to Embodiment 1.
Figure 43:
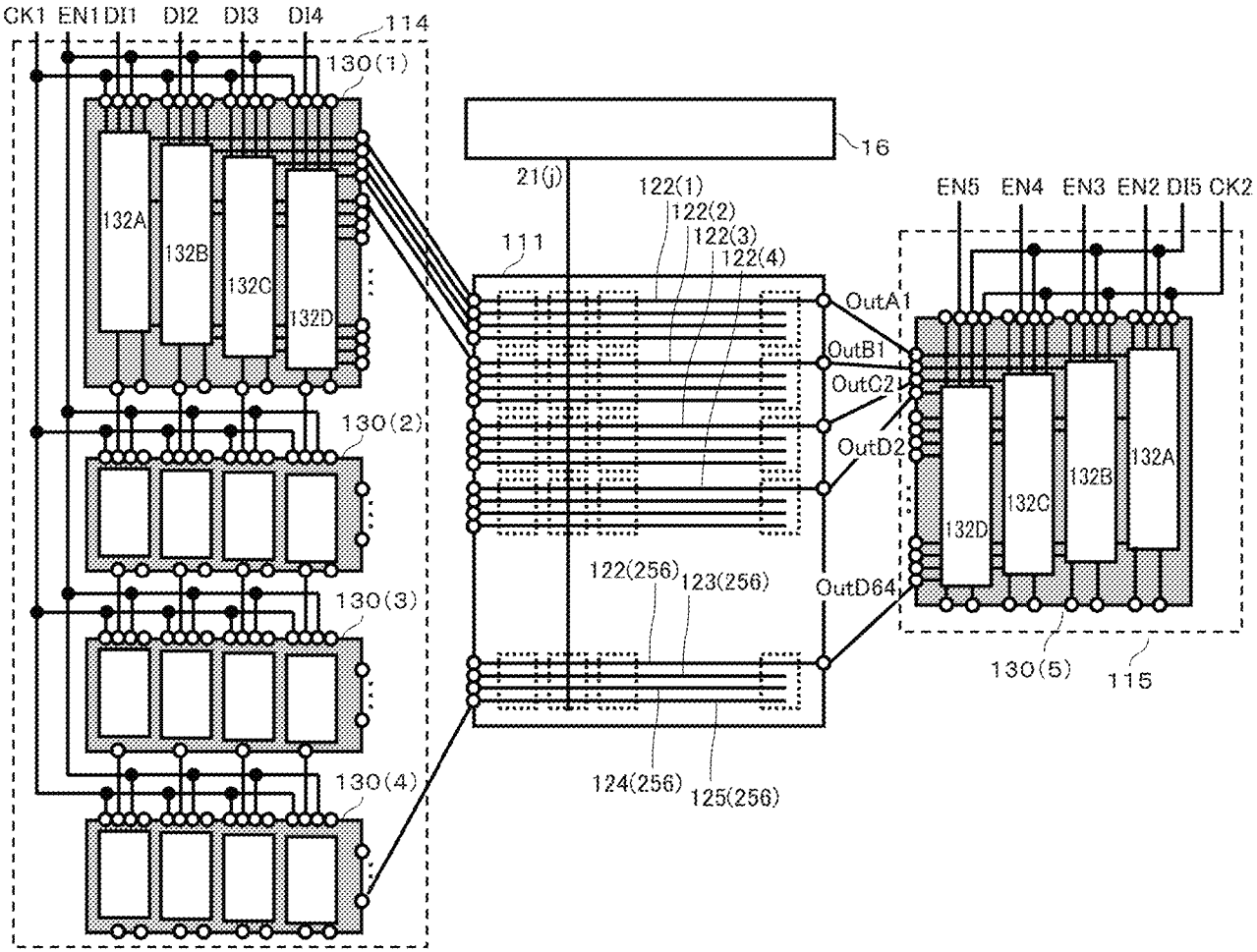
FIG. 43 is configuration diagram illustrating a first gate driver circuit and a second gate driver circuit according to Embodiment 2.

The matter or the embodiment related to the setting of the terminal Ct at "high" corresponds to the operation, the driving system, and the configuration of, for example: the second gate driver circuit 15 illustrated in FIG. 1; the second gate driver circuit 15 illustrated in FIG. 10; the second gate driver circuit 15 illustrated in FIG. 15; the second gate driver circuit 15 illustrated in FIG. 43; the gate driver integrated circuit 30 illustrated in FIG. 3; the second gate driver circuit 15 illustrated in FIG. 11; the second gate driver circuit 15 illustrated in FIG. 33; the second gate driver circuit 15 illustrated in FIG. 34; the second gate driver circuit 15 illustrated in FIG. 35; the second gate driver circuit 15 illustrated in FIG. 36; the second gate driver circuit 15 illustrated in FIG. 36; and the second gate driver circuit 15 illustrated in FIG. 37.

In FIG. 32, the voltage V22on is outputted to the terminal OutA1 during the period of 1H (the selecting period for one pixel row). The voltage V22off is outputted during the period of 1H after the application period of the voltage V22on. The voltage V22off is applied to the corresponding gate signal line and the state is kept until the next selecting period after the period of the voltage V22ovd.

The voltage V22on is outputted during the period of 1H to the terminal OutA2 with a delay of the period of 2H (the selecting period for two pixel rows) with respect to the terminal OutA1. The voltage V22off is outputted during the period of 1H after the application period of the voltage V22on. The voltage V22off is applied to the corresponding gate signal line and the state is kept until the next selecting period after the application period of the voltage V22ovd.

The voltage V22on is outputted during the period of 1H to the terminal OutA3 with a delay of the period of 2H (the selecting period for one pixel row) with respect to the terminal OutA2. The voltage V22off is outputted during the period of 1H after the application period of the voltage V22on. The voltage V22off is applied to the corresponding gate signal line and the state is kept until the next selecting period after the period of the voltage V22ovd.

In the same manner as above, the voltage Von, the voltage Vovd, and the voltage Voff are sequentially applied to the terminal OutA4.

On the other hand, the voltage V22on is outputted to the OutB1 terminal during the period of 1H (the selecting period for one pixel row) with a delay of the period of 1H with respect to the terminal OutA1.

The timing of output to the terminal OutA and the terminal OutB of the second gate driver circuit 15 is controlled by data to be applied to the terminals DI1 and DI2 in FIG. 21, for example. The timing of output to the terminal OutA and the terminal OutB of the second gate driver circuit 15 is controlled by data to be applied to the terminals DI3 and DI4.

The voltage V22off is outputted during the period of 1H after the application period of the voltage V22on. The voltage V22off is applied to the corresponding gate signal line and the state is kept until the next selecting period after the application period of the voltage V22ovd.

The voltage V22on is outputted during the period of 1H to the terminal OutB2 with a delay of the period of 2H (the selecting period for two pixel rows) with respect to the terminal OutB1. The voltage V22off is outputted during the period of 1H after the application period of the voltage V22on. The voltage V22off is applied to the corresponding gate signal line and the state is kept until the next selecting period after the application period of the voltage V22ovd.

The voltage V22on is outputted during the period of 1H to the terminal OutB3 with a delay of the period of 2H (the selecting period for one pixel row) with respect to the terminal OutB2. The voltage V22off is outputted during the period of 1H after the application period of the voltage V22on. The voltage V22off is applied to the corresponding gate signal line and the state is kept until the next selecting period after the application period of the voltage V22ovd.

In the same manner as above, the voltage Von, the voltage Vovd, and the voltage Voff are sequentially applied to the terminal OutB4.

As described above, the voltage to be applied to the gate signal line 22(*i*) changes with a delay of the period of 1H between OutA and OutB. Focusing on the voltage Von, the timing for applying the voltage Von is as follows: OutA 1, OutB 1, OutA2, OutB2, OutA3, OutB3, OutA4, OutB4, . . . .

The output of the terminal OutB is delayed by the period of 1H with respect to the output of the terminal OutA. Accordingly, in FIG. 10, selecting timing of the terminal OutA of the gate signal line driving unit 32A and selecting timing of the terminal OutB of the gate signal line driving unit 32B are realized by controlling the terminals CtA and CtB. In the same or similar manner to FIG. 10, the driving system of FIG. 13 and FIG. 14 can be implemented in the case of FIG. 15 as well. Accordingly, outputting timing of the OutA and the OutB in FIG. 13 and FIG. 14 are realized by controlling the terminals Ct.

According to the driving method described above, in the image display apparatus according to the present disclosure illustrated in FIG. 21, for example, the gate voltage ternary driving is performed on the gate signal line 22(1) by the gate signal line driving unit 32A of the first gate driver circuit 14 and the gate signal line driving unit 32B of the second gate driver circuit 15.

The gate voltage ternary driving is performed on the gate signal line 22(2) by the gate signal line driving unit 32A of the first gate driver circuit 14 and the gate signal line driving unit 32A of the second gate driver circuit 15.

The gate voltage binary driving is performed on the gate signal line 23(1) by the gate signal line driving unit 32B of the first gate driver circuit 14.

Accordingly, the gate signal line 22(1) is applied with the bilateral driving by the gate signal line driving unit 32A of the first gate driver circuit 14 and the gate signal line driving unit 32B of the second gate driver circuit 15. The gate signal line 23(1) is applied with the unilateral driving by the gate signal line driving unit 32B of the first gate driver circuit 14.

According to the above-described explanation, the gate signal lines 22(*i*) and 23(*i*) are sequentially selected according to the gate signal line driving units 32A of the first gate driver circuit 14 and the second gate driver circuit 15 and the data position of the shift register of the second gate driver circuit 15, and the driving system is implemented.

Figure 38:
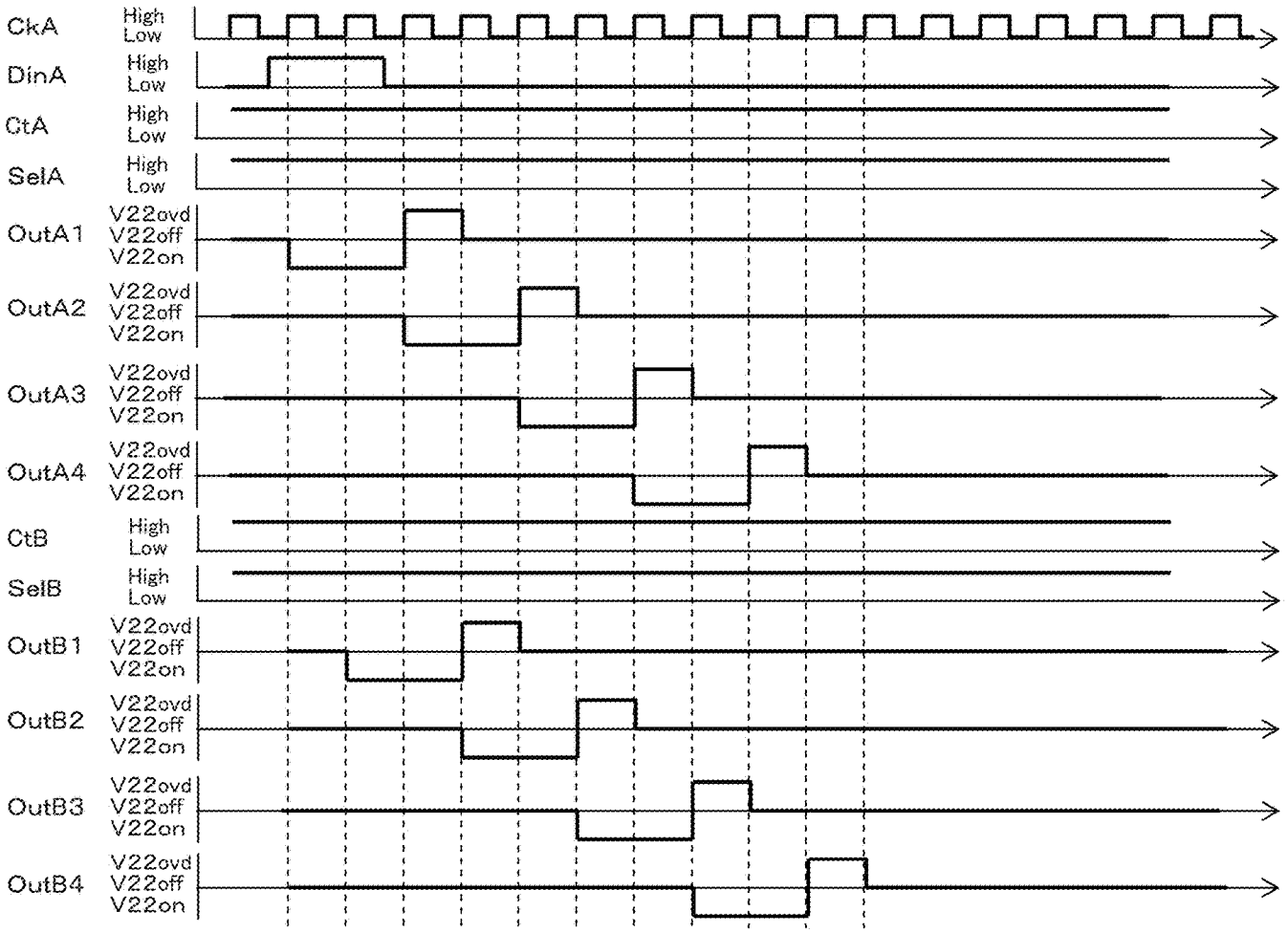
FIG. 38 is a timing chart illustrating an operation of the gate driver circuit according to Embodiment 1.

In the same manner as above, FIG. 38 is a timing chart illustrating an operation in which CtA=H and CtB=H are applied to the settings of FIG. 25 (SelA=H, SelB=H, and n=2). The operation or the control system is the same or similar to those in FIG. 25 and FIG. 32, and thus description will be omitted.

Figure 49:
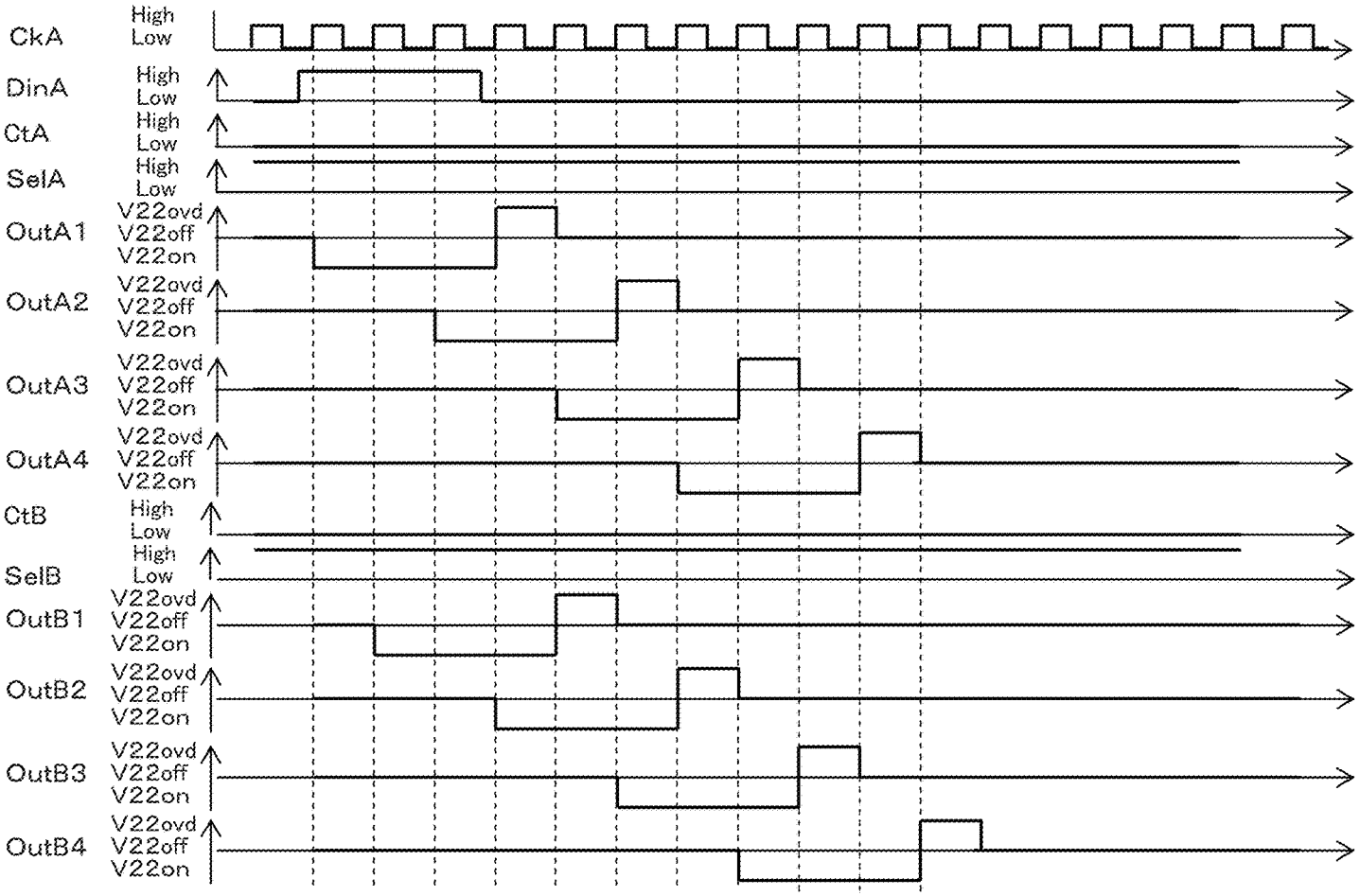
FIG. 49 is a timing chart illustrating an operation of a gate driver circuit according to Embodiment 3.

FIG. 49 is a timing chart illustrating an operation in which CtA=H and CtB=L are applied to the settings of FIG. 26 (SelA=H, SelB=H, and n=2). The operation or the control system is the same or similar to those in FIG. 26 and FIG. 32, and thus description will be omitted.

Figure 50:
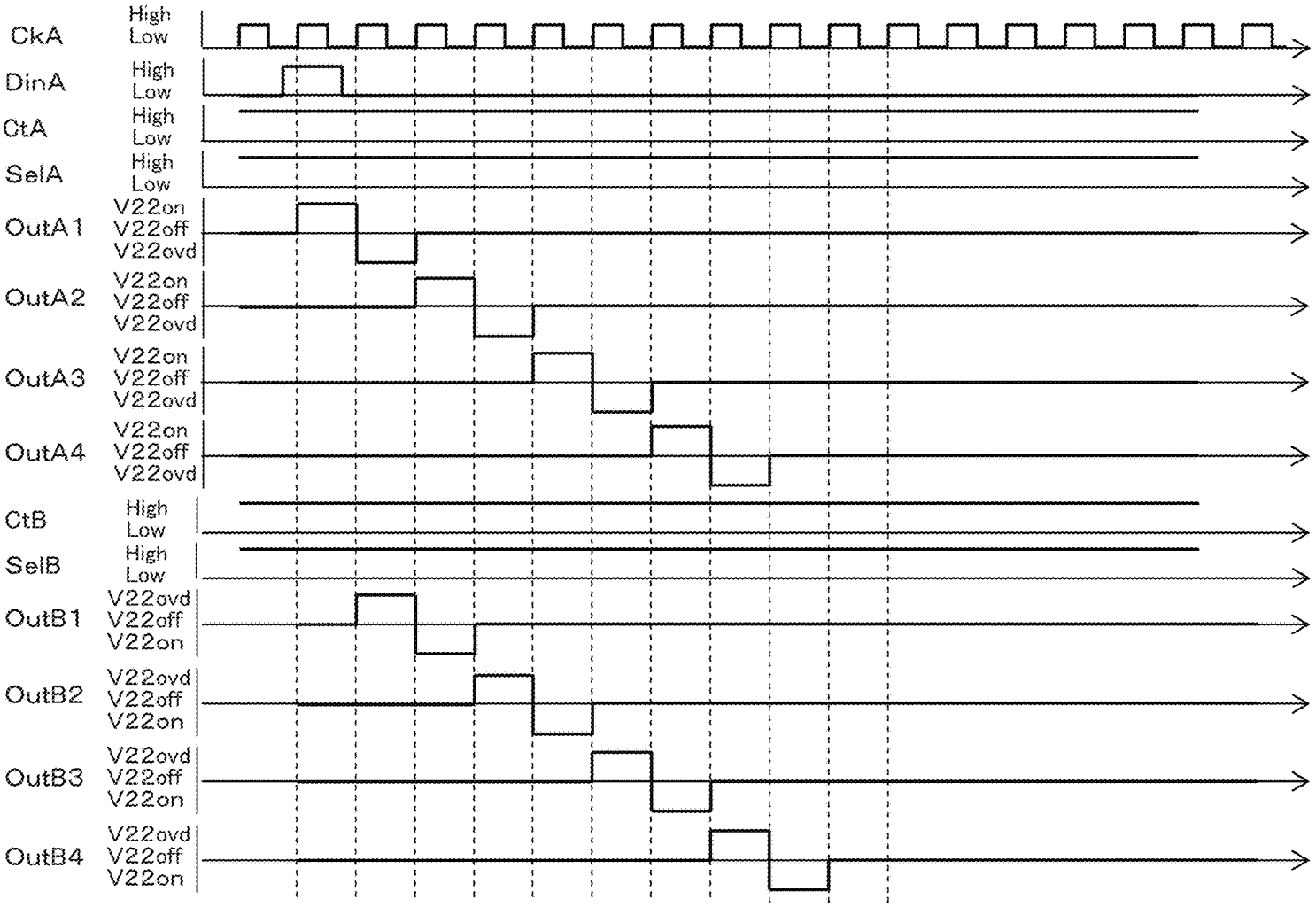
FIG. 50 is a timing chart illustrating an operation of the gate driver circuit according to Embodiment 3.

FIG. 50 is a timing chart illustrating an operation in which CtA=H and CtB=H are applied to the settings of FIG. 23 (SelA=H, SelB=H, and n=2). The operation or the control system is the same or similar to those in FIG. 23 and FIG. 32, and thus description will be omitted.

Figure 51:
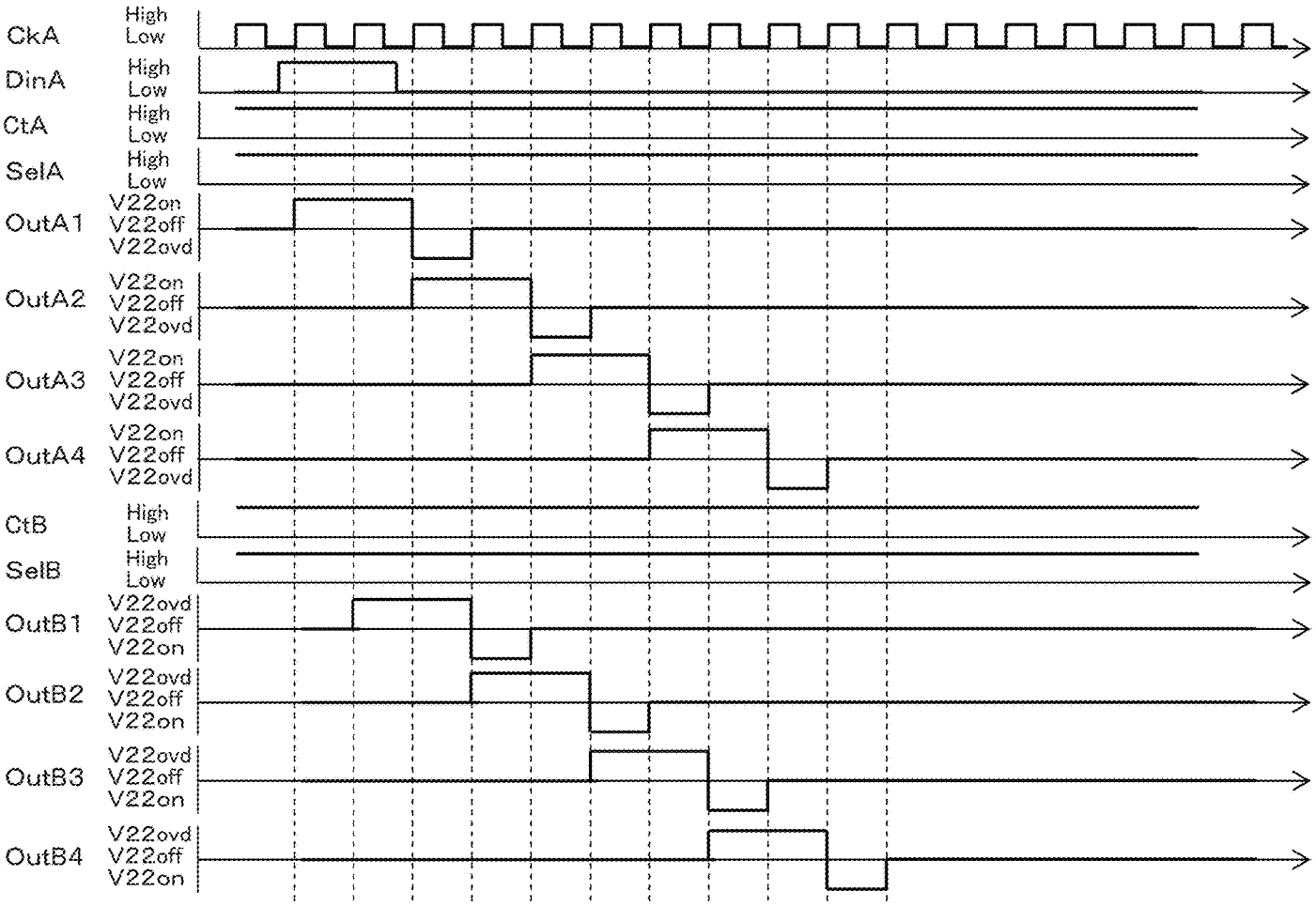
FIG. 51 is a timing chart illustrating an operation of the gate driver circuit according to Embodiment 3.

FIG. 51 is a timing chart illustrating an operation in which CtA=H and CtB=H are applied to the settings of FIG. 25 (SelA=H, SelB=H, and n=2). The operation or the control system is the same or similar to those in FIG. 25 and FIG. 32, and thus description will be omitted.

Figure 52:
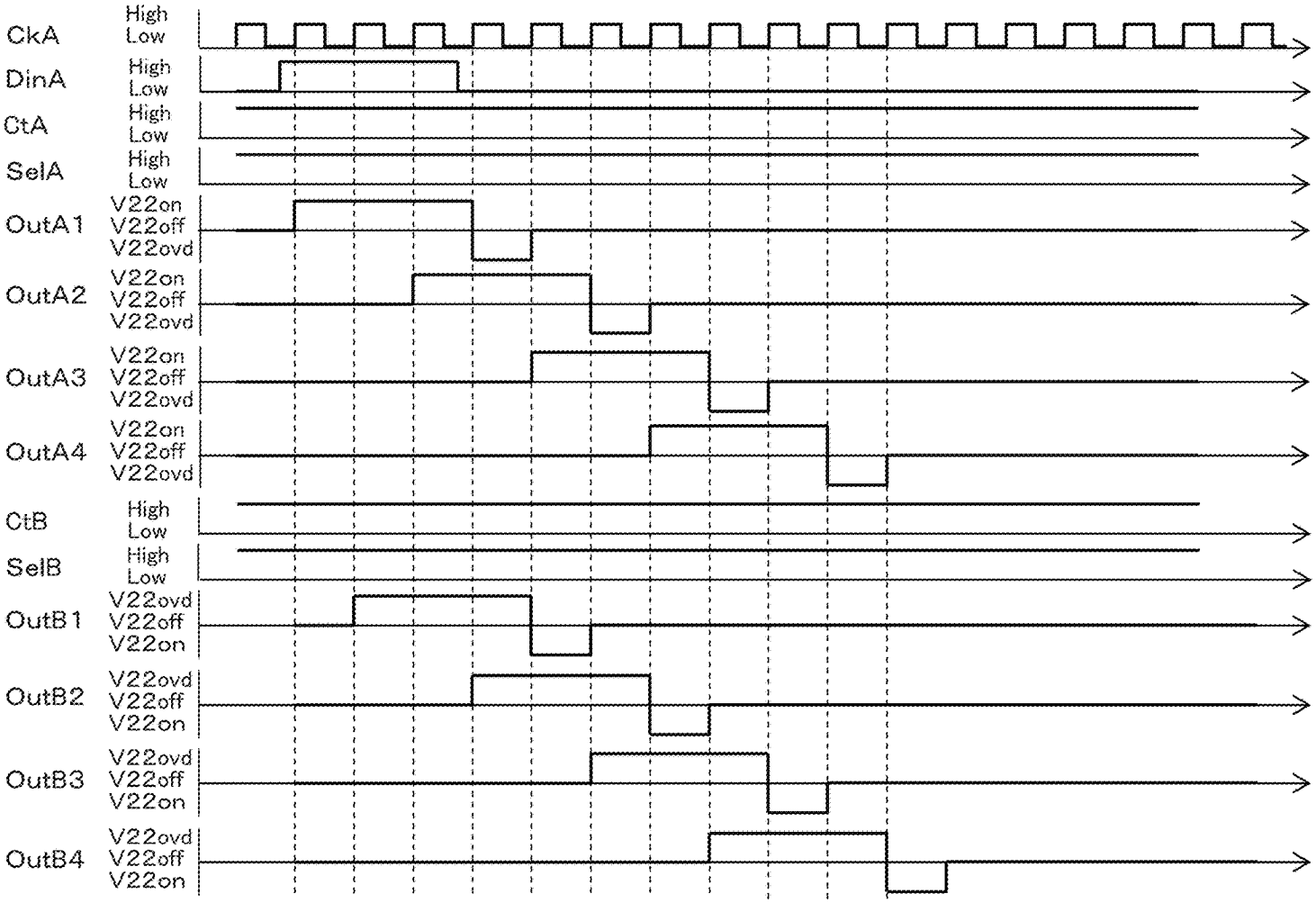
FIG. 52 is a timing chart illustrating an operation of the gate driver circuit according to Embodiment 3.

FIG. 52 is a timing chart illustrating an operation in which CtA=H and CtB=H are applied to the settings of FIG. 31 (SelA=H, SelB=H, and n=2). The operation or the control system is the same or similar to those in FIG. 31 and FIG. 32, and thus description will be omitted.

Figure 53:
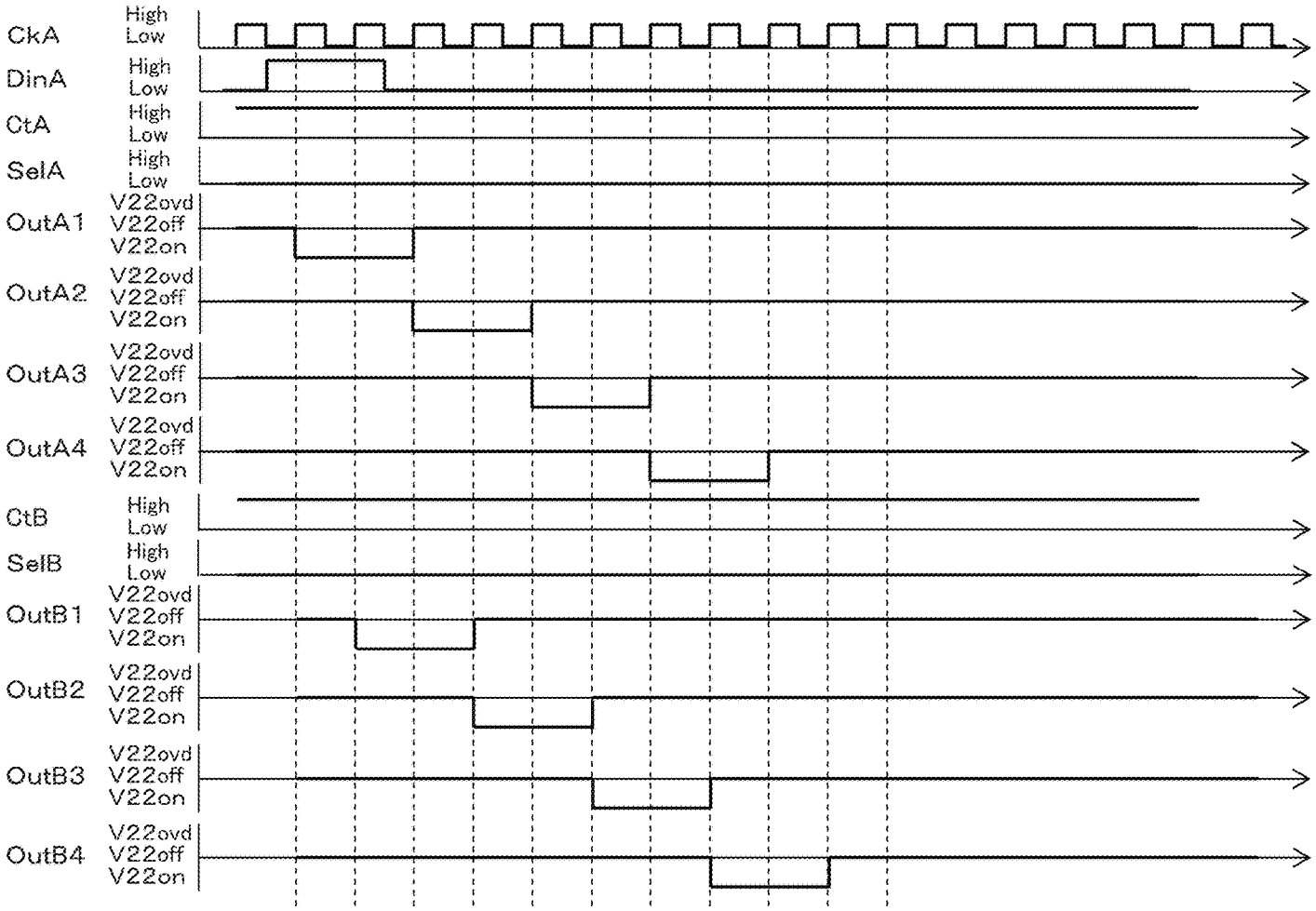
FIG. 53 is a timing chart illustrating an operation of the gate driver circuit according to Embodiment 3.

FIG. 53 is a timing chart illustrating an operation in which CtA=H and CtB=H are applied to the settings of FIG. 27 (SelA=H, SelB=H, and n=2). The operation or the control system is the same or similar to those in FIG. 27 and FIG. 32, and thus description will be omitted.

Figure 39:
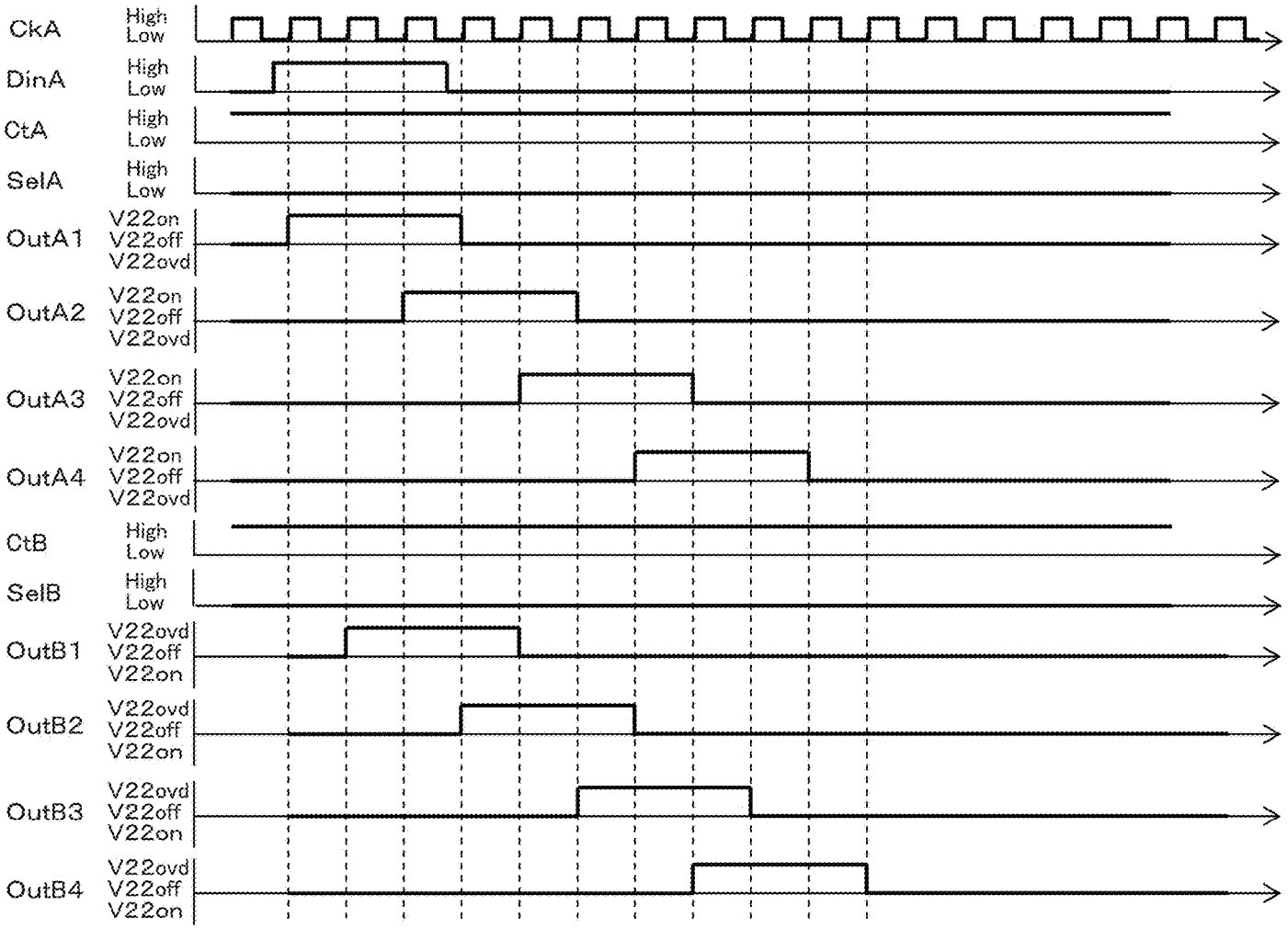
FIG. 39 is a timing chart illustrating an operation of the gate driver circuit according to Embodiment 1

Furthermore, FIG. 39 is a timing chart illustrating an operation in which the settings are as follows: SelA=L; SelB=L; n=3; CtA=H; and CtB=H.

As described above, according to the logic settings to the terminals Ct and the terminals Sel of the gate driver circuit and the gate driver integrated circuit (IC) according to the present disclosure, it is possible to implement the driving system and the image display apparatus according to the present disclosure, illustrated in, for example, FIG. 10, FIG. 15, FIG. 43, FIG. 44, FIG. 48, FIG. 11, FIG. 33, FIG. 34, FIG. 35, FIG. 36, and FIG. 37.

In FIG. 10, the image display apparatus according to present disclosure is implemented with the clocks being different between the first gate driver circuit 14 and second gate driver circuit 15. The terminal Ct divides a clock to be supplied to the terminal CK, and controls data or a control signal to be applied to the shift register. In According to the logic control on the terminal Ct, it is not required to vary the clocks of the first gate driver circuit 14 and the second gate driver circuit 15, or the first gate driver circuit 114 and the second gate driver circuit 115.

It is to be noted that, although the terminals DinA and the terminals DinB are provided in FIG. 18, the terminals may be common terminals. It is to be noted that, although the terminals CkA and the terminals CkB are provided, the terminals may be common terminals.

FIG. 21 is a diagram in which the gate driver integrated circuit or the gate driver circuit illustrated in FIG. 18, FIG. 20, etc., is applied to the image display apparatus according to the present disclosure. FIG. 21 is a diagram illustrating a configuration including the gate driver integrated circuit 30 to which a function (UD1 and UD2) of inverting an order of signals to be outputted to the output terminals OutA1 to OutA64, and the output terminals OutB1 to OutB64.

By inverting the order of signals to be outputted from the gate driver integrated circuit 50(3) of the second gate driver circuit 15, it is possible to mount the gate driver integrated circuit 50(3) of the second gate driver circuit 15 on the same surface side as the gate driver integrated circuit 30(1) and the gate driver integrated circuit 30(2) of the first gate driver circuit 14.

The first gate driver circuit 14 includes two gate driver integrated circuits 30(1) and 30(2), and the second gate driver circuit 15 includes one gate driver integrated circuit 30(3).

Output terminals of the gate driver integrated circuit 30(1) and the gate driver integrated circuit 30(2) mounted on the first gate driver circuit 14 are connected to the gate signal lines 22(1) to 22(128) and the gate signal lines 23(1) to 23(128) which are drawn to the left side of the display panel 11.

According to the present embodiment, the gate signal line 22(1) is connected to the output terminal OutA1 of the gate driver integrated circuit 30(1), the gate signal line 22(2) is connected to the output terminal OutA2 of the gate driver integrated circuit 30(1), the gate signal line 22(3) is connected to the output terminal OutA3 of the gate driver integrated circuit 30(1), . . . , and the gate signal line 22(64) is connected to the output terminal OutA64 of the gate driver integrated circuit 30(1).

In addition, the gate signal line 23(1) is connected to the output terminal OutB1 of the gate driver integrated circuit 30(1), the gate signal line 23(2) is connected to the output terminal OutB2 of the gate driver integrated circuit 30(1), . . . , and the gate signal line 23(64) is connected to the output terminal OutB64 of the gate driver integrated circuit 30(1).

In addition, the gate signal line 22(65) is connected to the output terminal OutA1 of the gate driver integrated circuit 30(2), the gate signal line 22(66) is connected to the output terminal OutA2 of the gate driver integrated circuit 30(2), the gate signal line 22(67) is connected to the output terminal OutA3 of the gate driver integrated circuit 30(2), . . . , and the gate signal line 22(128) is connected to the output terminal OutA64 of the gate driver integrated circuit 30(2).

In addition, the gate signal line 23(65) is connected to the output terminal OutB1 of the gate driver integrated circuit 30(2), the gate signal line 23(66) is connected to the output terminal OutB2 of the gate driver integrated circuit 30(2), . . . , and the gate signal line 23(128) is connected to the output terminal OutB64 of the gate driver integrated circuit 30(2).

The clock input terminal CkA and the clock input terminal CkB of the gate driver integrated circuit 30(1) are connected to the clock input terminal CkA and the clock input terminal CkB of the gate driver integrated circuit 30(2), respectively, and a first clock CK1 is supplied.

In addition, the clock input terminal CtA and the clock input terminal CtB of the gate driver integrated circuit 30(1) are connected to the clock input terminal CtA and the clock input terminal CtB of the gate driver integrated circuit 30(2), respectively, and a control signal DT1 is supplied. The control signal DT1 is set at "low".

The data output terminal DoutA of the gate driver integrated circuit 30(1) is connected to the data input terminal DinA of the gate driver integrated circuit 30(2), and the data output terminal DoutB of the gate driver integrated circuit 30(1) is connected to the data input terminal DinB of the gate driver integrated circuit 30(2).

In such a manner as described above, the gate driver integrated circuit 30(1) and the gate driver integrated circuit 30(2) are connected in the cascade arrangement. The data input terminal DinA of the gate driver integrated circuit 30(1) is supplied with a signal DI1 for generating write controlling signals 22(1) to 22(128), and the data input terminal DinB of the gate driver integrated circuit 30(1) is supplied with a signal DI2 for generating display controlling signals 23(1) to 23(128).

In addition, although not illustrated, the power supply terminal VonA of the gate driver integrated circuit 30(1) is connected to the power supply terminal VonA of the gate driver integrated circuit 30(2) and the voltage V22on is applied, and the power supply terminal VoffA of the gate driver integrated circuit 30(1) is connected to the power supply terminal VoffA of the gate driver integrated circuit 30(2) and the voltage V22off is applied Furthermore, the power supply terminal VovdA of the gate driver integrated circuit 30(1) is connected to the power supply terminal VovdA of the gate driver integrated circuit 30(2) and the voltage V22ovd is applied.

Furthermore, the power supply terminal VonB of the gate driver integrated circuit 30(1) is connected to the power supply terminal VonB of the gate driver integrated circuit 30(2) and the voltage V23on is applied, and the power supply terminal VoffB of the gate driver integrated circuit 30(1) is connected to the power supply terminal VoffB of the gate driver integrated circuit 30(2) and the voltage V23off is applied. Furthermore, the power supply terminal VovdB of the gate driver integrated circuit 30(1) is connected to the power supply terminal VovdB of the gate driver integrated circuit 30(2) and the voltage V22ovd is applied.

Meanwhile, output terminals of the gate driver integrated circuit 30(3) mounted on the second gate driver circuit 15 are connected to the gate signal lines 22(1) to 22(128) which are drawn to the right side of the display panel 11.

According to the present embodiment, among the gate signal lines 22(1) to 22(128), the gate signal line 22(1), the gate signal line 22(3), the gate signal line 22(5), . . . , and the gate signal line 22(127), which are the odd-numbered gate signal lines, are connected respectively to the output terminal OutA1 of the gate driver integrated circuit 30(3), the output terminal OutA2 of the gate driver integrated circuit 30(3), the output terminal OutA3 of the gate driver integrated circuit 30(3), . . . , and the output terminal OutA64 of the gate driver integrated circuit 30(3).

In addition, the gate signal line 22(2), the gate signal line 22(4), the gate signal line 22(6), . . . , and the gate signal line 22(128), which are the even-numbered gate signal lines, are connected respectively to the output terminal OutB1 of the gate driver integrated circuit 30(3), the output terminal OutB2 of the gate driver integrated circuit 30(3), the output terminal OutB3 of the gate driver integrated circuit 30(3), . . . , and the output terminal OutB64 of the gate driver integrated circuit 30(3).

The clock input terminal CkA and the clock input terminal CkB of the gate driver integrated circuit 30(3) are connected to each other and a second clock CK2 is supplied. In addition, the control signal CT2 is supplied to the control terminals CtA and CtB of the gate driver integrated circuit 30(3). The control signal CT2 is set at "high".

The signal DI3 is supplied to the data input terminal DinA of the gate driver integrated circuit 30(3), and the signal DI4 is supplied to the data input terminal DinB. The data inputs DI1, DI2, DI3, and DI4 are controlled so as to correspond to selected positions of the gate signal line.

According to the present disclosure, in FIG. 21, the scanning direction of the shift registers of the gate signal line driving units 32A and 32B of the gate driver integrated circuit 30(1) is opposite to the scanning direction of the shift registers of the gate signal line driving units 32A and 32B of the gate driver integrated circuit 30(3), and thus an opposite logic signal is applied to the terminals UD1 and UD2. In addition, the same clock is applied to the clocks CK1 and CK2.

FIG. 9, FIG. 16, FIG. 18, etc., each illustrate an exemplary embodiment in which two gate signal line driving units are included. It should be understood that the exemplary embodiment or the technical idea illustrated in FIG. 9, FIG. 16, FIG. 18, etc., can be applied to a configuration in which three or more gate signal line driving units are included (for example, FIG. 42, FIG. 43, etc.).

It is to be noted that the circuits (the gate driver circuits and gate driver integrated circuits) which drive the gate signal lines are described as gate driver circuits according to the present disclosure; however, the gate driver circuits according to the present disclosure are not limited to these circuits. For example, the gate driver circuits may each be directly formed on the display panel substrate concurrently with the process of forming pixel circuits or the like using the techniques of TAOS, a low-temperature poly silicon, and a high-temperature polycrystalline silicon.

In addition, the source driver circuit is not limited to the semiconductor chips, but may be any source driver circuits. It should be understood that COFs are not required when the source driver circuits are formed directly on the display panel substrate concurrently with the process of forming the pixel circuits or the like sing the techniques of TAOS, a low-temperature poly silicon, and a high-temperature polycrystalline silicon.

In addition, the transistor Q which includes a driving transistor and a switching transistor is described as a thin-film transistor (TFT); however, the transistor Q is not limited to the TFT. The transistor Q may be configured of a thin-film diode (TFD), a ring diode, or the like.

The transistors Q may be, of course, FETs, MOS-FETs, MOS transistors, or bipolar transistors. These are also fundamentally thin-film transistors. In addition, it should be understood that the transistors Q may be varistors, thyristors, ring diodes, photodiodes, photo transistors, PLZT elements, etc.

In addition, the transistors Q are not limited to thin-film elements but may be transistors formed on a silicon wafer. For example, a transistor formed using a silicon wafer, removed and transferred onto a glass substrate is exemplified. In addition, a display panel on which a transistor chip formed using a silicon wafer is mounted by bonding on a glass substrate is exemplified.

It is to be noted that either an n-type or a p-type transistor Q can be included in the pixel circuit. It is preferable that that the transistor Q has, for example, an LDD (lightly doped drain) configuration.

Furthermore, the transistors Q may be any one of those formed using: high-temperature polycrystalline silicon (HTPS); low-temperature poly silicon (LTPS); continuous grain silicon (CGS); transparent amorphous oxide semiconductor (TAOS, IZO); amorphous silicon (AS); and infrared rapid thermal annealing (RTA). In addition, the first gate driver circuit 14, the second gate driver circuit 15, and the source driver circuit 16 are not limited to those formed using semiconductor chips, but may be directly formed on a substrate on which the pixel circuit is formed using the above-described polysilicon techniques.

In FIG. 2, transistors Q included in a pixel are all formed in, for example, a p-type. However, the transistors Q of the pixel are not limited to the p-type transistors according to the present disclosure. The transistors Q may be formed of only the n-type transistors or only the p-type transistors. In addition, the pixel circuit 12 may be configured using both of the n-type and the p-type transistors.

The switching transistors Q (for example, Q22 or Q22) are not limited to transistors, but the switching transistors Q may be analogue switches formed using both of the p-type transistor and the n-type transistor, for example.

It is preferable that the transistors Q each have a top gate structure. This is because the top gate structure reduces parasitic capacitance, and a gate electrode pattern of the top gate functions as a light shielding layer to shield light emitted from a light-emitting element D20, making it possible to reduce malfunction of a transistor or an off-leakage current.

It is preferable, in the process to be carried out, that a copper line or a copper alloy line can be employed as a line material for a gate signal line 22(*i*) or a source signal line 21(*i*), or for both of the gate signal line 22(*i*) and the source signal line 21(*i*). This is because it is possible to reduce wiring resistance between signal lines and a larger display panel can be implemented.

It is preferable that the gate signal line 22(*i*) which is driven (controlled) by the gate driver circuit 14 has low impedance. Accordingly, it is preferable that, in the process to be carried out, a copper line or a copper alloy line can be employed as the line material, in a composition or a structure of the gate signal line 22(*i*).

Specifically, as a technique of forming the pixel circuit 12, it is preferable that low-temperature poly silicon (LTPS) is employed. A transistor formed through the low-temperature poly silicon technique is easily formed into the top gate structure. With the top gate structure, parasitic capacitance is small, an n-type and a p-type transistor can be manufactured, and the copper line or the copper alloy line process can be employed, and thus it is preferable that the top gate structure is used in the image display apparatus according to the present disclosure. It is preferable that, for the copper line, a three-layer structure of Ti—Cu—Ti is employed.

For the lines such as the gate signal line 22(*i*) or the source signal line 21(*i*), a three-layer structure of Mo (molybdenum)-Cu—Mo is employed when the transistors Q are transparent amorphous oxide semiconductors (TAOS).

It should be understood that the above-described explanation or details can be applied to other embodiments of the present disclosure as well.

Embodiment 2

The following describes an image display apparatus including the display panel 111 in which a plurality of pixel circuits are disposed each of which includes a gate signal line to which the bilateral driving is applied and three gate signal lines to which the unilateral driving is applied.

In the following description, it is assumed that the number of pixels in the row direction of the display panel 111 is n=256 for the purpose of illustration. It is also assumed that the gate signal line driving units each having 64-pixel outputs are integrated for four circuits in a single gate driver integrated circuit. However, the number of pixels in the row direction of the display panel 111, and the number of gate signal line driving units and the number of outputs thereof, according to the present disclosure are not limited to those described above.

FIG. 40 is a circuit diagram illustrating the pixel circuit 112(*i, j*) of an image display apparatus 110 according to the present embodiment. The pixel circuit 112(*i, j*) according to the present embodiment includes: an EL element D120; a driving transistor Q120; a capacitor C120; and transistors Q122, Q123, Q124, and Q125 each operating as a switch.

The driving transistor Q120 supplies the EL element D120 with a current according to a video signal voltage Vsg(j). The capacitor C120 holds the video signal voltage Vsg(j). The transistor Q122 is a switch for writing the video signal voltage Vsg(j) to the capacitor C120. The transistor Q123 is a switch which supplies the EL element D120 with a current to cause the EL element D120 to emit light. The transistor Q124 is a switch which applies a voltage Vini to the source of the driving transistor Q120, and the transistor Q125 is a switch which applies a voltage Vref to the gate terminal of the driving transistor Q120.

The pixel circuit 112(*i, j*) includes a power line 128 on the high-voltage side and a power line 129 on the low-voltage side. The power line 128 is supplied with an anode voltage Vdd from the power supply circuit. The power line 129 is supplied with a cathode voltage Vss from the power supply circuit. The drain of the transistor Q123 is connected to the power line 128 on the high-voltage side, and the source terminal of the transistor Q123 is connected to the drain terminal of the driving transistor Q120. The source of the driving transistor Q120 is connected to the anode of the EL element D120, and the cathode of the EL element D120 is connected to the power line 129 on the low-voltage side.

The pixel circuit 12(*i, j*) illustrated in FIG. 40 is supplied with the anode voltage Vdd, the cathode voltage Vss, the reference voltage Vref, and the initial voltage Vini, each of which supplied in common to all of the pixel circuits 12(*i, j*). In addition, when a voltage resulting from adding a luminescence production starting voltage of the light-emitting element D120 to the threshold voltage of the driving transistor Q20 is larger than 0V, the voltage Vini may be substantially the same voltage as the cathode voltage Vss.

It is preferable that, in the pixel circuit 12(*i, j*) illustrated in FIG. 40, the following relationship is established: the anode voltage Vdd>the reference voltage Vref>the cathode voltage Vss>the initial voltage Vini. To be specific, for example, the anode voltage Vdd=10 to 18 (V), the reference voltage Vref=1.5 to 3 (V), the cathode voltage Vss=0.5 to 2.5 (V), and the initial voltage Vini=0 to −3 (V).

The capacitor C120 is connected between the gate terminal and the source of the driving transistor Q120. The drain terminal (or the source terminal) of the transistor Q124 is connected to the source terminal of the driving transistor Q120, and the source terminal (or the drain terminal) of the transistor Q124 is connected to the power line of the voltage Vini. The drain terminal (or the source terminal) of the transistor Q125 is connected to the gate terminal of the driving transistor Q120, and the source terminal (or the drain terminal) of the transistor Q125 is connected to the power line of the voltage Vref.

The source terminal (or the drain terminal) of the transistor Q122 is connected to the source 121(*j*) that supplies the video signal voltage Vsg(j), and the drain terminal (or the source terminal) of the transistor Q122 is connected to the gate terminal of the driving transistor Q120.

In addition, the gate terminal of the transistor Q122 is connected to the gate signal line 122(*i*), the gate terminal of the transistor Q123 is connected to the gate signal line 123(*i*), the gate terminal of the transistor Q124 is connected to the gate signal line 124(*i*), and the gate terminal of the transistor Q125 is connected to the gate signal line 125(*i*).

The gate signal line 122(*i*) is drawn from the left side of the display panel 111 and connected to the first gate driver circuit 114, and also drawn from the right side of the display panel 111 and connected to the second gate driver circuit 115. In addition, the gate signal lines 123(*i*), 124(*i*), and 125(*i*) are drawn from the left side of the display panel 111 and connected to the first gate driver circuit 114.

As described above, according to the present embodiment, the gate signal line 122(*i*) is the first gate signal line to which the bilateral driving is applied, and the gate signal lines 123(*i*), 124(*i*), and 125(*i*) are each the second gate signal line to which the unilateral driving is applied.

It is to be noted that, although it has been described that each of the driving transistor Q120, the transistors Q122, Q123, Q124, and Q125 is an N-channel thin-film transistor according to the present embodiment, the present disclosure is not limited to this.

The following describes an operation of the pixel circuit 112(*i, j*).

Figure 41:
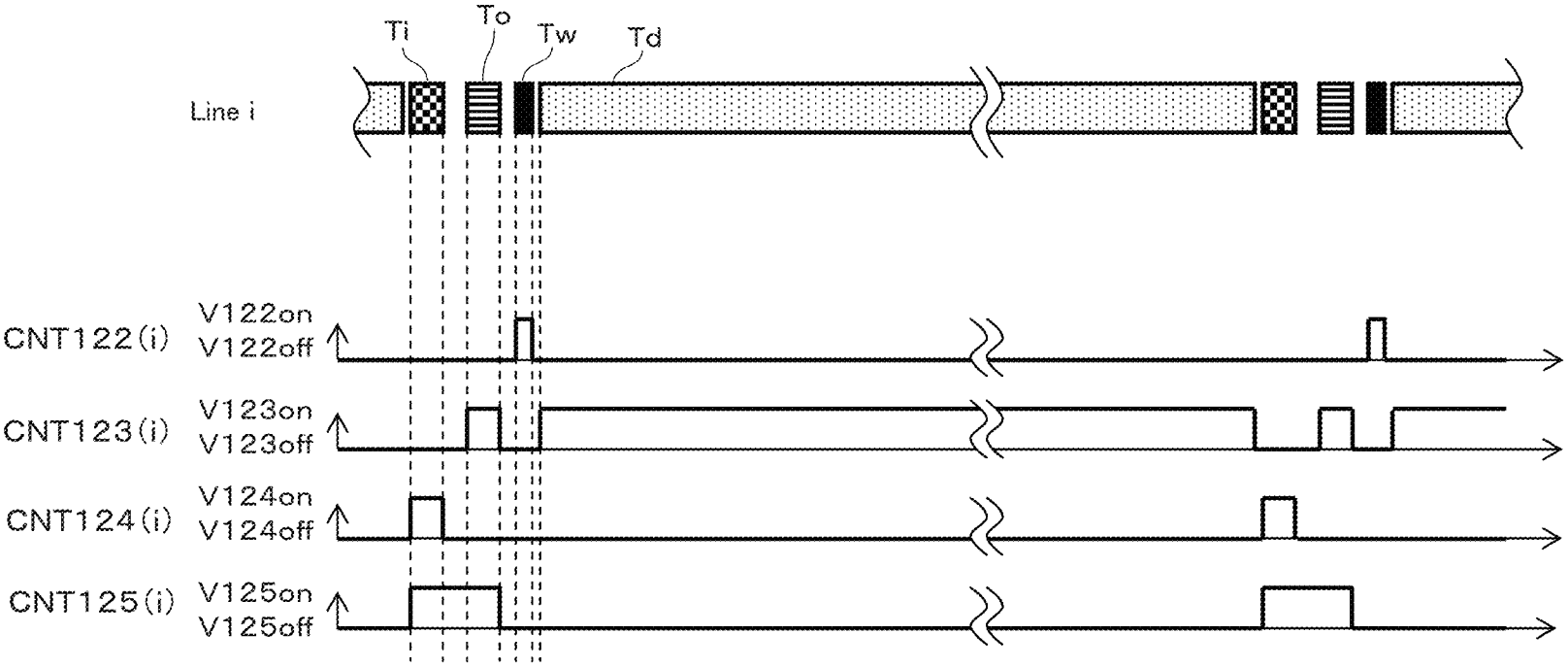
FIG. 41 is a timing chart for explaining an operation of the pixel circuit according to Embodiment 2.

FIG. 41 is a timing chart for explaining an operation of the pixel circuit 112(*i, j*) of the image display apparatus 110 according to the present embodiment. More specifically, FIG. 41 is a timing chart for the pixel circuits 112(*i*, 1) to 112(*i, m*) in the line i.

Each of the pixel circuits 112(*i*, 1) divides one field period into a plurality of periods including: an initialization period Ti; a detecting period To; a writing period Tw; and a display period Td. In the initialization period Ti, a voltage between the terminals of the capacitor C120 is initialized. In the detecting period To, an offset voltage Vos of the driving transistor Q120 is detected. In the writing period Tw, an operation of writing the video signal voltage Vsg(j) to be displayed is performed by the pixel circuit 112(*i, j*). In the display period Td, the EL element D120 is caused to emit light based on the video signal voltage Vsg(j) which has been written.

(Initialization Period Ti)

For performing initialization, the control signal CNT124 (*i*) is set at the voltage V124on to turn ON the transistor Q124, and the control signal CNT125 is set at the voltage V125on to turn ON the transistor Q125. In addition, the control signal CNT122(*i*) is set at the voltage V122off to turn OFF the transistor Q122, and the control signal CNT123 is set at the voltage V123off to turn OFF the transistor Q123.

Then, the source of the driving transistor Q120 is supplied with the voltage Vini, and the gate of the driving transistor Q120 is supplied with the voltage Vref. In such a manner as described above, the voltage between the terminals of the capacitor C120 is set at a voltage (Vref−Vini). Since the voltage Vini is set at a voltage lower than or equal to the voltage Vss, the EL element D120 does not emit light.

Subsequently, the control signal CNT124 is set at the voltage V124off to turn OFF the transistor Q124.

(Detecting Period To)

The display controlling signal CNT 123(*i*) is set at the voltage V123on to turn ON the transistor Q123. Then, since the voltage (Vref−Vini) of the capacitor C120 is applied between the gate and the source of the driving transistor Q120, a current starts to flow from the power line 128 on the high-voltage side via the transistor Q123 and the driving transistor Q120, and the capacitor C120 starts to discharge.

Then, the voltage between the terminals of the capacitor C120 is set at the offset voltage Vos of the driving transistor Q120, and the current stops flowing. At this time, the voltage at the anode of the EL element D120 increases to a voltage (Vref−Vos).

However, since the voltage (Vref−Vos) is lower than the voltage between the anode and the cathode when a current starts to flow through the EL element D120, the EL element D120 does not emit light.

It is to be noted that, when a current does not flow through the EL element D120, the EL element D120 operates as a capacitor having a large capacitance between the anode and the cathode.

Subsequently, the control signal CNT125 is set at the voltage V125off to turn OFF the transistor Q125, and the control signal CNT123 is set at the voltage V123off to turn OFF the transistor Q123.

(Writing Period Tw)

For performing the writing operation, the write controlling signal CNT122(*i*) is set at the voltage V122on to turn ON the transistor Q122 while the transistor Q123, the transistor Q124, and the transistor Q125 are kept in an OFF state. Then, the voltage at the gate of the driving transistor Q120 is set at the video signal voltage Vsg(j).

At this time, since the EL element D120 operates as a capacitor having a sufficiently large capacitance compared to the capacitor C120, the voltage at the anode of the EL element D120 is maintained at the voltage (Vref−Vos). Accordingly, the capacitor C120 is charged to have a voltage (Vsg(j)−(Vref−Vos)); that is, a voltage ((Vsg(j)+Vos)−(Vref), between the terminals.

Subsequent to the writing operation, the write controlling signal CNT122(*i*) is set at the voltage V122off to turn OFF the transistor Q122.

(Display Period Td)

The display controlling signal CNT123(*i*) is set at the voltage V123on to turn ON the transistor Q123 while each of the transistor Q122, the transistor Q124, and the transistor Q125 is kept in an OFF state. Then, a current according to the voltage between the gate and the source (Vsg(j)+Vos) flows through the EL element D120.

Here, the voltage Vos is an offset voltage Vos of the driving transistor Q120. Accordingly, the current that flows through the EL element D120 depends on the voltage Vsg(j) that results from subtracting the offset voltage Vos from the voltage between the gate and source terminals of the driving transistor Q120 (Vsg(j)+Vos).

In such a manner as described above, in the display period Td, the EL element D120 is caused to emit light with a luminance depending on the video signal voltage Vsg(j) which has been written in the writing period Tw. In general, the offset voltage Vos of the driving transistor Q120 has large variation. However, the image display apparatus 110 according to the present embodiment is capable of displaying an image while suppressing the effect of variation in the offset voltage Vos.

It is to be noted that, in the present embodiment, the initialization period Ti and the detecting period To are each set as one horizontal retrace period, and for further stabilization of the operation, a period between the initialization period Ti and the detecting period To is also set as one horizontal retrace period.

In addition, in order to improve the luminance of the image display apparatus 110, most part of the one field period other than the initialization period Ti, the detecting period To, and the writing period Tw is the display period Td, according to the present embodiment. In addition, the time period of the writing period Tw is 1 μs as with Embodiment 1.

The following describes an operation of the image display apparatus 110 according to the present embodiment.

Figure 42:
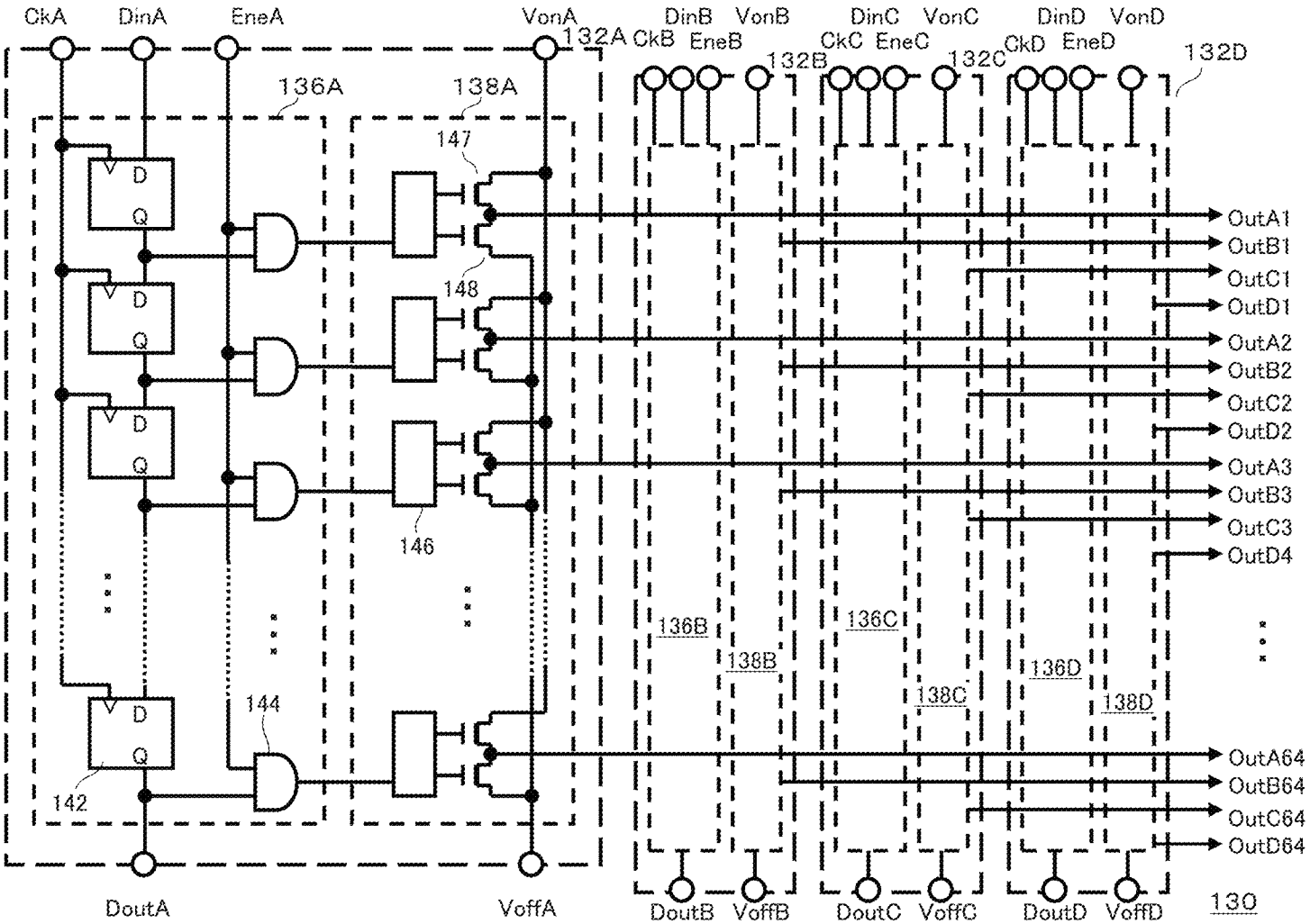
FIG. 42 is a circuit diagram of a gate driver integrated circuit according to Embodiment 2.

FIG. 42 is a circuit diagram illustrating the gate driver integrated circuit 130 of the image display apparatus 110 according to the present embodiment. A gate driver integrated circuit 130 according to the present embodiment includes four gate signal line driving units 132A, 132B, 132C, and 132D. The gate signal line driving units 132A, 132B, 132C, and 132D each have the same configuration as the gate signal line driving unit 32A of the gate driver integrated circuit 30 according to Embodiment 1.

The gate signal line driving unit 132A is connected to the clock input terminal CkA, the data input terminal DinA, the enable input terminal EneA, the data output terminal DoutA, power supply terminal VonA, the power supply terminal VoffA, and the output terminal OutAi (1≤i≤64), of the gate driver integrated circuit 130.

In the same manner as above, the gate signal line driving unit 132B is connected to the clock input terminal CkB, the data input terminal DinB, the enable input terminal EneB, the data output terminal DoutB, the power supply terminal VonB, the power supply terminal VoffB, and the output terminal OutBi, of the gate driver integrated circuit 130. The gate signal line driving unit 132C is connected to the clock input terminal CkC, the data input terminal DinC, the enable input terminal EneC, the data output terminal DoutC, the power supply terminal VonC, the power supply terminal VoffC, and the output terminal OutCi, of the gate driver integrated circuit 130. The gate signal line driving unit 132D is connected to the clock input terminal CkD, the data input terminal DinD, the enable input terminal EneD, the data output terminal DoutD, the power supply terminal VonD, the power supply terminal VoffD, and the output terminal OutDi, of the gate driver integrated circuit 130.

The data output terminals of the gate driver integrated circuit 130 are arranged in the following order: OutA1, OutB1, OutC1, OutD1, OutA2, OutB2, OutC2, OutD2, . . . , OutA64, OutB64, OutC64, and OutD64.

Figure 44:
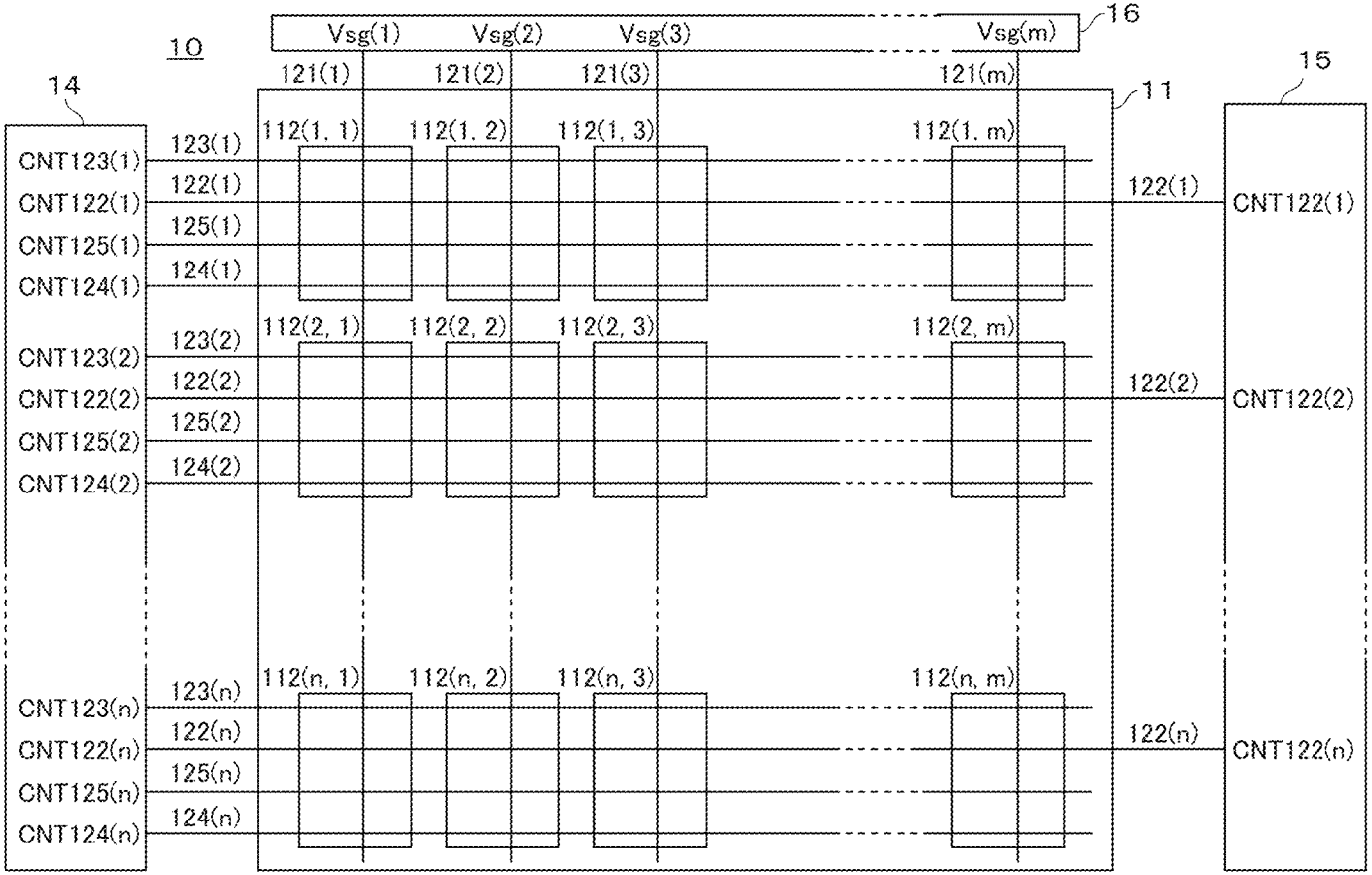
FIG. 44 is a configuration diagram of the image display apparatus according to Embodiment 2.

FIG. 43 is a configuration diagram illustrating the first gate driver circuit 114 and the second gate driver circuit 115 of the image display apparatus 110 according to the present embodiment. In addition, FIG. 44 is a schematic diagram illustrating a configuration of the image display apparatus 110 according to the present embodiment.

The image display apparatus 110 according to the present embodiment includes the display panel 111 as a display panel, and a driving circuit which drives the display panel 111. The driving circuit includes: the source driver circuit 16; the first gate driver circuit 114; the second gate driver circuit 115; and a power supply circuit (not illustrated).

It is to be noted that, the power supply terminal VonA, the power supply terminal VoffA, the power supply terminal VonB, the power supply terminal VoffB, the power supply terminal VonC, the power supply terminal VoffC, the power supply terminal VonD, and the power supply terminal VoffD are omitted in FIG. 43.

The first gate driver circuit 114 includes four gate driver integrated circuits 130(1) to 130(4), and the second gate driver circuit 115 includes a single gate driver integrate circuit 130(5). Here, the gate driver integrated circuits 130(1) to 130(5) each have the same circuit configuration as the gate driver integrated circuit 130.

The output terminals of the gate driver integrated circuits 130(1) to 130(4) mounted on the first gate driver circuit 114 are connected to gate signal lines which are drawn to the left side of the display panel 111.

According to the present embodiment, each of the gate signal lines 122(1) to 122(64) is connected to a corresponding one of the output terminals OutA1 to OutA64 of the gate driver integrated circuit 130(1). Each of the gate signal lines 123(1) to 123(64) is connected to a corresponding one of the output terminals OutB1 to OutB64 of the gate driver integrated circuit 130(1). Each of the gate signal lines 124(1) to 124(64) is connected to a corresponding one of the output terminals OutC1 to OutC64 of the gate driver integrated circuit 130(1). Each of the gate signal lines 125(1) to 125(64) is connected to a corresponding one of the output terminals OutD1 to OutD64 of the gate driver integrated circuit 130(1).

Each of the gate signal lines 122(65) to 122(128) is connected to a corresponding one of the output terminals OutA1 to OutA64 of the gate driver integrated circuit 130(2). Each of the gate signal lines 123(65) to 123(128) is connected to a corresponding one of the output terminals OutB1 to OutB64 of the gate driver integrated circuit 130(2). Each of the gate signal lines 124(65) to 124(128) is connected to a corresponding one of the output terminals OutC1 to OutC64 of the gate driver integrated circuit 130(2). Each of the gate signal lines 125(65) to 125(128) is connected to a corresponding one of the output terminals OutD1 to OutD64 of the gate driver integrated circuit 130(2).

Each of the gate signal lines 122(129) to 122(192) is connected to a corresponding one of the output terminals OutA1 to OutA64 of the gate driver integrated circuit 130(3). Each of the gate signal lines 123(129) to 123(192) is connected to a corresponding one of the output terminals OutB1 to OutB64 of the gate driver integrated circuit 130(3). Each of the gate signal lines 124(129) to 124(192) is connected to a corresponding one of the output terminals OutC1 to OutC64 of the gate driver integrated circuit 130(3). Each of the gate signal lines 125(129) to 125(192) is connected to a corresponding one of the output terminals OutD1 to OutD64 of the gate driver integrated circuit 130(3).

Each of the gate signal lines 122(193) to 122(256) is connected to a corresponding one of the output terminals OutA1 to OutA64 of the gate driver integrated circuit 130(4). Each of the gate signal lines 123(193) to 123(256) is connected to a corresponding one of the output terminals OutB1 to OutB64 of the gate driver integrated circuit 130(4). Each of the gate signal lines 124(193) to 124(256) c output terminals OutC1 to OutC64 of the gate driver integrated circuit 130(4). Each of the gate signal lines 125(193) to 125(256) is connected to a corresponding one of the output terminals OutD1 to OutD64 of the gate driver integrated circuit 130(4).

The clock input terminals CkA, CkB, CkC, and CkD of the gate driver integrated circuit 130(1), the clock input terminals CkA, CkB, CkC, and CkD of the gate driver integrated circuit 130(2), the clock input terminals CkA, CkB, CkC, and CkD of the gate driver integrated circuit 130(3), and the clock input terminals CkA, CkB, CkC, and CkD of the gate driver integrated circuit 130(4) are connected, respectively, and the first clock CK1 is supplied.

The enable input terminals EneA, EneB, EneC, and EneD of the gate driver integrated circuit 130(1), the enable input terminals EneA, EneB, EneC, and EneD of the gate driver integrated circuit 130(2), the enable input terminals EneA, EneB, EneC, and EneD of the gate driver integrated circuit 130(3), and the enable input terminals EneA, EneB, EneC, and EneD of the gate driver integrated circuit 130(4) are connected, respectively, and the enable signal EN1 is supplied.

Each of the data output terminals DoutA, DoutB, DoutC, and DoutD of the gate driver integrated circuit 130(1) is connected to a corresponding one of the data input terminals DinA, DinB, DinC, and DinD of the gate driver integrated circuit 130(2). Each of the data output terminals DoutA, DoutB, DoutC, and DoutD of the gate driver integrated circuit 130(2) is connected to a corresponding one of the data input terminals DinA, DinB, DinC, and DinD of the gate driver integrated circuit 130(3). Each of the data output terminals DoutA, DoutB, DoutC, and DoutD of the gate driver integrated circuit 130(3) is connected to a corresponding one of the data input terminals DinA, DinB, DinC, and DinD of the gate driver integrated circuit 130(4).

In such a manner as described above, the gate driver integrated circuits 130(1) to 130(4) are connected in a cascade arrangement.

The signal DI1 is supplied to the data input terminal DinA of the gate driver integrated circuit 130(1). The signal DI2 is supplied to the data input terminal DinB of the gate driver integrated circuit 130(1). The signal DI3 is supplied to the data input terminal DinC of the gate driver integrated circuit 130(1). The signal DI4 is supplied to the data input terminal DinD of the gate driver integrated circuit 130(1).

In addition, although omitted in FIG. 43, the power supply terminals VonA of the gate driver integrated circuits 30(1) to 30(4) are mutually connected, and the voltage V122on is supplied. The power supply terminals VoffA of the gate driver integrated circuits 30(1) to 30(4) are mutually connected and supplied with the voltage V122off. The power supply terminals VonB of the gate driver integrated circuits 30(1) to 30(4) are mutually connected, and the voltage V123on is supplied. The power supply terminals VoffB of the gate driver integrated circuits 30(1) to 30(4) are mutually connected and supplied with the voltage V123off. The power supply terminals VonC of the gate driver integrated circuits 30(1) to 30(4) are mutually connected, and the voltage V124on is supplied. The power supply terminals VoffC of the gate driver integrated circuits 30(1) to 30(4) are mutually connected and supplied with the voltage V124off. The power supply terminals VonD of the gate driver integrated circuits 30(1) to 30(4) are mutually connected, and the voltage V125on is supplied. The power supply terminals VoffD of the gate driver integrated circuits 30(1) to 30(4) are mutually connected and supplied with the voltage V125off.

Meanwhile, the gate signal lines 122(1) to 122(256) which are drawn to the right side of the display panel 111 are connected to the gate driver integrated circuit 130(5) mounted on the second gate driver circuit 115.

According to the present embodiment, among the gate signal lines 122(1) to 122(256), the (a multiple of 4+1)th gate signal line 122(1) is connected to the output terminal OutA1 of the gate driver integrated circuit 130(5). The gate signal line 122(5) is connected to the output terminal OutA2 of the gate driver integrated circuit 130(5). The gate signal line 122(9) is connected to the output terminal OutA3 of the gate driver integrated circuit 130(5), . . . , and the gate signal line 122(253) is connected to the output terminal OutA64 of the gate driver integrated circuit 130(5).

The (a multiple of 4+2)th gate signal line 122(2) is connected to the output terminal OutB1 of the gate driver integrated circuit 130(5). The gate signal line 122(6) is connected to the output terminal OutB2 of the gate driver integrated circuit 130(5). The gate signal line 122(10) is connected to the output terminal OutB3 of the gate driver integrated circuit 130(5), . . . , and the gate signal line 122(254) is connected to the output terminal OutB64 of the gate driver integrated circuit 130(5).

The (a multiple of 4+3)th gate signal line 122(3) is connected to the output terminal OutC1 of the gate driver integrated circuit 130(5). The gate signal line 122(7) is connected to the output terminal OutC2 of the gate driver integrated circuit 130(5). The gate signal line 122(11) is connected to the output terminal OutC3 of the gate driver integrated circuit 130(5), . . . , and the gate signal line 122(255) is connected to the output terminal OutC64 of the gate driver integrated circuit 130(5).

The (a multiple of 4)th gate signal line 122(4) is connected to the output terminal OutD1 of the gate driver integrated circuit 130(5). The gate signal line 122(8) is connected to the output terminal OutD2 of the gate driver integrated circuit 130(5). The gate signal line 122(12) is connected to the output terminal OutD3 of the gate driver integrated circuit 130(5), . . . , and the gate signal line 122(256) is connected to the output terminal OutD64 of the gate driver integrated circuit 130(5).

The clock input terminals CkA, CkB, CkC, and CkD of the gate driver integrated circuit 130(5) are mutually connected and supplied with the second clock CK2. In addition, the enable input terminal EneA of the gate driver integrated circuit 130(5) is supplied with the enable signal EN2. The enable input terminal EneB is supplied with the enable signal EN3. The enable input terminal EneC is supplied with the enable signal EN4. The enable input terminal EneD is supplied with the enable signal EN5. The data input terminals DinA, DinB, DinC, and DinD of the gate driver integrated circuit 130(5) are mutually connected and supplied with the signal DI5 for generating the write controlling signals CNT122(1) to CNT122(256).

Although omitted in FIG. 43, the power supply terminals VonA, VonB, VonC, and VonD of the gate driver integrated circuits 30(5) are mutually connected and supplied with the voltage V122on. The power supply terminals VoffA, VoffB, VoffC, and VoffD are mutually connected and supplied with the voltage V122off.

The following describes an operation of the first gate driver circuit 114 and the second gate driver circuit 115.

The first clock CK1 having a cycle of 1 μs is supplied to the clock input terminals CkA, CkB, CkC, and CkD of the gate driver integrated circuits 130(1) to 130(4) of the first gate driver circuit 114, and the enable input terminal EneA is fixed to a high level.

The data input terminal DinA of the gate driver integrated circuit 130(1) is supplied with the signal DI1 for generating the write controlling signals CNT122(1) to CNT122(256). The data input terminal DinB of the gate driver integrated circuit 130(1) is supplied with the signal DI2 for generating the display controlling signals CNT123(1) to CNT123(256). The data input terminal DinC of the gate driver integrated circuit 130(1) is supplied with the signal DI3 for generating the control signals CNT124(1) to CNT124(256). The data input terminal DinD of the gate driver integrated circuit 130(1) is supplied with the signal DI4 for generating the control signals CNT125(1) to CNT125(256).

Each of the signals DI1, DI2, DI3, and DI4 is shifted every time the clock CK1 is supplied to the clock terminals of the gate driver integrated circuits 130(1) to 130(4), and corresponding control signals are outputted. As described above, the write controlling signals CNT122(1) to CNT122(256) which are the first control signals are outputted from the output terminals OutA1 to OutA64 of the gate driver integrated circuits 30(1) to 130(4). The display controlling signals CNT123(1) to CNT123(256) are outputted from the output terminals OutB1 to OutB64. The control signals CNT124(1) to CNT124(256) are outputted from the output terminals OutC1 to OutC64. The control signals CNT125(1) to CNT125(256) are outputted from the output terminals OutD1 to OutD64.

Figure 45:
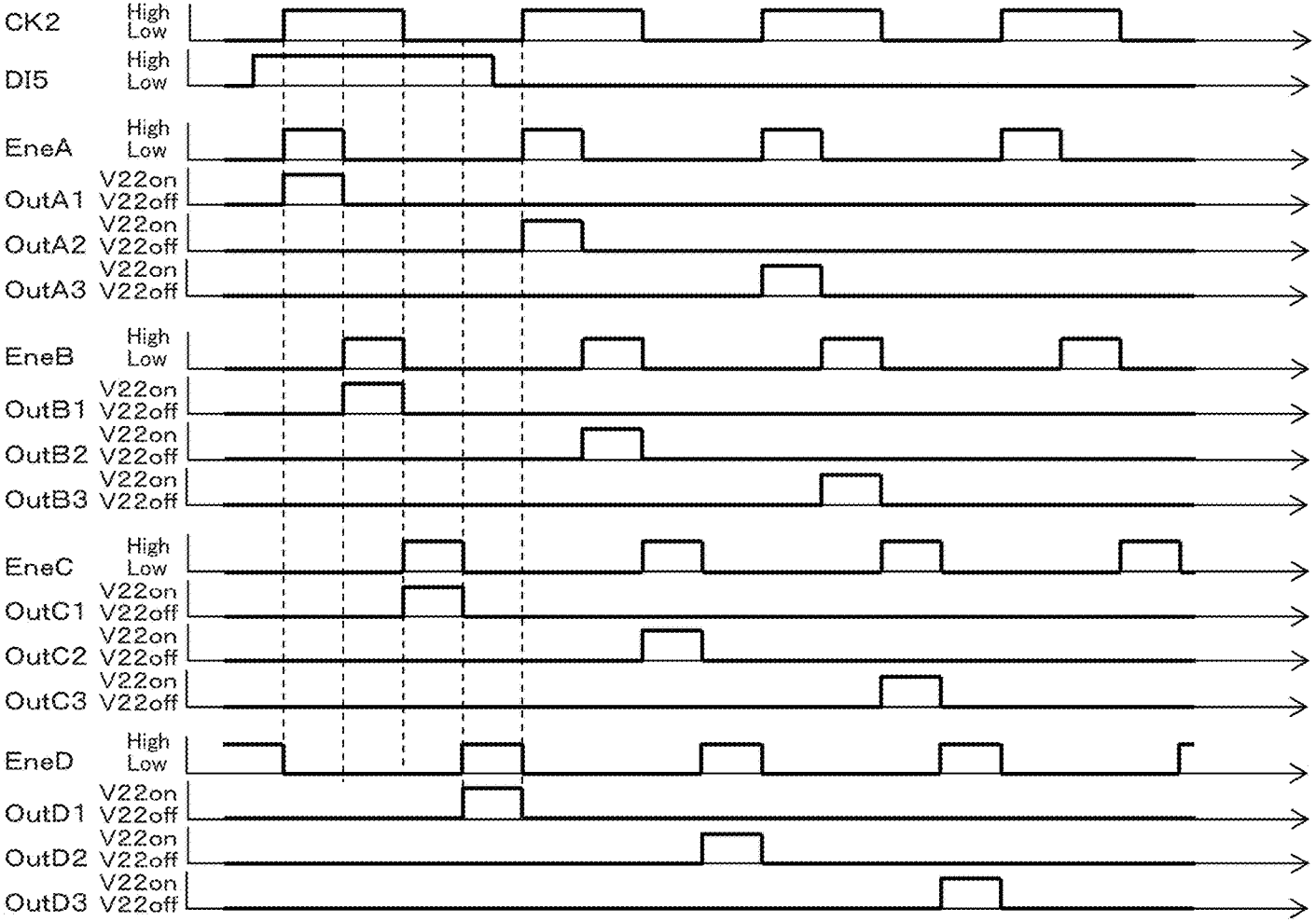
FIG. 45 is a timing chart illustrating an operation of the second gate driver circuit according to Embodiment 2.

FIG. 45 is a timing chart illustrating an operation of the second gate driver circuit 115 of the image display apparatus 110 according to the present embodiment.

The second clock CK2 having a cycle of 4 μs that is a quadruple of the clock CK1 is supplied to the clock input terminals CkA, CkB, CkC, and CkD of the gate driver integrated circuit 130(5). The data input terminals DinA, DinB, DinC, and DinD of the gate driver integrated circuit 130(5) are supplied with the signal DI5 for generating the write controlling signals CNT122(1) to CNT122(256).

The enable input terminal EneA is supplied with the enable signal EN2 which has: the same cycle as the clock CK2; a duty of ¼; and the same timing of rising as the clock CK2. The enable input terminal EneB is supplied with the enable signal EN3 which is delayed from the enable signal EN2 by 90°. The enable input terminal EneC is supplied with the enable signal EN4 which is delayed from the enable signal EN3 further by 90°. The enable input terminal EneD is supplied with an enable signal which is delayed from the enable signal EN4 further by 90°.

The gate driver integrated circuit 130(5) shifts the signal DI5 every time the clock CK2 is supplied. Then, a logical AND with the enable signal EN2 is obtained, and the second write controlling signals CNT22(1), CNT22(5), . . . , to CNT22(253) are outputted. A logical AND with the enable signal EN3 is obtained, and the second write controlling signals CNT22(2), CNT22(6), . . . , CNT22(254) are outputted. A logical AND with the enable signal EN4 is obtained, and the second write controlling signals CNT22(3), CNT22(7), . . . , CNT22(255) are outputted. A logical AND with the enable signal EN5 is obtained, and the second write controlling signals CNT22(4), CNT22(8), . . . , CNT22(256) are outputted.

According also to Embodiment 2 as described above, the first gate driver circuit 114 includes the gate driver integrated circuits 130(1) to 130(4) which are connected in the cascade arrangement, thereby includes the first shift register units each having at least the same number of stages as the number of pixel circuit rows included in the display panel; that is, the shift register unit 136A of each of the gate driver integrated circuits 130(1) to 130(4) connected in the cascade arrangement, and supplies the first control signal (write controlling signal CNT122(*i*)) generated by the first shift register unit using the first clock CK1 to each of the first gate signal lines (gate signal lines 122(*i*)) from one side of the pixel circuit rows.

In addition, the second gate driver circuit 115 includes N second shift registers (N=4, in the present embodiment) each having the length corresponding to at least 1/N of the number of the pixel circuit rows included in the display panel (i.e., the shift register units 136A, 136B, 136C, and 136D of the gate driver integrated circuit 130(5)), and supplies, from the other side of the pixel circuit rows, each of the first gate signal lines (gate signal lines 122(*i*)) with the first control signal (write controlling signal CNT122(*i*)) generated by each of the second shift register units using the second clock CK2 having the Nth cycle of the first clock CK1.

As described above, in the case where M types of gate signal lines are formed for each of the pixel circuits, and among the M types of gate signal lines, the bilateral driving is applied to S types of gate signal lines, and the unilateral driving is applied to (M−S) types of gate signal lines, it is possible to realize the design which satisfies (the number of gate driver integrated circuits used in the first gate driver circuit):(the number of gate driver integrated circuits used in the second gate driver circuit)=M:S.

It is to be noted that, although the gate signal line 124(*i*) is applied with the bilateral driving and the other gate signal lines 123(*i*), 124(*i*), and 125(*i*) are applied with the unilateral driving according to the above-described embodiment, the present disclosure is not limited to this.

Figure 46:
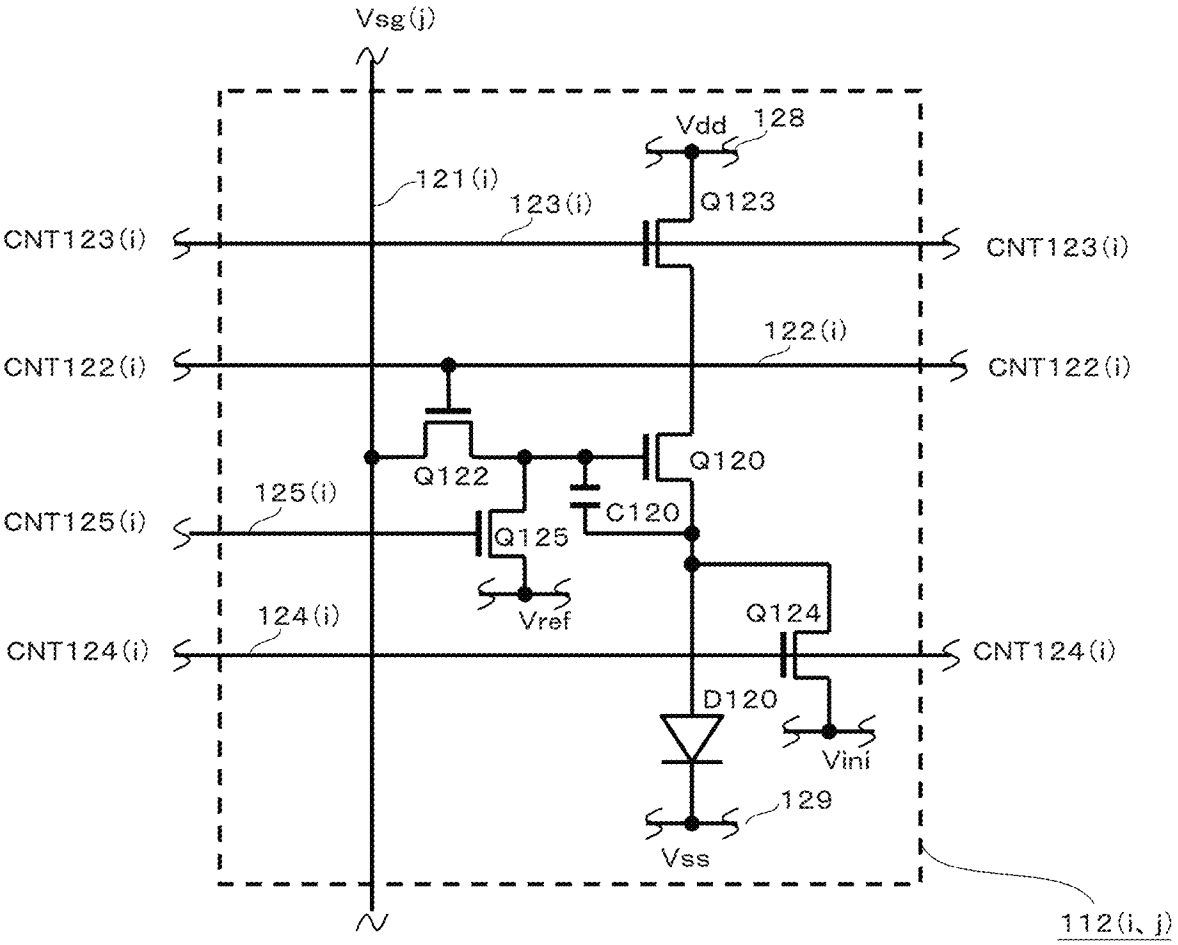
FIG. 46 is a circuit diagram illustrating the pixel circuit of the image display apparatus according to Embodiment 2.

For example, as illustrated in FIG. 46, the gate signal line 125(*i*) may be applied with the unilateral driving by the gate driver circuit 14, and the other gate signal lines 123(*i*), 122(*i*), and 124(*i*) may be applied with the bilateral driving by the first gate driver circuit 14 and the second gate driver circuit 15, in the pixel circuit 112(*i, j*). It is to be noted that, it is preferable that the gate signal line 122(*i*) is applied with the gate voltage ternary driving.

In the case of the pixel configuration illustrated in FIG. 46, the ratio of the number of the first gate driver circuits 14 (gate driver integrated circuits 30) disposed to the left of the display screen to the number of the second gate driver circuits 15 (gate driver integrated circuits 30) disposed to the right of the display screen is 4:3.

It should be understood that, according also to the exemplary embodiment illustrated in FIG. 40 and FIG. 43, the driving system described in FIG. 45 and the like can be implemented by employing the gate driver circuit or the gate driver integrated circuit according to the present disclosure illustrated in FIG. 19 and FIG. 21, or by applying the configuration illustrated in FIG. 21. It should also be understood that the description related to the terminal Sel, the terminal Ct, etc. can be applied as well.

Embodiment 3

Figure 47:
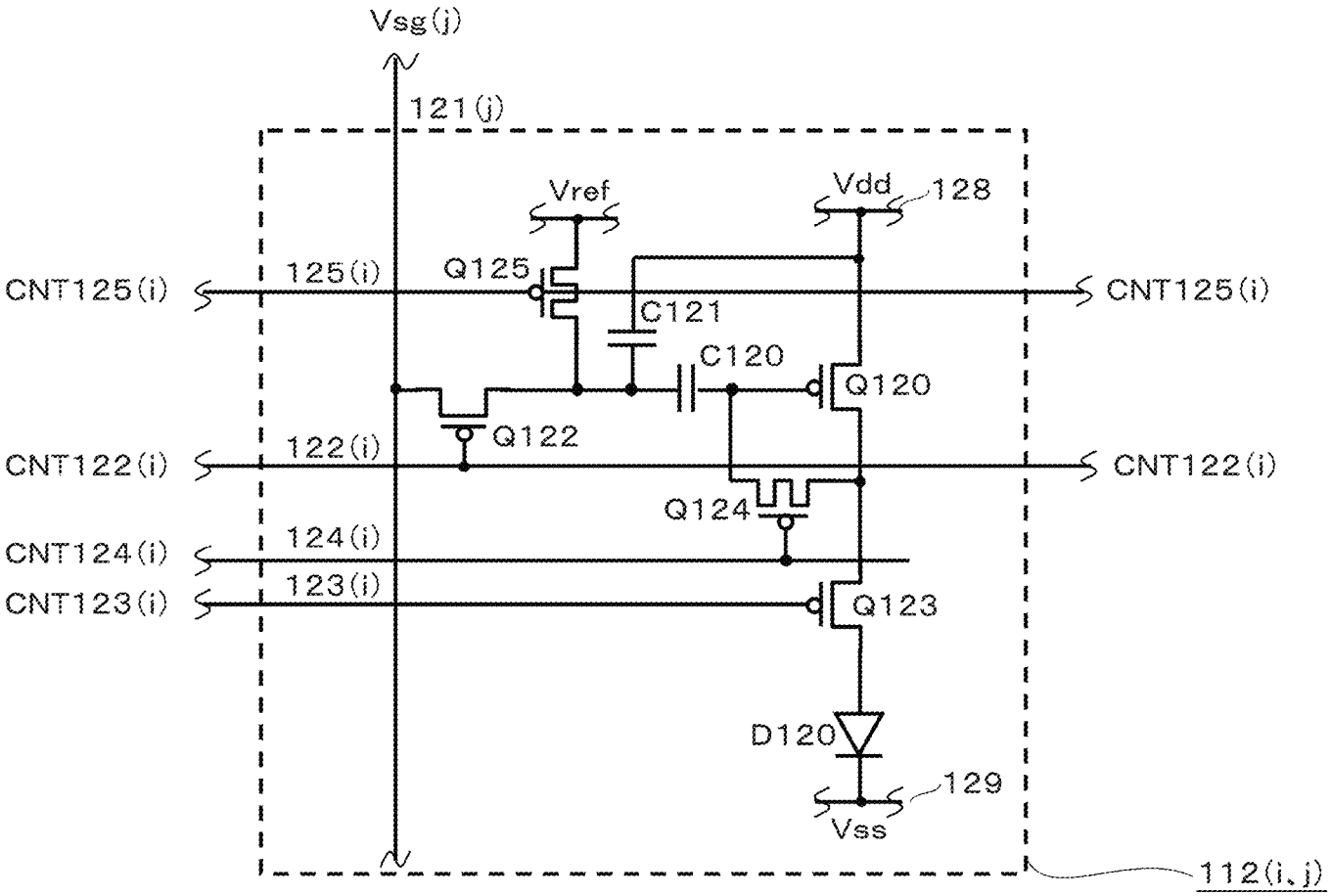
FIG. 47 is a circuit diagram illustrating a pixel circuit according to Embodiment 3.
Figure 48:
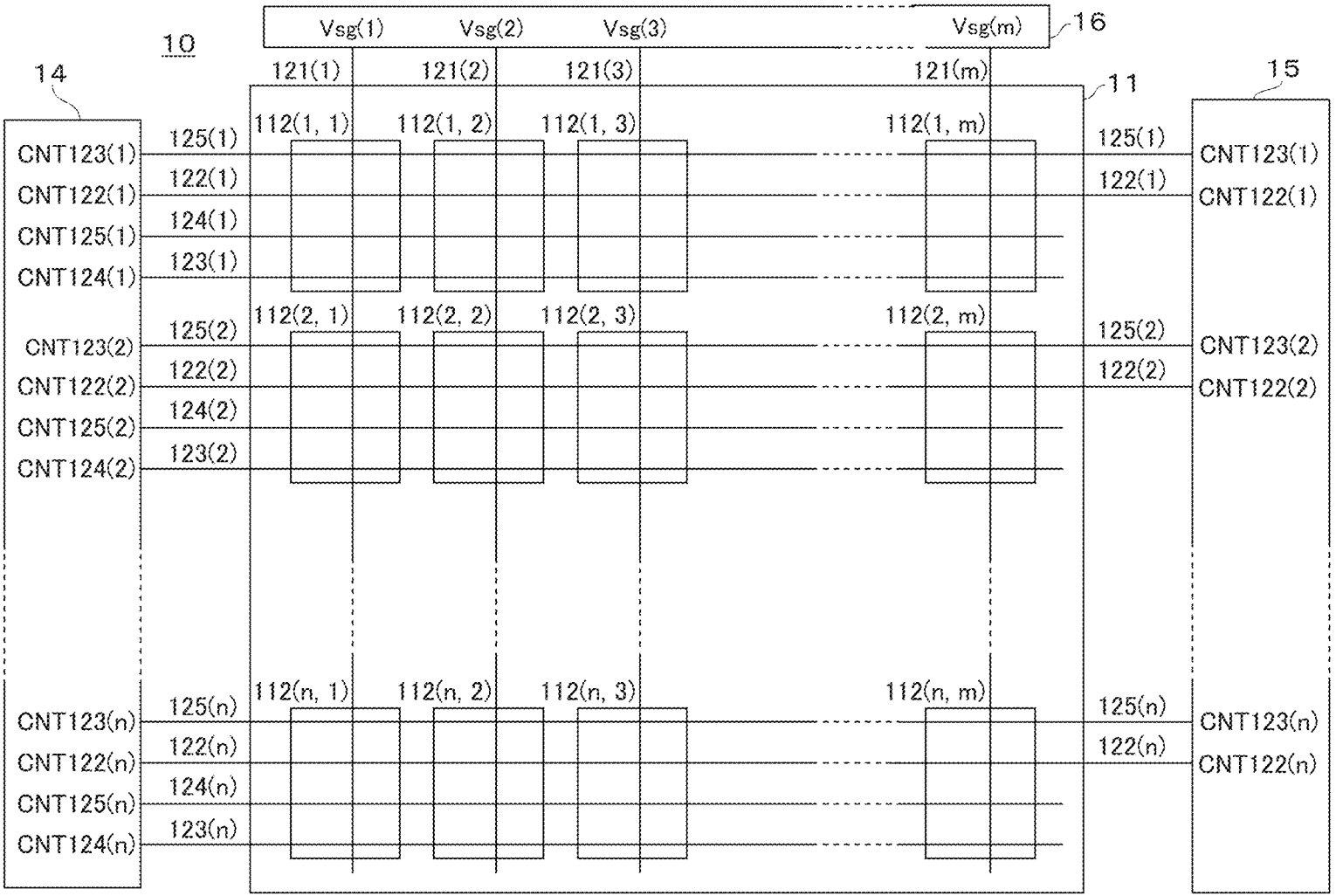
FIG. 48 is a configuration diagram of an image display apparatus according to Embodiment 3.

The following describes an example of an image display apparatus including the display panel in which a plurality of pixel circuits are disposed each of which includes two gate signal lines to which the bilateral driving is applied and two gate signal lines to which the unilateral driving is applied. FIG. 47 is a schematic diagram illustrating a configuration of a pixel of the image display apparatus 10 according to the present embodiment. FIG. 48 is a schematic diagram illustrating a configuration of the image display apparatus 10 according to the present embodiment.

The image display apparatus 10 according to the present embodiment includes the display panel 11 and a driving circuit which drives the display panel 11. The driving circuit includes: the source driver circuit 16; the first gate driver circuit 14; the second gate driver circuit 15; and a power supply circuit (not illustrated).

In addition, as illustrated in FIG. 47, four gate signal lines (122(*i*), 123(*i*), 124(*i*), and 125(*i*)) are formed in the pixel circuit 112(*i, j*). The first gate driver circuit 14 is disposed for the gate signal lines 122(*i*), 123(*i*), 124(*i*), and 125(*i*), and the first gate driver circuit 14 and the second gate driver circuit 15 are disposed for the gate signal lines 122(*i*) and 125(*i*).

Accordingly, the gate signal lines 125(*i*) and 122(*i*) are applied with the bilateral driving by the first gate driver circuit 14 and the second gate driver circuit 15. In addition, the gate signal line 122(*i*) is applied with the gate voltage ternary driving. It is to be noted that, the other gate signal lines 125(*i*), 124(*i*), and 123(*i*) are applied with the gate voltage ternary driving. The gate signal lines 124(*i*) and 123(*i*) are applied with the bilateral driving by the first gate driver circuit 14.

In the pixel circuit 122(*i, j*) illustrated in FIG. 47, the first terminal of the P-channel driving transistor Q120 is connected to an electrode or a line of the anode voltage Vdd, and the second terminal is connected to the first terminal of the switching transistor Q123. In addition, the gate terminal of the switching transistor Q123 is connected to the gate signal line 123(*i*). The second terminal of the switching transistor Q123 is connected to the first terminal of the EL element D120. In addition, the second terminal of the EL element D120 is connected to an electrode or a line to which the cathode voltage Vss is applied.

It is to be noted that, although the transistor is a P-channel transistor in FIG. 47, the transistor is not limited to this, and the transistor may be an N-channel transistor. In addition, the pixel circuit 112(*i, j*) may include both of the P-channel and N-channel transistors.

The first terminal of the switching transistor Q125 is connected to an electrode or a line to which the reset voltage Vref is applied, and the second terminal of the switching transistor Q125 is connected to the gate terminal of the driving transistor Q120. In addition, the gate terminal of the switching transistor Q125 is connected to the gate signal line 125(*i*).

The first terminal of the switching transistor Q122 which applies a video signal to a pixel is connected to the source signal line 121(*j*), and the second terminal of the switching transistor Q122 is connected to the first terminal of the second capacitor C120. In addition, the second terminal of the second capacitor C120 is connected to the gate terminal of the driving transistor Q120. In addition, the gate terminal of the switching transistor Q122 is connected to the gate signal line 122(*i*).

The first terminal of the first capacitor C121 is connected to the anode voltage Vdd, the second terminal of the first capacitor C121 is connected to the first terminal of the second capacitor or the gate terminal of the driving transistor Q120.

The first terminal of the switching transistor Q124 is connected to the gate terminal of the driving transistor Q120, and the second terminal of the switching transistor Q124 is connected to the second terminal of the driving transistor Q120. In addition, the gate terminal of the switching transistor Q124 is connected to the gate signal line 123(*i*).

A multigate (at least a dual gate) configuration is employed for at least one of the transistors Q125 and Q124, and the LDD (lightly doped drain) configuration is further combined thereto. With this configuration, it is possible to suppress off-leakage, and thus excellent contrast and offset cancelling operation can be implemented. In addition, excellent high-luminance display and image display can be implemented.

The gate signal lines 125(*i*) and 122(*i*) are applied with the bilateral driving by the first gate driver circuit 14 and the second gate driver circuit 15. The gate signal lines 124(*i*) and 123(*i*) are applied with the unilateral driving by the gate driver circuit 14.

In FIG. 47, the bilateral driving is performed on the gate signal line 122(*i*) to which the switching transistor Q122 that applies a video signal to the pixel circuit 112(*i, j*) is connected. In addition, the bilateral driving is performed on the gate signal line 123(*i*) to which the switching transistor Q125 that performs operation or control when the offset cancelling operation of the driving transistor Q120 is performed.

It should be understood that the driving system of the present disclosure can be applied to the pixel circuit configuration illustrated in, for example, FIG. 47. It should also be understood that it is possible to combine the present embodiment with other embodiments.

For example, it is possible to apply the embodiment illustrated in FIG. 9, FIG. 16, FIG. 18, FIG. 19, FIG. 20, and FIG. 42 to the first gate driver circuit 14 and the second gate driver circuit 15 illustrated in FIG. 48. In addition, it is possible to apply the panel configuration illustrated in FIG. 3, FIG. 10, FIG. 11, FIG. 15, FIG. 20, FIG. 21, FIG. 33, FIG. 34, FIG. 35, FIG. 36, FIG. 37, FIG. 43, FIG. 44, and FIG. 48. Furthermore, it is possible to apply the driving method described in FIG. 17 and FIG. 22. In addition, it is possible to apply the driving system illustrated in FIG. 5, FIG. 8, FIG. 12, FIG. 13, FIG. 14, FIG. 23, FIG. 24, FIG. 25, FIG. 26, FIG. 27, FIG. 28, FIG. 29, FIG. 30, FIG. 31, FIG. 32, FIG. 38, FIG. 39, FIG. 45, FIG. 49, FIG. 50, FIG. 51, FIG. 52, and FIG. 53.

(Others)

It should be understood that the above-described explanation can be applied to the configuration of not only the above-described pixel circuit but also other pixel circuits. Furthermore, the above-described explanation can be applied to other driving systems and image display apparatuses described in the present disclosure. It should also be understood that it is possible to apply the image display of the present disclosure to electronic devices illustrated in FIG. 54, FIG. 55, and FIG. 56, or to combine them.

As one example, the image display apparatus according to the present disclosure includes: the first gate driver circuit; the second gate driver circuit; and the source driver circuit which supplies a video signal to the source signal lines. The first gate driver circuit is connected to one end of the first gate signal lines, and the second gate driver circuit is connected to the other end of the gate signal lines, to apply the bilateral driving to the gate signal lines. Furthermore, a single gate driver circuit is connected to one end of the gate signal line which does not require a particularly high slew rate, and the unilateral driving is applied thereto.

Furthermore, as one example, in the image display apparatus according to the present disclosure, with respect to a pixel circuit including n gate signal lines for a pixel, a first gate driver circuit is connected to the n gate signal lines of each of the pixels, and a second gate driver circuit is connected to, among the n gate signal lines, m gate signal lines (m is an integer not less than one and smaller than n).

Furthermore, as one example, in the image display apparatus according to the present disclosure, the first gate driver circuit and the second gate driver circuit each have n shift register circuits, the first to nth shift register circuits of the first gate driver circuit are each electrically connected to the first to nth gate signal lines of one pixel row, and the first to nth shift register circuits of the second gate driver circuit are electrically connected to gate signal lines of two or more of the pixel rows.

Furthermore, as one example, the gate signal line driving unit according to the present disclosure includes: first shift register units each having at least the same number of stages as the number of pixel circuit rows; the first gate driver circuit 14 which supplies the first control signal generated by the first shift register units using the first clock CK1 to each of the first gate signal lines 22(*i*) from one side of the pixel circuit rows; N second first shift register units each having the length corresponding to at least 1/N of the number of the pixel circuit rows (N is an integer not less than two); and the second gate driver circuit 15 which supplies, from the other side of the pixel circuit rows, the first control signal generated by each of the second shift register units using the second clock CK2 having a Nth cycle of the first clock, to each of the first gate signal lines 22(*i*).

The image display apparatus and the driving system for the image display apparatus are applicable to wide variety of applications. For example, the display panel illustrated in FIG. 33 is an image display panel including four gate signal lines formed (disposed) in each of the pixel circuits 112(*i*). The first gate driver circuit 14 and the second gate driver circuit 15 perform the bilateral driving to one of the four gate signal lines, and the first gate driver circuit 14 performs the unilateral driving to the other three gate signal lines.

FIG. 34 is a diagram explaining FIG. 33. In FIG. 34, the gate driver integrated circuits 130(1), 130(2), 130(3), and 130(4) of the first gate driver circuit 14 and the gate driver integrated circuit 130(5) of the gate driver circuit 15 are arranged as one segment.

When the number of the gate driver integrated circuits 130 included in the first gate driver circuit 14 is a, and the number of the gate driver integrated circuits 130 included in the second gate driver circuit 15 is b, the relation is expressed as a:b=4:1. In addition, when the number of the gate signal lines of the pixel circuit is c, the number of the shift registers or the gate signal line driving units included in the gate driver integrate circuit 130 is expressed as c=4.

As described above, the image display apparatus according to the present disclosure includes a display screen including pixel circuits arranged in a matrix, and a gate driver circuit which drives the display screen. The first gate driver circuit 14 and the second gate driver circuit 15 are disposed respectively on the left side and the right side of the display screen. In addition, the pixel circuits each include a plurality of gate signal lines, at least one gate signal line among the plurality of gate signal lines is driven by the first gate driver circuit 14 and the second gate driver circuit 15 disposed respectively on the left side and right side, and the other one of the gate signal lines is driven by one of the first gate driver circuit 14 and the second gate driver circuit 15 disposed respectively on the left side and right side.

Here, when the gate driver circuit disposed on the left side is the first gate driver circuit 14 and the gate driver circuit disposed on the right sided is the second gate driver circuit 15, the image display apparatus according to the present disclosure has the configuration described below.

The second gate driver circuit 15 includes: a first shift register unit having the same number of stages as the number of effective pixel circuits of the display screen; and a first gate signal line driving unit which supplies, from one side of the pixel circuit rows, each of the first gate signal lines with a first control signal generated by the first shift register unit. It is to be noted that the number of effective pixel circuit rows of the display screen is the number of pixel circuits which perform image display, or the number of pixel circuit rows which require driving by the gate driver circuit.

The first gate driver circuit 14 includes N second shift register units each having the length corresponding to at least 1/N (N is an the integer not less than two) of the number of effective pixel circuit rows of the display screen, and a second gate signal line driving unit which supplies, from the other side of the pixel circuit rows, each of the first gate signal lines with the first control signal generated in each of the second shift register units.

It is to be noted that, when the gate driver circuit includes a plurality of gate driver circuits, the length of the shift register is divided by the length of the shift register included in the gate driver circuit.

The effective pixel (row) is a pixel row which contributes to image display. A dummy pixel (row) which does not contribute to image display is not included, for example. However, a dummy pixel (row) which requires driving by the driver IC is included as the effective pixel (row).

It should be understood that, when the number of rows of the effective pixel circuits of the display screen is not a multiples of the number of the output terminals of the gate driver circuit, the number of necessary gate driver circuits increases.

With this configuration, it is possible to provide an image display apparatus including a gate driver integrated circuit which is highly versatile and can be used irrespective of the number and arrangement of terminals of the gate signal lines and irrespective of the specification or the like of the image display apparatus. In addition, a driving system most suitable to the configuration of the pixel circuit can be performed, and thus it is possible to realize excellent image display.

It should also be understood that the description presented in the Description of the present disclosure can be applied to the image display apparatus according to the present disclosure illustrated in FIG. 33 and FIG. 34. For example, it is exemplified that the description related to the terminal Sel and the terminal CT can be applied. The above-stated description is true also for the other embodiments according to the present disclosure.

FIG. 35 illustrates an image display panel including four gate signal lines formed (disposed) in each of the pixel circuits 112(*i*). The first gate driver circuit 14 and the second gate driver circuit 15 perform the bilateral driving to three of the four gate signal lines, and the first gate driver circuit 14 performs the unilateral driving to the other gate signal line. For example, FIG. 46 illustrates the pixel circuit as an example.

When the number of the gate driver integrated circuits 130 included in the first gate driver circuit 14 is a, and the number of the gate driver integrated circuits 130 included in the second gate driver circuit 15 is b, the relation is expressed as a:b=4:3. In addition, when the number of the gate signal lines of the pixel circuit is c, the number of shift registers or the gate signal line driving units included in the gate driver integrate circuit 130 is expressed as c=4.

Although the number of the gate signal lines in a pixel circuit is even according to the embodiments described above, the present disclosure is not limited to this.

FIG. 36 illustrates an image display panel including three gate signal lines formed (disposed) in each of the pixel circuits 112(*i*). The first gate driver circuit 14 and the second gate driver circuit 15 perform the bilateral driving to one of the three gate signal lines, and the first gate driver circuit 14 performs the unilateral driving to the other two gate signal lines.

When the number of the gate driver integrated circuits 130 included in the first gate driver circuit 14 is a, and the number of the gate driver integrated circuits 130 included in the second gate driver circuit 15 is b, the relation is expressed as a:b=3:1. In addition, when the number of the gate signal lines of the pixel circuit is c, the number of shift registers or the gate signal line driving units included in the gate driver integrate circuit 130 is expressed as c=3.

Likewise, FIG. 37 illustrates an image display panel including three gate signal lines formed (disposed) in each of the pixel circuits 112(*i*). The first gate driver circuit 14 and the second gate driver circuit 15 perform the bilateral driving to two of the three gate signal lines, and the first gate driver circuit 14 performs the unilateral driving to the other one of the gate signal lines.

When the number of the gate driver integrated circuits 130 included in the first gate driver circuit 14 is a, and the number of the gate driver integrated circuits 130 included in the second gate driver circuit 15 is b, the relation is expressed as a:b=3:2. In addition, when the number of the gate signal lines of the pixel circuit is c, the number of shift registers or the gate signal line driving units included in the gate driver integrate circuit 130 is expressed as c=3.

It should be understood that the above-described embodiment can also be applied to the other embodiments according to the present disclosure. It should also be understood that it is possible to combine the present embodiment with other embodiments.

In addition, the configurations of the pixel circuit, and the numerical values of voltages, time, etc. illustrated in Embodiments 1, 2, and 3 are presented as examples, and it is desirable to optimally set the configuration of the pixel circuit or the numerical values according to the characteristics of the EL element, the specification of the image display apparatus, and the like.

It is to be noted that it is possible to dispose a circularly polarizing plate (circularly polarizing film) (not illustrated) on the light emitting face of the display apparatus. A polarization plate and a phase film are integrated into a circularly polarizing plate (circularly polarizing film).

It is to be noted that, although the light-emitting element is an EL element according to the present disclosure, the light-emitting element is not limited to this. It should also be understood that the technical idea of the present disclosure can be applied to, for example, a surface-conduction electron-emitter display (SED) and an electric field emission display (FED).

Furthermore, the present disclosure is not limited to a self-luminous display such as an EL display panel. It should be understood that the technical idea of the present disclosure can be applied to an image display apparatus in which a plurality of gate signal lines are disposed in a pixel circuit, the bilateral driving is performed on at least one of the plurality of gate signal lines, and the unilateral driving is performed on at least one of the other gate signal lines.

Furthermore, it should be understood that the technical idea of the present disclosure can be applied to a gate driver circuit (circuit) including a plurality of shift register circuits corresponding to a plurality of gate signal lines disposed on the pixel circuit.

In addition, it should be understood that the technical idea of the present disclosure can be applied to an image display apparatus in which a plurality of gate signal lines are disposed on the pixel circuit, the first gate driver circuit 14 is disposed to one side of a display screen, and the second gate driver circuit 15 is disposed to the other side of the display screen.

In addition, although the transistor Q including a driving transistor and a switching transistor is a thin film transistor (TFT) as described in FIG. 2, the transistor Q is not limited to this. The transistor Q can be configured of a thin-film diode (TFD), a ring diode, etc. as well.

The transistor Q may, of course, be an FET, a MOS-FET, a MOS transistor, or a bipolar transistor. These are also, basically, thin-film transistors. It should be understood that the transistor Q may be a varistor, a thyristor, a ring diode, a photodiode, a photo transistor, a PLZT element, etc.

In addition, the transistor Q is not limited to a thin-film element but may be a transistor formed on a silicon wafer. For example, a transistor formed using a silicon wafer, removed and transferred onto a glass substrate is exemplified. In addition, a display panel on which a transistor chip formed using a silicon wafer is mounted by bonding on a glass substrate is exemplified.

It is to be noted that either an n-type or a p-type transistor Q can be included in the pixel circuit. It is preferable that the transistor Q has an LDD configuration.

Furthermore, the transistor Q may be any one of those formed using: high-temperature polycrystalline silicon (HTPS); low-temperature poly silicon (LTPS); continuous grain silicon (CGS); transparent amorphous oxide semiconductor (TAOS, IZO); amorphous silicon (AS); and infrared rapid thermal annealing (RTA). In addition, the first gate driver circuit 14, the second gate driver circuit 15, and the source driver circuit 16 are not limited to those formed using semiconductor chips, but may be directly formed on a substrate on which the pixel circuit is formed using the above-described polysilicon techniques or the like.

In FIG. 2, transistors Q included in a pixel are all formed in, for example, a p-type. However, the transistors Q of the pixel are not limited to the p-type transistors according to the present disclosure. The transistors Q may be formed of only the n-type transistors or only the p-type transistors. In addition, the pixel circuit 12 may be configured using both of the n-type and the p-type transistors.

The switching transistors Q (for example, Q22 and Q22) are not limited to transistors, but the switching transistors Q may be analogue switches formed using both of the p-type transistor and the n-type transistor, for example.

It is preferable that the transistor Q has a top gate structure. This is because the top gate structure reduces parasitic capacitance, and a gate electrode pattern of the top gate functions as a light shielding layer to shield light emitted from a light-emitting element D20, making it possible to reduce malfunction of a transistor or an off-leakage current.

It is preferable, in the process to be carried out, that a copper line or a copper alloy line can be employed as a line material for the gate signal line 22(*i*) or the source signal line 21(*i*), or for both of the gate signal line 22(*i*) and the source signal line 21(*i*). This is because it is possible to reduce wiring resistance between the signal lines and a larger display panel can be implemented.

It is preferable that the gate signal line 22(*i*) which is driven (controlled) by the first gate driver circuit 14 has low impedance. Accordingly, it is preferable that, in the process to be carried out, a copper line or a copper alloy line can be employed as the line material, in a composition or a structure of the gate signal line 22(*i*).

Specifically, as a technique of forming the pixel circuit 12, it is preferable that low-temperature poly silicon is employed. A transistor formed through the low-temperature poly silicon technique is easily formed into the top gate structure. With the top gate structure, parasitic capacitance is small, an n-type and a p-type transistor can be manufactured, and the copper line or the copper alloy line process can be employed in the process, and thus it is preferable that the top gate structure is used in the image display apparatus according to the present disclosure. It is preferable that, for the copper line, a three-layer structure of Ti—Cu—Ti is employed.

For the lines such as the gate signal line 22(*i*) or the source signal line 21(*i*), it is preferable that a three-layer structure of Mo—Cu—Mo is employed when the transistors Q are, for example, transparent amorphous oxide semiconductors.

Furthermore, it is possible to apply the details (or part of the details) described in each of the diagrams of the above-described embodiments, to various electronic devices. To be specific, it is possible to apply them to display units of electronic devices.

Examples of such electronic devices include: a video camera, a digital camera, a head mounted display, a navigation system, an audio reproducing device (a car audio, an audio component, etc.), a computer, a gaming device, a mobile information terminal (a mobile computer, a mobile phone, a mobile game device, a digital book, etc.), an image reproducing apparatus including a recording medium (to be specific, a device including a display capable of reproducing a recording medium of a digital versatile disc (DVD) or the like and displaying the image thereof), etc.

Figure 54:
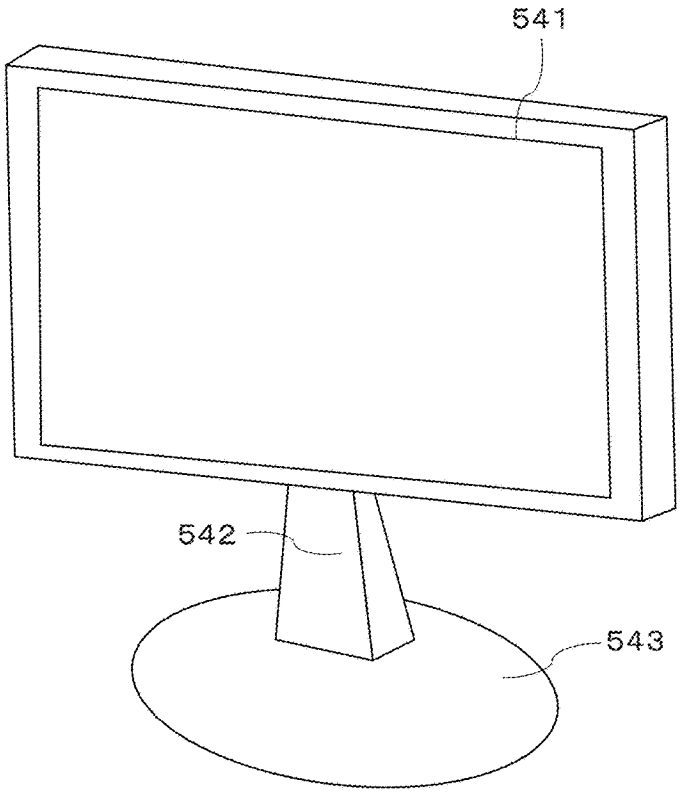
FIG. 54 is a diagram illustrating an image display apparatus.

FIG. 54 illustrates a display including: a support column 542; holding base 543; and the EL display apparatus (EL display panel) 541 according to the present disclosure. The display illustrated in FIG. 54 has a function of displaying various information items (a still image, video, a text image, etc.) on a display portion. It is to be noted that the function of the display illustrated in FIG. 54 is not limited to this, and the display can have various functions.

Figure 55:
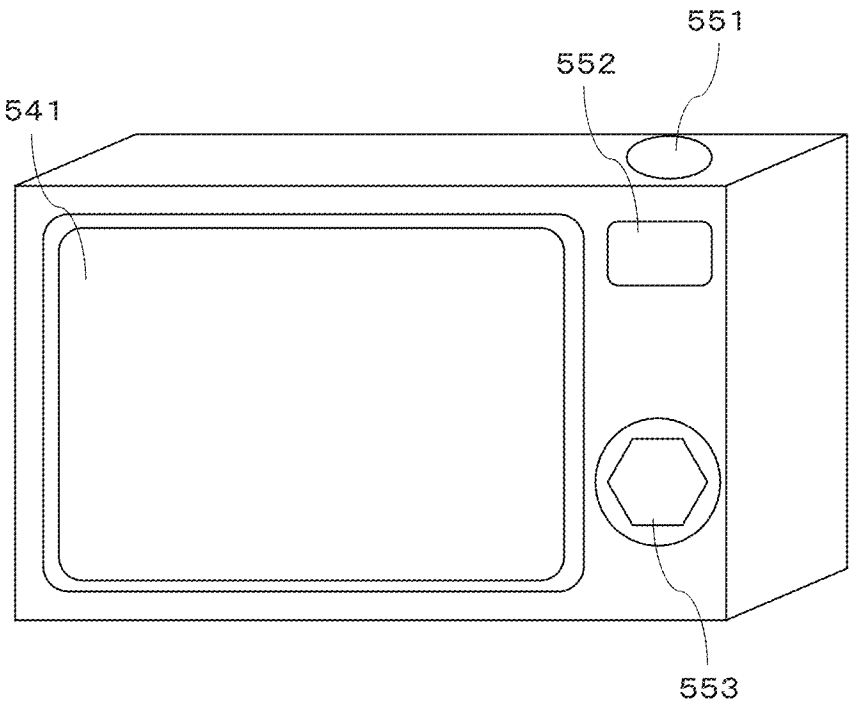
FIG. 55 is a diagram illustrating an image display apparatus.

FIG. 55 illustrates a camera including: a shutter 551; a viewfinder 552; and a cursor 553. The camera illustrated in FIG. 55 has a function of capturing a still image. The camera also has a function of capturing video. It is to be noted that the functions of the camera illustrated in FIG. 55 are not limited to these functions, and the camera can have various functions.

FIG. 56 illustrates a computer including: a keyboard 561; and a touch-pad 562. The computer illustrated in FIG. 56 has a function of displaying various information items (a still image, video, a text image, etc.) on a display portion. It is to be noted that the function of the computer illustrated in FIG. 56 is not limited to this, and the computer can have various functions.

It is possible to upgrade the image quality of the above-described information devices illustrated in the above-described FIG. 54, FIG. 55, and FIG. 56, by employing the display apparatus (display panel) or the driving system described in the above-described embodiments in the configuration of the display portions of the electronic devices. In addition, it is possible to easily perform test or adjustment.

It is possible to arbitrarily combine the above-described embodiments with other embodiments.

For example, it should be understood that the display apparatus (display panel) illustrated or explained in the above-described embodiments can be employed as the display apparatus of the laptop personal computer illustrated in FIG. 56, or can be included in information devices.

In addition, the details described in each of the diagrams or the like can be combined with other embodiments without notification. For example, it is possible to configure the information display apparatuses illustrated in FIG. 54, FIG. 55, and FIG. 56 by adding a touch-panel or the like to the display apparatus according to the above-described embodiments illustrated in, for example, FIG. 3, FIG. 10, FIG. 15, and FIG. 43.

The display apparatus according to the above-described embodiments is the concept including a system device such as an information device. The concept of the display panel includes a system device such as an information device in a broad sense.

In the above-described embodiments, the image display apparatus has been described. However, it should be understood that the technical idea described in the Description can be applied not only to the image display apparatus but also to other display apparatuses.

The display apparatus according to the above-described embodiments is the concept including a system device such as an information device. The concept of the display panel includes a system device such as an information device in a broad sense.

As described above, the embodiments are presented as exemplifications of the technique according to the present disclosure. The attached Drawings and the detailed descriptions are provided for that purpose.

Accordingly, the structural elements described in the attached Drawings and the detailed descriptions may include not only the structural elements which are essential for solving the problems but also the structural elements which are not essential for solving the problems but used for exemplifying the above-described techniques. As such, description of these non-essential structural elements in the accompanying Drawings and the detailed description should not be taken to mean that these non-essential structural elements are essential.

Furthermore, since the foregoing embodiments are for exemplifying the techniques according to the present disclosure, various changes, substitutions, additions, omissions, and so on, can be carried out within the scope of the Claims or its equivalents.

INDUSTRIAL APPLICABILITY

The present disclosure provides an image display apparatus which includes a gate driver integrated circuit that is highly versatile and can be used irrespective of the number and arrangement of terminals of gate signal lines and irrespective of the specification or the like of the image display apparatus, and is useful as an image display apparatus such as active-matrix image display apparatus including a current light-emitting element.

REFERENCE SIGNS LIST

10 image display apparatus
11 display panel
12, 112 pixel circuit
14 first gate driver circuit
15 second gate driver circuit
16 source driver circuit
21 source signal line
22 first gate signal line
23 second gate signal line
28 power line
29 power line
30 gate driver integrated circuit (gate driver circuit)
32 gate signal line driving unit (gate signal line outputting circuit)
36 shift register unit
38 voltage outputting unit
42 D-type flip-flop
44 AND gate
46 level shift unit
47 transistor
48 transistor
50 gate driver integrated circuit (gate driver circuit)
52 gate signal line driving unit
56 shift register unit
58 voltage outputting unit
70 selector
72 D-type flip-flop
74 AND gate
76 level shift unit
77 transistor
78 transistor
114 gate driver circuit
115 gate driver circuit
121 source signal line
122 gate signal line
123 gate signal line
124 gate signal line
125 gate signal line
128 anode power line
129 cathode power line
130 gate driver integrated circuit (gate driver circuit)
132 gate signal line driving unit
136 shift register unit

138 voltage outputting unit
142 D-type flip-flop
144 AND gate
146 level shift unit
147 transistor
148 transistor
191 COF
192 display screen
193 source printed circuit board
194 gate printed circuit board
234 gate signal line driving unit
236 shift register unit
238 voltage outputting unit
451 COF line
453 driver input terminal
454 connecting terminal
455 output terminal
456 driver output terminal
457 operating terminal
541 EL display apparatus
542 support column
543 holding base
551 button
552 viewfinder
553 cursor
561 keyboard
562 touch-pad
C20, C120 capacitor
D20, D120 EL element
Q20, Q120 driving transistor
Q22, Q23, Q122, Q123, Q124, Q125 switching transistor
CkA, CkB, CkC, CkD clock input terminal
DinA, DinB, DinC, DinD data input terminal
EneA, EneB, EneC, EneD enable input terminal
Din/out, Dout/in data input and output terminal
DoutA, DoutB, DoutC, DoutD data output terminal
OutA1, OutBi, OutCi, OutDi output terminal
VonA, VonB, VonC, VonD, VoffA, VoffB, VoffC, VoffD power supply terminal
u/dA, u/dB control terminal
Ti initialization period
To detecting period
Tw, Tw1, Tw2, Twi writing period
Td, Td1, Td2, Tdi display period
CK1, CK2, CK3 clock
DI1, DI2, DI3, DI4, DI5 signal
EN1, EN2, EN3, EN4, EN5 enable signal
CNT22, CNT122 first control signal (write controlling signal)
CNT23, CNT123 second control signal (display controlling signal)
CNT124, CNT125 control signal
Vsg video signal voltage
Vos offset voltage
V22off, V22on, V23off, V23on, V122off, V122on, V123off, V123on, V124off, V124on, V125off, V125on, Vini, Vref, Vdd, Vss voltage

The invention claimed is:

1. An image display apparatus comprising:
a display screen including pixels arranged in a matrix and L effective pixel rows, where L is an integer not less than 2, each of the pixels having a light-emitting element;
N gate signal lines disposed for each of the L effective pixel rows, where N is an integer not less than two;
a source signal line disposed for each pixel column;
a first gate driver circuit;
a second gate driver circuit; and
a source driver circuit which outputs a video signal to the source signal line,
wherein the first gate driver circuit and the second gate driver circuit each include N shift register circuits,
among the N gate signal lines disposed for each of the L effective pixel rows, each of a gate signal lines has one end connected to the first gate driver circuit and an other end connected to the second gate driver circuit, where a is an integer not less than one and not more than (N−1),
an M1th stage of each of a first to Nth ones of the N shift register circuits of the first gate driver circuit is electrically connected to a first to Nth ones of the N gate signal lines in an M1th one of the L effective pixel rows, where M1 is an integer not less than one and not more than L, and
an M2th stage of each of a (a+1)th to Nth ones of the N shift register circuits of the second gate driver circuit is electrically connected to a first to ath ones of the N gate signal lines in one of the L effective pixel rows other than an M2th one of the L effective pixel rows, where M2 is an integer not less than one and not more than L×a/N.

2. The image display apparatus according to claim 1,
wherein each of the first gate driver circuit and the second gate driver circuit:
includes a control terminal;
has a first operation mode in which a scanning signal including an ON voltage and a first OFF voltage is applied to the N gate signal lines;
has a second operation mode in which a scanning signal including the ON voltage, the first OFF voltage, and a second OFF voltage is applied to the N gate signal lines; and
selects one of the first operation mode and the second operation mode based on a logic signal applied to the control terminal of each of the first gate driver circuit and the second gate driver circuit.

3. The image display apparatus according to claim 1,
wherein an operation clock of each of the N shift register circuits of the first gate driver circuit is different from an operation clock of each of N shift register circuits of the second gate driver circuit.

4. The image display apparatus according to claim 1,
wherein each of the pixels includes a switching transistor to which a video signal transmitted from the source driver circuit is applied, and
a scanning signal including an ON voltage, a first OFF voltage, and a second OFF voltage is applied to one of the N gate signal lines to which a gate terminal of the switching transistor is connected.

5. The image display apparatus according to claim 1,
wherein each of the pixels includes a switching transistor to which a video signal transmitted from the source driver circuit is applied, and
the switching transistor includes a gate terminal connected to a corresponding one of the N gate signal lines having one end connected to the first gate driver circuit and an other end connected to the second gate driver circuit.

6. The image display apparatus according to claim 1,
wherein each of the first gate driver circuit and the second gate driver circuit has a function of inverting a scanning direction.

7. The image display apparatus according to claim 1, wherein the light-emitting element is an EL (electroluminescence) display element.

8. An image display apparatus comprising:

a display screen including pixels arranged in a matrix, each of the pixels having a light-emitting element;

a first gate signal line and a second gate signal line each disposed for each pixel row;

a source signal line disposed for each pixel column;

a first gate driver circuit;

a second gate driver circuit; and a source driver circuit which outputs a video signal to the source signal line, wherein the first gate driver circuit is connected to one end of each of the first gate signal line and the second gate signal line, the second gate driver circuit is connected to an other end of the first gate signal line, the first gate driver circuit and the second gate driver circuit each apply a first scanning signal to the first gate signal line, the first gate driver circuit applies a second scanning signal to the second gate signal line, and the first gate driver circuit is configured to be controlled according to a first operation mode in which two voltages are applied to the second gate signal line and a second operation mode in which three voltages are applied to the first gate signal line, with one of the first operation mode and the second operation mode being selected based on a control signal.

9. The image display apparatus according to claim 8, wherein the first gate driver circuit:

includes a control terminal has the first operation mode in which a scanning signal including an ON voltage and a first OFF voltage is applied to the second gate signal line;

has the second operation mode in which a scanning signal including the ON voltage, the first OFF voltage, and a second OFF voltage is applied to the first gate signal line; and selects one of the first operation mode and the second operation mode based on a logic signal applied to the control terminal.

10. The image display apparatus according to claim 8, wherein an operation clock of a shift register of the first gate driver circuit is different from an operation clock of a shift register of the second gate driver circuit.

11. The image display apparatus according to claim 8, wherein each of the pixels includes a switching transistor to which a video signal transmitted from the source driver circuit is applied, and a scanning signal including an ON voltage, a first OFF voltage, and a second OFF voltage is applied to one of the first gate signal line and the second gate signal line to which a gate terminal of the switching transistor is connected.

12. The image display apparatus according to claim 8, wherein each of the pixels includes a switching transistor to which a video signal transmitted from the source driver circuit is applied, and the switching transistor includes a gate terminal connected to one of the first gate signal line and the second gate signal line having one end connected to the first gate driver circuit and an other end connected to the second gate driver circuit.

13. The image display apparatus according to claim 8, wherein each of the first gate driver circuit and the second gate driver circuit has a function of inverting a scanning direction.

14. The image display apparatus according to claim 8, wherein the light-emitting element is an EL (electroluminescence) display element.

15. An image display apparatus comprising:

a display screen including pixels arranged in a matrix and L effective pixel rows, where L is an integer not less than 2, each of the pixels having a light-emitting element;

N gate signal lines disposed for each of the L effective pixel rows, where N is an integer not less than two;

a source signal line disposed for each pixel column;

a first gate driver circuit;

a second gate driver circuit; and a source driver circuit which outputs a video signal to the source signal line, wherein the first gate driver circuit includes a plurality of first shift register circuits each having L stages, and the second gate driver circuit includes N second shift register circuits each having L/N stages.

16. The image display apparatus according to claim 15, wherein an operation clock of each of the first shift register circuits of the first gate driver circuit is different from an operation clock of each of the N second shift register circuits of the second gate driver circuit.

17. The image display apparatus according to claim 15, wherein each of the pixels includes a switching transistor to which a video signal transmitted from the source driver circuit is applied, and a scanning signal including an ON voltage, a first OFF voltage, and a second OFF voltage is applied to one of the N gate signal lines to which a gate terminal of the switching transistor is connected.

18. The image display apparatus according to claim 15, wherein each of the pixels includes a switching transistor to which a video signal transmitted from the source driver circuit is applied, and the switching transistor includes a gate terminal connected to a corresponding one of the N gate signal lines having one end connected to the first gate driver circuit and an other end connected to the second gate driver circuit.

19. The image display apparatus according to claim 15, wherein each of the first gate driver circuit and the second gate driver circuit has a function of inverting a scanning direction.

20. The image display apparatus according to claim 15, wherein the light-emitting element is an EL (electroluminescence) display element.

* * * * *